US008187448B2

(12) United States Patent
Rousseau et al.

(10) Patent No.: US 8,187,448 B2
(45) Date of Patent: May 29, 2012

(54) CRYSTALLINE CHROMIUM ALLOY DEPOSIT

(75) Inventors: Agnes Rousseau, Rock Hill, SC (US); Craig V. Bishop, Grafton, OH (US)

(73) Assignee: Atotech Deutschland GmbH, Berlin (DE)

( * ) Notice: Subject to any disclaimer, the term of this patent is extended or adjusted under 35 U.S.C. 154(b) by 510 days.

(21) Appl. No.: 12/244,327

(22) Filed: Oct. 2, 2008

(65) Prior Publication Data

US 2009/0114544 A1 May 7, 2009

Related U.S. Application Data

(60) Provisional application No. 60/976,805, filed on Oct. 2, 2007.

(51) Int. Cl.

| | |
|---|---|
| ***C25D 3/56*** | (2006.01) |
| ***C25D 3/04*** | (2006.01) |
| ***C25D 3/06*** | (2006.01) |
| ***C25D 3/10*** | (2006.01) |

(52) U.S. Cl. ..... 205/243; 205/283; 205/287; 205/289; 205/290

(58) Field of Classification Search ..... 205/243, 205/283, 287, 289, 290

See application file for complete search history.

(56) References Cited

U.S. PATENT DOCUMENTS

| | | | | |
|---|---|---|---|---|
| 900,597 | A | 10/1908 | Salzer | |
| 1,496,845 | A | 6/1924 | Grube | |
| 2,470,378 | A | 5/1949 | Skala et al. | 23/87 |
| 2,927,066 | A | 3/1960 | Schaer | 204/43 |
| 2,962,428 | A | 11/1960 | Passal | 204/51 |
| 3,649,479 | A | 3/1972 | Icxi | 204/51 |
| 3,788,957 | A | 1/1974 | Christie | 204/51 |
| 3,833,485 | A | 9/1974 | Crowther et al. | 204/43 |
| 3,954,574 | A | 5/1976 | Gyllenspetz et al. | 204/43 |
| 4,038,160 | A | 7/1977 | Crowther et al. | 204/51 |
| 4,054,494 | A | 10/1977 | Gyllenspetz et al. | 204/43 |
| 4,062,740 | A | 12/1977 | Bauer et al. | 204/51 |
| 4,093,521 | A | 6/1978 | Renton et al. | 204/43 |

(Continued)

FOREIGN PATENT DOCUMENTS

| | | |
|---|---|---|
| DE | 1098066 | 12/1994 |

(Continued)

OTHER PUBLICATIONS

Wang et al., "Study of Formic Acid-Methanol-Urea Trivalent Chromium Plating System", Diandu Yu Huanbao (no. month, 2005), vol. 25, No. 3, pp. 5-7.*

(Continued)

*Primary Examiner* — Edna Wong

(74) *Attorney, Agent, or Firm* — Renner, Otto, Boisselle & Sklar

(57) ABSTRACT

An electrodeposited crystalline functional chromium deposit which is nanogranular as deposited, and the deposit may be both TEM and XRD crystalline or may be TEM crystalline and XRD amorphous. In various embodiments, the deposit includes one or any combination of two or more of an alloy of chromium, carbon, nitrogen, oxygen and sulfur; a {111} preferred orientation; an average crystal grain cross-sectional area of less than about 500 $nm^2$; and a lattice parameter of 2.8895+/−0.0025 A. A process and an electrodeposition bath for electrodepositing the nanogranular crystalline functional chromium deposit on a substrate, including providing the electrodeposition bath including trivalent chromium, a source of divalent sulfur, a carboxylic acid, a source of nitrogen and being substantially free of hexavalent chromium; immersing a substrate in the bath; and applying an electrical current to electrodeposit the deposit on the substrate.

22 Claims, 17 Drawing Sheets

(a) XRD and TEM amorphous
(b) XRD amorphous and TEM crystalline
(c) XRD and TEM crystalline
(d) XRD crystalline from conventional chromium (hexavalent chromium)

U.S. PATENT DOCUMENTS

| | | | | |
|---|---|---|---|---|
| 4,142,948 | A * | 3/1979 | Tajima et al. | 205/243 |
| 4,157,945 | A | 6/1979 | Ward et al. | |
| 4,161,432 | A | 7/1979 | Barclay et al. | 204/51 |
| 4,167,460 | A | 9/1979 | Tomaszewski | 204/51 |
| 4,180,639 | A | 12/1979 | Caporiccio et al. | 526/243 |
| 4,293,620 | A | 10/1981 | Vigar | 428/667 |
| RE31,508 | E | 1/1984 | Barclay et al. | 204/43 |
| 4,432,843 | A | 2/1984 | Tremmel | |
| 4,448,648 | A | 5/1984 | Barclay et al. | 204/51 |
| 4,448,649 | A | 5/1984 | Barclay et al. | 204/51 |
| 4,450,052 | A | 5/1984 | McMullen et al. | 204/51 |
| 4,461,680 | A | 7/1984 | Lashmore | 204/41 |
| 4,472,250 | A | 9/1984 | Barclay et al. | 204/51 |
| 4,473,448 | A | 9/1984 | Deeman | |
| 4,477,318 | A | 10/1984 | Tomaszewski | 204/51 |
| 4,502,927 | A | 3/1985 | Barclay et al. | |
| 4,507,178 | A | 3/1985 | Barclay | 204/29 |
| 4,543,167 | A | 9/1985 | Seyb, Jr. et al. | 204/51 |
| 4,610,763 | A | 9/1986 | Law | 204/35.1 |
| 4,612,091 | A | 9/1986 | Benaben et al. | 204/51 |
| 4,673,471 | A | 6/1987 | Kagechika et al. | 204/44.5 |
| 4,690,735 | A | 9/1987 | Laitinen et al. | 204/37.1 |
| 4,804,446 | A | 2/1989 | Lashmore et al. | 204/51 |
| 4,877,494 | A | 10/1989 | Kanamaru et al. | 204/28 |
| 4,897,317 | A | 1/1990 | Kanamaru et al. | 428/629 |
| 4,960,735 | A | 10/1990 | Mehrotra et al. | 204/37.1 |
| 5,196,109 | A | 3/1993 | Scott | 205/289 |
| 5,269,905 | A | 12/1993 | Reynolds | 205/101 |
| 5,273,643 | A | 12/1993 | Hasegawa et al. | 205/155 |
| 5,294,326 | A | 3/1994 | Shahin | 205/287 |
| 5,338,433 | A | 8/1994 | Maybee et al. | 205/178 |
| 5,352,266 | A | 10/1994 | Erb et al. | 75/300 |
| 5,415,763 | A | 5/1995 | Johnson et al. | 205/287 |
| 5,433,797 | A | 7/1995 | Erb et al. | 148/304 |
| 5,578,167 | A | 11/1996 | Sooriakumar et al. | 156/654.1 |
| RE35,730 | E | 2/1998 | Reynolds | 205/101 |
| 5,770,090 | A | 6/1998 | Lewis, III | 210/662 |
| 5,868,917 | A | 2/1999 | Benaben | 205/109 |
| 6,329,071 | B1 | 12/2001 | Kobayashi et al. | |
| 6,719,852 | B2 | 4/2004 | Oshima et al. | 148/243 |
| 6,736,954 | B2 | 5/2004 | Cobley et al. | 205/238 |
| 6,773,573 | B2 | 8/2004 | Gabe et al. | 205/296 |
| 6,858,098 | B2 | 2/2005 | Oshima et al. | 148/267 |
| 6,911,068 | B2 * | 6/2005 | Cobley et al. | 106/1.25 |
| 2001/0054557 | A1 * | 12/2001 | Taylor et al. | 205/103 |
| 2003/0070934 | A1 | 4/2003 | Cobley et al. | 205/263 |
| 2004/0074778 | A1 | 4/2004 | Cobley et al. | 205/261 |
| 2004/0206631 | A1 | 10/2004 | Cobley et al. | 205/291 |
| 2005/0126922 | A1 * | 6/2005 | Narita et al. | 205/238 |
| 2005/0284769 | A1 | 12/2005 | Edigaryan | 205/287 |
| 2007/0227895 | A1 | 10/2007 | Bishop et al. | |
| 2008/0166531 | A1 | 7/2008 | Schuh et al. | |
| 2008/0169199 | A1 * | 7/2008 | Huang et al. | 205/210 |

FOREIGN PATENT DOCUMENTS

| | | |
|---|---|---|
| GB | 2 124 656 | 2/1984 |
| GB | 2141138 | 12/1984 |
| GB | 2171114 | 8/1986 |
| JP | 53-108041 A | 9/1978 |
| JP | 53108041 A * | 9/1978 |
| JP | 03255270 | 11/1991 |
| WO | 82/03095 | 9/1982 |

OTHER PUBLICATIONS

Song et al.; "Pulse Plating of Hard Chromium from a Trivalent Chromium Bath"; *Plating and Surface Finishing*; vol. 87, No. 9, pp. 80-87 (2000).

Kawamura et al.; "Hard Chromium plating system using trivalent chromium Bath Containing Ammonium Chloride and Glycine"; Masushi Institute of Technology; PowerPoint presented at ECOCHROM, Jan. 24-26, 2006, San Diego; 35 pages.

Test of 100 liter Hoshino bath in Koka Chrom. Co. Ltd.; PowerPoint presented at ECOCHROM, Jan. 24-26, 2006, San Diego; 16 pages.

ECOCHROM; A Growth-IMS project; Hard Chrome Alternatives Team; PowerPoint presented at ECOCHROM, Jan. 24-26, 2006, San Diego; 16 pages.

ECOCHROM; A Growth-IMS project; Eco-efficient hard chrome chromium process; PowerPoint presented at ECOCHROM, Jan. 24-26, 2006, San Diego; 28 pages.

ECOCHROM: Results Jan. 25, 2006; Ecole Nationale Superieure des Mines; PowerPoint presented at ECOCHROM, Jan. 24-26, 2006, San Diego; 41 pages.

McDougall et al.; Chromium electrodeposition using a chromium(III) glycine complex; *Journal of Applied Electrochemistry* 28 (1998) 929-934.

Nakade et al.; Electrodeposition of Cr-P-C Alloy Film from Trivalent Chromium Bath; Technology Research Inst. of Osaka Pref.; Vo. 49, No. 9, 1998.

Watson; "The Development of Trivalent Chromium Plating"; Presented at a conference in England, Apr. 1992.

Zhenmi et al.; "Behaviours of Trichrome Electroplating in Cathode Polarization"; Harbin Institute of Technology. Date Unknown.

Hoare; "On the Role of Additives in a Trivalent chromium Plating Bath"; General Motors Research Laboratories; 1985.

Szynkarczuk et al.; "Electrodeposition of chromium from Cr(III) electrolytes in the presence of formic acid"; Institute of Inorganic Technology and Mineral Fertilizers; pp. 933-936; 1989.

Snyder; "The Decorative Colors of Trivalent Chromium Deposits"; AESF SUR/FIN® 2002 Proceedings.

Kudryavtsev et al.; "Thick Chromium Electroplating from Cr (III) Bath"; Mendeleyev University of Chemical Technology.

Cherrat et al.; "Fundamental Study of Electrodeposition of Chromium in Fused Salts by Pulse Techniques"; *Material Science Forum*; vol. 73-75 (1991); pp. 349-356.

Tomashova et al.; "Mechanism of the Electrodeposition of chromium from Trivalent Compounds"; Translated from *Zashchita Metallov*, vol. 4, No. 4, pp. 403-408, Jul.-Aug. 1968.

El-Sharif et al.; "Environmentally Acceptable Process for Electrodeposition of Hard Chromium From Chromium (III) Electrolyte"; *Trans IMF*; 1995, 73(1), 19-25.

Zweynert et al.; "Alternative Anode Reactions for Electrodeposition of Chromium From Cr (III) Baths"; *Dechema-Monographien*; vol. 125, pp. 453-458; (Date uncertain but 1995 or before).

Howarth et al.; "The electrodeposition of chromium from chromium (III) solutions—a study using microelectrodes"; *Journal of Applied Electrochemistry* 18 (1988) 644-652.

Barclay et al.; "A New Trivalent Chromium Electroplating Solution"; Proceedings of Interfinish 80; 1980; pp. 79-83.

Hoare; "On the Role of Additives in a Trivalent Chromium Plating Bath"; General Motors Research Laboratories; for Presentation at the American Electroplaters' Society, 1985.

Vinokurov et al.; "Certain Laws of the Electrodeposition of a Chromium-Phosphorus Alloy"; Translated from Zashchita Metallov, vol. 27, No. 3, pp. 448-452, May-Jun. 1991.

Tu et al.; "Pulse Plating with a Trivalent Chromium Plating Bath"; *Plating and Surface Finishing*; Oct. 1990.

Hsieh et al.; "The Electron Spectroscopy of Chromium Deposits from Trivalent and Hexavalent Chromium Baths"; *Metal Finishing*; Mar. 1991.

Watson et al.; "The role of chromium II catalyzed olation reactions in the sustained deposition of chromium and its alloys from environmentally acceptable chromium III electrolytes"; Paper presented at 1990 IMF Annual Meeting.

Danilov et al.; "Influence of Electrolyte Composition on Cr(III) Oxidation at Manganese Dioxide Anodes"; Translated from *Elektrokhimiya*; vol. 26, No. 9, pp. 1185-1187, Sep. 1990.

Hwang; "Trivalent Chromium Electroplating for Baths Containing Hypophosphite Ions"; *Plating and Surface Finishing*; May 1991.

Newby; "What Seems to be Holding Back Functional Trivalent Chromium Plating"; Paper presented at IVth International Chromium Colloquium; May 2004.

Willis; "Structure of chromium deposits from plating solutions containing trivalent and hexavalent chromium"; *Materials Science and Technology*, vol. 2, Jun. 1986.

Hong et al.; "Hard Chromium Plating From Trivalent Chromium Solution"; *Plating and Surface Finishing*; Mar. 2001.

Suvegh; "Application of positron lifetime spectroscopy to the study of electrodeposited chromium layers"; *Journal of Electroanalytical Chemistry* 455 (1998) 69-73.

Lee et al.; "Grain Orientations in Electrolytic High Contraction and Low Contraction Chromium Deposition"; JCPDS—International Centre for Diffraction Data, 1999, pp. 707-717.
Edigaryan et al.; "Electroplating from Concentrated Cr(III) Sulfate Solutions and the Properties of Chromium Deposits"; *Protection of Metals*; vol. 34, No. 2, 1998, pp. 95-100.
Edigaryan et al.; "Effect of Fluoride Ions on Chromium Deposition from Sulfuric Acid Solutions of Cr(III)"; Protection of Metals; vol. 35, No. 1, 1999, pp. 1-3.
Edigaryan et al.; "Chromium Deposition from Diluted Sulfate Solutions"; *Protection of Metals*; vol. 32, No. 5, 1996, pp. 461-464.
Edigaryan et al.; "Anodic Processes in Chromium Electrodeposition from Cr(III) Sulfate Solution"; Protection of Metals; vol. 34, No. 6, 1998, pp. 545-548.
Danilov et al. "Anodic Processes in a Sulfate Electrolyte on the Basis of Trivalent Chromium Salts"; translated from Elektrokhimiya, vol. 23, No. 7, pp. 988-991, Jul. 1987.
Shichi Ishida et al.; "Effects of Adding an Aluminum Salt to a Trivalent Chromium Plating Bath"; *Journal of the Hard Chrome Platers Association of Japan*; vol. 17, No. 2, Oct. 31, 2002, and English language translation attached.
Polukarov et al.; "Chrome Plating from Sulfate-Oxalate Cr(III) Baths. Structure, Composition, and Corrosion Behavior"; *Protection of Metals*, Vo. 37, No. 5, 2001, pp. 447-451.
Baral et al.; "Modeling, Optimization, and Comparative Analysis of Trivalent Chromium Electrodeposition from Aqueous Glycine and Formic Acid Baths"; *Journal of the Electrochemical Society*; 152 (7) C504-0512 (2005).
International Search Report and Written Opinion, Application No. PCT/US2007/065345, mailed Aug. 23, 2007.
Sakamoto; "On the crystal structures and electrolytic conditions of chromium electrodeposits"; Journal of the Japan Institute of Metals; vol. 36, No. 5, May 1972, pp. 450-457.
Translation of Sakamoto; "On the crystal structures and electrolytic conditions of chromium electrodeposits"; Journal of the Japan Institute of Metals; vol. 36, No. 5, May 1972, pp. 450-457.
Sillers Jr.; "Note on the crystal structure of electrodeposited chromium"; Transations of the American Electrochemical Society; vol. 52, 1927, pp. 301-308.
Celchinski et al.; "Pulse Plating of Chromium-cobalt Alloys Containing a Phase with the A-15 Structure"; Journal of the Electrochemical Socity, vol. 129, No. 11, Nov. 1982, pp. 2433-2438.
Cleghorn et al.; "Structure of electrodeposited chromium"; Electrochimica Acts, Elsevier Science Publishers, vol. 13, No. 3, Mar. 1968, pp. 331-334.
Pangarov et al.; "Preferred orientation of electrodeposited iron crystallites"; Electrochimica ACTA, vol. 11, 1966, pp. 1719-1731.
International Search Report and Written Opinion, Application No. PCT/US2008/078561, mailed Oct. 2, 2008.
E.N. Lubnin; X-ray Photoelectron Spectroscopy of Chromium Layers Electroplated from Oxalate-Sulfate Solutions, Protection of Metals, vol. 36, No. 4, 2000, pp. 301-305.
Office Action mailed Apr. 29, 2011 for U.S. Appl. No. 13/026,342.

* cited by examiner (a) XRD and TEM amorphous
(b) XRD amorphous and TEM crystalline
(c) XRD and TEM crystalline
(d) XRD crystalline from conventional chromium (hexavalent chromium)

CRYSTALLINE CHROMIUM ALLOY DEPOSIT

CROSS-REFERENCE TO RELATED APPLICATION

The present application is related to and claims benefit under 35 U.S.C. §119(e) of U.S. Provisional Application 60/976,805, filed 2 Oct. 2007, the entirety of which is hereby incorporated herein by reference.

TECHNICAL FIELD

The present invention relates generally to electrodeposited TEM crystalline chromium alloy deposited from trivalent chromium baths, methods and baths for electrodepositing such chromium alloy deposits and articles having such chromium alloy deposits applied thereto.

BACKGROUND

Chromium electroplating began in the late $19^{th}$ or early $20^{th}$ century and provides a superior functional surface coating with respect to both wear and corrosion resistance. However, in the past, this superior coating, as a functional coating (as opposed to a decorative coating), has only been obtained from hexavalent chromium electroplating baths. Chromium electrodeposited from hexavalent chromium baths is deposited in a crystalline form, which is highly desirable. Amorphous forms of chromium plate are not useful for functional applications. The chemistry used in the conventional technology is based on hexavalent chromium ions, which are considered carcinogenic and known to be toxic. Hexavalent chromium plating operations are subject to strict and severe environmental limitations. While industry has developed many methods of working with hexavalent chromium to reduce the hazards, both industry and academia have for many years searched for a suitable alternative. The most often sought alternative has been trivalent chromium. Until the present inventor's recent successes, the efforts to obtain a dependable, reliable functional chromium deposit based on a trivalent chromium process has continued without success for over one hundred years. Additional discussion of the need for a replacement for hexavalent chromium is included in the earlier application related to the present assignee's efforts in the area of chromium deposits from trivalent chromium, published as WO 2007/115030, the disclosure of which is hereby incorporated herein by reference.

As is apparent from the plethora of prior art attempts to obtain a functional crystalline chromium deposit from trivalent chromium, there has long been ample motivation to seek this goal. However, as is equally apparent, this goal has been elusive and, prior to the present invention, has not been attained in the prior art, despite quite literally a hundred years of trying.

For all these reasons, a long-felt need has remained unmet for (1) a crystalline-as-deposited functional chromium deposit, (2) an electrodeposition bath and process capable of forming such a functional chromium deposit, and (3) articles made with such a functional chromium deposit, in which the crystalline chromium deposit is free of macrocracks and is capable of providing the desired functional wear and corrosion resistance characteristics comparable to the conventional functional hard chromium deposit obtained from a hexavalent chromium electrodeposition process. The urgent need for a bath and process capable of providing a crystalline functional chromium deposit from a bath substantially free of hexavalent chromium heretofore has not been satisfied prior to the present invention and the present inventor's previous efforts as disclosed in WO 2007/115030.

SUMMARY

The present inventors have discovered and developed a process and bath for electrodepositing a nanogranular crystalline functional chromium alloy deposit from a trivalent chromium bath, substantially free of hexavalent chromium, in which the deposit obtained matches or exceeds the performance properties of a chromium deposit obtained from a hexavalent chromium process and bath. The alloy comprises chromium, carbon, nitrogen, oxygen and sulfur.

In one embodiment, the present invention relates to an electrodeposited crystalline functional chromium alloy deposit, in which the deposit is nanogranular as deposited. In one embodiment, the deposit is both TEM and XRD crystalline, as deposited. In another embodiment, the deposit is TEM crystalline and is XRD amorphous.

In any of the embodiments of the present invention, the deposit may include one or any combination of two or more of (a) a {111} preferred orientation; (b) an average crystal grain cross-sectional area of less than about 500 $nm^2$; and (c) a lattice parameter of 2.8895+/−0.0025 A.

In any of the foregoing embodiments of the invention, the deposit may include from about 0.05 wt. % to about 20 wt. % sulfur. The deposit may include nitrogen, in an amount from about 0.1 to about 5 wt % nitrogen. The deposit may include carbon, in an amount of carbon less than that amount which renders the chromium deposit amorphous. In one embodiment, the deposit may include from about 0.07 wt. % to about 1.4 wt. % sulfur, from about 0.1 wt. % to about 3 wt. % nitrogen, and from about 0.1 wt. % to about 10 wt. % carbon. In one embodiment, the deposit further comprises oxygen, from about 0.5 wt. % to about 7 wt. % of the deposit, and in another embodiment, the deposit comprises oxygen, from about 1 wt. % to about 5 wt. %. The deposit may also contain hydrogen.

In any of the foregoing embodiments of the invention, the deposit remains substantially free of macrocracking when subjected to a temperature of at least 190° C. for at least 3 hours and has a thickness in the range from about 3 microns to about 1000 microns.

In one embodiment, the invention further relates to an article including the deposit as described for any of the foregoing embodiments.

In one embodiment, the invention further relates to a process for electrodepositing a nanogranular crystalline functional chromium alloy deposit on a substrate, including:

providing an electrodeposition bath, in which the bath is prepared by combining ingredients including trivalent chromium, a source of divalent sulfur, a carboxylic acid, a source of $sp^3$ nitrogen, wherein the bath is substantially free of hexavalent chromium;

immersing a substrate in the electroplating bath; and applying an electrical current to electrodeposit a functional crystalline chromium alloy deposit on the substrate, in which the deposit is crystalline and nanogranular as deposited. In one embodiment of the process, the deposit is both TEM and XRD crystalline, and in another embodiment, the deposit is TEM crystalline and is XRD amorphous. The alloy comprises chromium, carbon, nitrogen, oxygen and sulfur.

In one embodiment of the process, the deposit obtained includes one or any combination of two or more of (a) a {111} preferred orientation; (b) an average crystal grain cross-sectional area of less than about 500 $nm^2$; and (c) a lattice parameter of 2.8895+/−0.0025 A.

In any of the foregoing embodiments of the process, the deposit may include from about 0.05 wt. % to about 20 wt. % sulfur. The deposit may include from about 0.1 to about 5 wt % nitrogen. The deposit may include from about 0.5 to about 7 wt. % oxygen. The deposit may include carbon, in an amount of carbon less than that amount which renders the chromium deposit amorphous. In one embodiment, the deposit comprises from about 0.07 wt. % to about 1.4 wt. % sulfur, from about 0.1 wt. % to about 3 wt. % nitrogen, about 1 wt. % to about 5 wt. % oxygen, and from about 0.1 wt. % to about 10 wt. % carbon.

In any of the foregoing embodiments of the process, the deposit remains substantially free of macrocracking when subjected to a temperature of at least 190° C. for at least 3 hours and has a thickness in the range from about 3 microns to about 1000 microns.

In any of the foregoing embodiments of the process, the source of divalent sulfur may be present in the electrodeposition bath at a concentration from about 0.0001 M to about 0.05 M.

In any of the foregoing embodiments of the process, the electrodeposition bath may include a pH in the range from 5 to about 6.5.

In any of the foregoing embodiments of the process, the applying an electrical current may be carried out for a time sufficient to form the deposit to a thickness of at least 3 microns.

In one embodiment, the present invention further relates to an electrodeposition bath for electrodepositing a nanogranular crystalline functional chromium alloy deposit, in which the bath is prepared by combining ingredients including a source of trivalent chromium having a concentration of least 0.1 molar and being substantially free of added hexavalent chromium; a carboxylic acid; a source of $sp^3$ nitrogen; a source of divalent sulfur, at a concentration in the range from about 0.0001 M to about 0.05 M; and in which the bath has a pH in the range from 5 to about 6.5; an operating temperature in the range from about 35° C. to about 95° C.; and a source of electrical energy to be applied between an anode and a cathode immersed in the electrodeposition bath.

In any of the foregoing embodiments of the process and/or of the electrodeposition bath, the source of divalent sulfur comprises one or a mixture of two or more of:

thiomorpholine, thiodiethanol,

L-cysteine,

L-cystine, allyl sulfide, thiosalicylic acid, thiodipropanoic acid, 3,3'-dithiodipropanoic acid, 3-(3-aminopropyl disulfanyl) propylamine hydrochloride,

[1,3]thiazin-3-ium chloride, thiazolidin-3-ium dichloride, a compound referred to as 3-(3-aminoalkyl disulfenyl)alkylamine having the formula:

$$R_3N^{\oplus}—(CH_2)_n—S—S—(CH_2)_m^{\oplus}—NR^1{}_32X^{\ominus}$$

wherein R and $R^1$ are independently H, methyl or ethyl and n and m are independently 1-4; or a compound referred to as a [1,3]thiazin-3-ium having the formula:

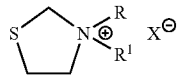

wherein R and $R^1$ are independently H, methyl or ethyl; or a compound referred to as a thiazolidin-3-ium having the formula:

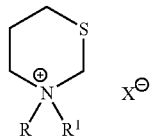

wherein R and $R^1$ are independently H, methyl or ethyl; and wherein in each of the foregoing, X may be any halide or an anion other than nitrate (—$NO_3^-$), comprising one or more of cyano, formate, citrate, oxalate, acetate, malonate, $SO_4^{-2}$, $PO_4^{-3}$, $H_2PO_3^{-1}$, $H_2PO_2^{-1}$, pyrophosphate ($P_2O_7^{-4}$), polyphosphate ($P_3O_{10}^{-5}$), partial anions of the foregoing multivalent anions (e.g., $HSO_4^{-1}$) $C_1$-$C_{18}$ alkyl sulfonic acids, $C_1$-$C_{18}$ benzene sulfonic acids, and sulfamate.

In any of the foregoing embodiments of the electrodeposition bath, the source of electrical energy is capable of providing a current density of at least 10 A/$dm^2$ based on an area of substrate to be plated.

In any of the foregoing embodiments of the electrodeposition bath, the bath may include a quantity of the source of nitrogen sufficient that the deposit comprises from about 0.1 to about 5 wt % nitrogen.

In any of the foregoing embodiments of the electrodeposition bath, the bath may include a quantity of the carboxylic acid sufficient that the chromium deposit comprises an amount of carbon less than that amount which renders the chromium deposit amorphous.

In any of the foregoing embodiments of the electrodeposition bath, the bath may include a quantity of the divalent sulfur compound, the source of nitrogen and the carboxylic acid sufficient that the deposit comprises from about 0.05 wt. % to about 1.4 wt. % sulfur, from about 0.1 wt. % to about 3 wt. % nitrogen, and from about 0.1 wt. % to about 10 wt. % carbon.

In any of the foregoing embodiments of the process and/or of the electrodeposition bath, the carboxylic acid may include one or more of formic acid, oxalic acid, glycine, acetic acid, and malonic acid or a salt of any thereof.

In any of the foregoing embodiments of the process and/or of the electrodeposition bath, the source of $sp^3$ nitrogen may include ammonium hydroxide or a salt thereof, a primary, secondary or tertiary alkyl amine, in which the alkyl group is a $C_1$-$C_6$ alkyl, an amino acid, a hydroxy amine, or a polyhydric alkanolamines, wherein alkyl groups in the source of nitrogen comprise $C_1$-$C_6$ alkyl groups.

In any of the foregoing embodiments of the process and/or of the electrodeposition bath, the bath may include the source of divalent sulfur at a concentration sufficient to obtain either (a) a deposit that is both TEM and XRD crystalline, as deposited or (b) a deposit that is TEM crystalline and XRD amorphous, as deposited.

The present invention, although possibly useful for formation of decorative chromium deposits, is primarily applicable to and most useful in preparation of functional chromium deposits, and in particular for functional TEM crystalline chromium alloy deposits which heretofore have only been available through hexavalent chromium electrodeposition processes. In one embodiment, the invention is useful for preparation of functional TEM crystalline but XRD amorphous chromium alloy deposits which heretofore have been unknown. In one embodiment, the invention is useful for preparation of functional TEM crystalline and XRD crystalline nanogranular chromium deposits which heretofore have been unknown.

The present invention provides a solution to the problem of providing a functional chromium deposit from a trivalent chromium bath substantially free of hexavalent chromium, in which the deposit is crystalline as deposited, and which is capable of providing a product with functional characteristics substantially equivalent to the functional characteristics obtained from hexavalent chromium electrodeposits. The invention provides a solution to the problem of replacing hexavalent chromium plating baths while still delivering the desired functional chromium which has been sought for so long.

Figure 1:
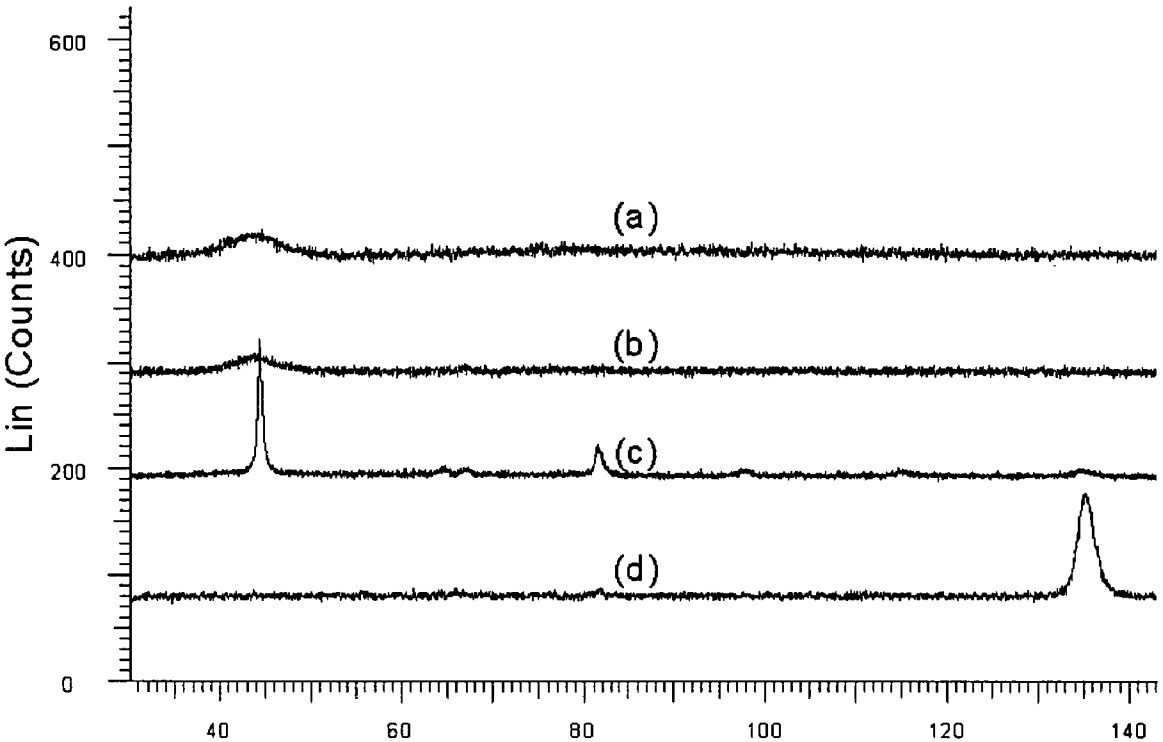
FIG. 1 includes four X-ray diffraction patterns (Cu k alpha) of two embodiments of nanogranular crystalline chromium alloy deposited in accordance with embodiments of the present invention, a hexavalent chromium of the prior art and an amorphous chromium deposit not in accordance with the present invention.

It should be appreciated that the process steps and structures described below may not necessarily form a complete process flow for manufacturing parts containing the functional crystalline chromium deposit of the present invention. The present invention can be practiced in conjunction with fabrication techniques currently used in the art, and only so much of the commonly practiced process steps are included as are necessary for an understanding of the present invention.

DETAILED DESCRIPTION

As used herein, a decorative chromium deposit is a chromium deposit with a thickness less than one micron, and often less than 0.8 micron which is primarily decorative in purpose and use and is typically applied over an electrodeposited nickel or nickel alloy coating, or over a series of copper and nickel or nickel alloy coatings whose combined thicknesses are in excess of three microns, and which provide the protective or other functional characteristics of the coating.

As used herein, a functional chromium deposit is a chromium deposit applied to (often directly to) a substrate such as strip steel ECCS (Electrolytically Chromium Coated Steel) where the chromium thickness is generally greater than 1 micron, most often greater than 3 microns, and is used for functional or industrial, not decorative, applications. Functional chromium deposits are generally applied directly to a substrate or over a relatively thin preparatory layer, in which the chromium layer, not the underlying layer(s), provides the sought protective or other functional characteristics of the coating. Functional chromium coatings take advantage of the special properties of chromium, including, e.g., its hardness, its resistance to heat, wear, corrosion and erosion, and its low coefficient of friction. Even though it has nothing to do with performance, many users want the functional chromium deposits to be like decorative chromium in appearance, so in some embodiments the functional chromium has a decorative appearance in addition to its functional properties. The thickness of the functional chromium deposit may range from the above-noted greater than 1 micron or, more often, to deposits having a thickness of 3 microns or much more, up to, e.g., 1000 microns. In some cases, the functional chromium deposit is applied over a 'strike plate' such as nickel or iron plating on the substrate or a 'duplex' system in which the nickel, iron or alloy coating has a thickness not usually greater than three microns and the chromium thickness generally is in excess of three microns.

The differences between decorative and functional chromium are well known to those of skill in the art. Strict specifications for functional chromium deposits have been developed by such standard setting organizations as ASTM. See, e.g., ASTM B 650-95 (Reapproved 2002) relating to the specification for functional or hard chromium, which is also sometimes referred to as engineering chromium. As stated in ASTM B 650, electrodeposited engineering chromium, which is also called "functional" or "hard" chromium, is usually applied directly to the basis metal and is much thicker than decorative chromium. As further stated in ASTM B 650, engineering chromium is used in the following exemplary purposes: to increase wear and abrasion resistance, to increase fretting resistance, to reduce static and kinetic friction, to reduce galling or seizing, or both, for various metal combinations, to increase corrosion resistance and to build up undersize or worn parts.

Decorative chromium plating baths are concerned with thin chromium deposits over a wide plating range so that articles of irregular shape are completely covered. Functional chromium plating, on the other hand, is designed for thicker deposits on regularly shaped articles, where plating at a higher current efficiency and at higher current densities is important. Previous chromium plating processes employing trivalent chromium ion have generally been suitable for forming only "decorative" finishes. The present invention provides "hard" or functional chromium deposits, but is not so limited, and can be used for decorative chromium finishes. "Hard", "engineering" or "functional" chromium deposits and "decorative" chromium deposits are known terms of art, as described above.

As used herein, when used with reference to, e.g., an electroplating bath or other composition, "substantially free of hexavalent chromium" means that the electroplating bath or other composition so described is free of any intentionally added hexavalent chromium. As will be understood, such a bath or other composition may contain trace amounts of hexavalent chromium present as an impurity in materials added to the bath or composition or as a by-product of electrolytic or chemical processes carried out with bath or composition. However, in accordance with the present invention, hexavalent chromium is not purposely or intentionally added to the baths or processes disclosed herein.

As used herein, macrocracks (and cognate terms such as macrocracking) are defined as and refer to cracks (or formation of cracks) that extend through the entire thickness of the chromium layer, down to the substrate, and that are formed primarily after annealing at temperatures in the range from about 190° C. to about 450° C. for a time sufficient to crystallize an amorphous chromium deposit. Such time is generally from about 1 to about 12 hours. Macrocracks primarily occur in chromium deposits that are about 12 microns or greater in thickness, but can also occur in less thick chromium deposits. As is known in the art, macrocracks are generally only observed after the part bearing the chromium deposit of interest has been heated to temperatures in the above range during which the crystalline structure is formed from the amorphous material. The minimum heat treatment for embrittlement relief (i.e., annealing) of electrodeposited chromium deposits is spelled out in AMS-QQ-C-320 paragraph 3.2.6 as 375° F. (190.5° C.) for 3, 8, and 12 hours, with the times dependent upon the desired tensile strength and/or Rockwell hardness. AMS-QQ-C-320 is the Aerospace Material Specification for Chromium Plating (Electrodeposited) published by SAE International, Warrendale, Pa. Under these conditions, macrocracking can occur.

As used herein, the term "preferred orientation" carries the meaning that would be understood by those of skill in the crystallographic arts. Thus, "preferred orientation" is a condition of polycrystalline aggregate in which the crystal orientations are not random, but rather exhibit a tendency for alignment with a specific direction in the bulk material. Thus, a preferred orientation may be, for example, {100}, {110}, {111} and integral multiples thereof, such as (222), in which the integral multiples of a specifically identified orientation, such as {111}, are deemed to be included with the specifically identified orientation, as would be understood by those of skill in the art. Thus, as used herein, reference to the {111} orientation includes integral multiples thereof, such as (222), unless otherwise specifically stated.

As used herein, the term "grain size" refers to the cross-sectional area of grains of the crystalline chromium deposit based on a TEM dark field image of representative or average grains, as determined using ImageJ 1.40 software, from the National Institutes of Health. Using the "analyze particles" subroutine of ImageJ, edge recognition of crystalline chromium grains may be obtained, the perimeters traced, and the areas calculated. ImageJ is well known for use in calculating the cross-sectional area of irregularly shaped particles by image analysis. Grain size is related to the yield strength of a material by relationships such as the Hall-Petch effect that states that yield strength increases as grain size decreases. Furthermore, it has been observed that small grains may improve corrosion resistance (see, e.g. U.S. Pat. No. 6,174,610, the disclosure of which is incorporated by reference for its teachings relating to grain size).

As used herein, the term "nanogranular" refers to crystalline chromium grains having an average grain size or cross-sectional area from about 100 square nanometers ($nm^2$) to about 5000 $nm^2$, as determined by the above grain size definition. By comparison, a crystalline chromium deposit that is XRD crystalline deposited according to applicant's prior published application WO 2007/115030, the crystalline chromium grains have an average grain size or cross-sectional area in the range from about 9,000 $nm^2$ to about 100,000 $nm^2$, and conventional chromium deposits from hexavalent chromium baths and processes have an average grain size or cross-sectional area in the range from about 200,000 $nm^2$ to about 800,000 $nm^2$, and larger. Thus, there are clear differences between the nanogranular crystalline chromium deposits made in accordance with the present invention and those of other methods.

As used herein, the term "TEM crystalline" means that a deposit so described is crystalline as determined by transmission electron microscopy (TEM). TEM is capable of determining that a deposit is crystalline when the crystal grains in the deposit have a size from about 1 nm and up, depending on the applied energy. A given material may be determined by TEM to be crystalline, when the same material is not determined to be crystalline by the usual X-ray diffraction technique in which X-rays from a Cu kα source are employed.

As used herein, the term "TEM amorphous" means that a deposit so described is amorphous as determined by TEM. A deposit is TEM amorphous when it is not found to be TEM crystalline at applied energy of up to 200,000 eV. Using TEM, a deposit is confirmed to be amorphous when the selected area diffraction (SAD) pattern, obtained from TEM, has broad rings that lack "diffraction spots".

As used herein, the term "XRD crystalline" means that a deposit so described is crystalline as determined by X-ray diffraction (XRD) with a copper k alpha (Cu kα) x-ray source. Cu kα XRD has been commonly used to determine whether deposits are crystalline for many years, and has long been the standard method of determining whether a given electrodeposited metal is or is not crystalline. In the prior art, essentially all determinations of crystallinity of chromium deposits have been determined on one or both of two bases: (1) whether the chromium deposit forms macrocracks when it is annealed at a temperature above about 190° C.; and/or (2) whether the deposit is or is not XRD crystalline as defined herein.

As used herein, the term "XRD amorphous" means that a deposit so described is amorphous as determined by X-ray diffraction (XRD) with a copper k alpha (Cu kα) X-ray source.

As will be understood by those of skill in the art, sufficiently energetic X-rays from an appropriately high-energy X-ray source may be able to discern and/or determine a grain size as small as 1 nm. Thus, the terms XRD crystalline and XRD amorphous, as used herein, are based on the use of a copper k alpha X-ray source.

With respect to TEM and XRD crystalline materials, the present inventors have discovered that some materials, such as certain embodiments of the chromium deposits in accordance with the present invention, are not XRD crystalline, but nevertheless are TEM crystalline. A deposit that is XRD crystalline is always TEM crystalline, but a TEM crystalline deposit may or may not be XRD crystalline. More significantly, the present inventors have discovered that chromium deposits having superior properties, in terms of one or more of hardness, wear resistance, durability and brightness, can be obtained from trivalent chromium electroplating baths, when the deposits are TEM crystalline but are XRD amorphous. Thus, in one embodiment, the present invention relates to a crystalline functional chromium deposit that is TEM crystalline and is XRD amorphous, the deposit also having a grain size as determined by cross-sectional area of less than about 500 $nm^2$ and in which the deposit contains carbon, nitrogen, oxygen and sulfur.

As used herein, the term "chromium (or Cr or chrome) deposit" includes both chromium and chromium alloys in which the chromium alloy retains the BCC crystal structure of chromium deposits. As disclosed herein, in one embodiment, the present invention includes a chromium deposit containing chromium, carbon, oxygen, nitrogen and sulfur, and possibly also hydrogen.

Figure 14:
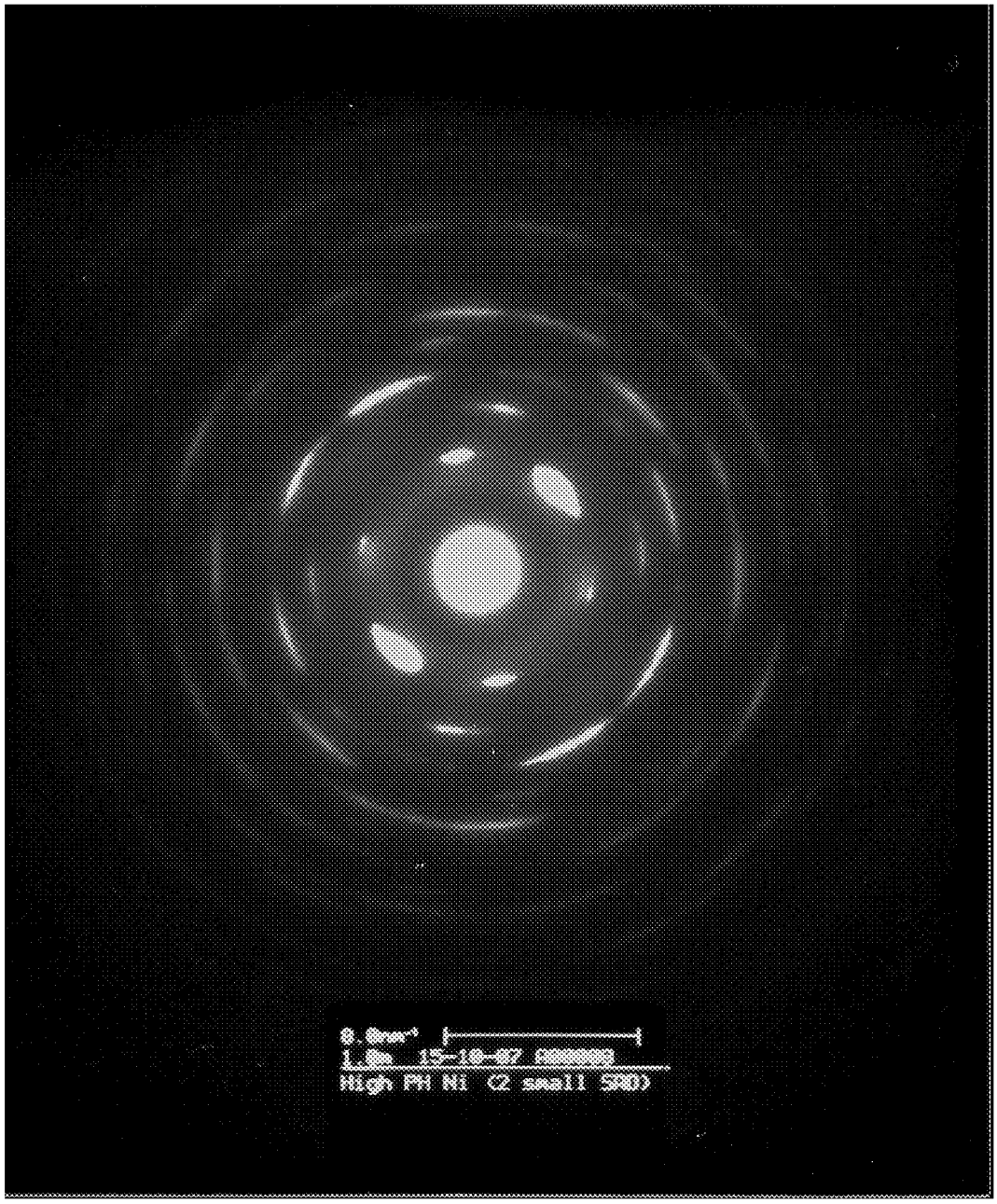
FIGS. 14-17 are TEM diffraction pattern photomicrographs of chromium deposits, in which the deposits are XRD crystalline, TEM crystalline but XRD amorphous, both XRD and TEM amorphous, and a conventional chromium deposit from a hexavalent chromium bath and process, respectively.
Figure 15:
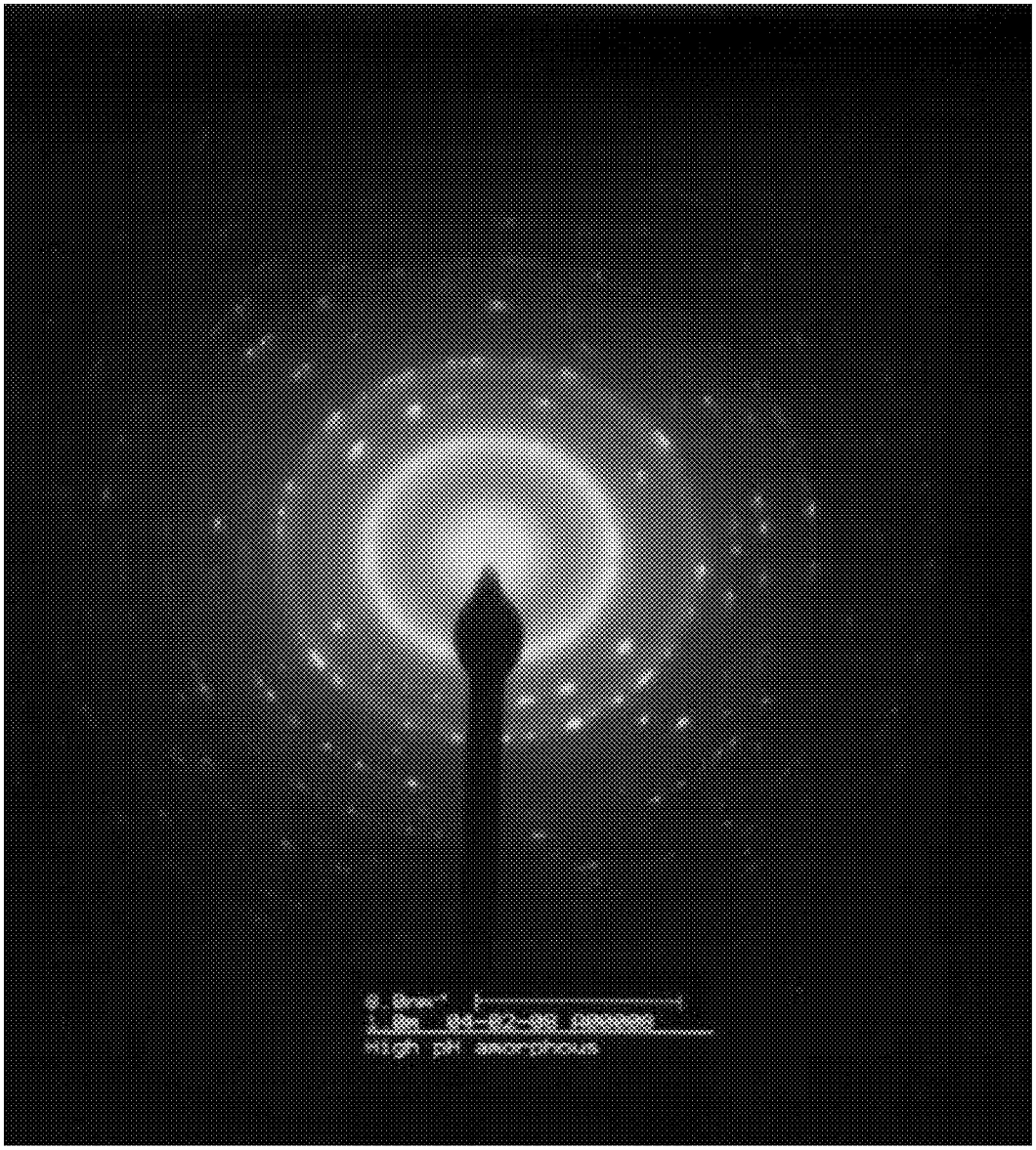
Figure 16:
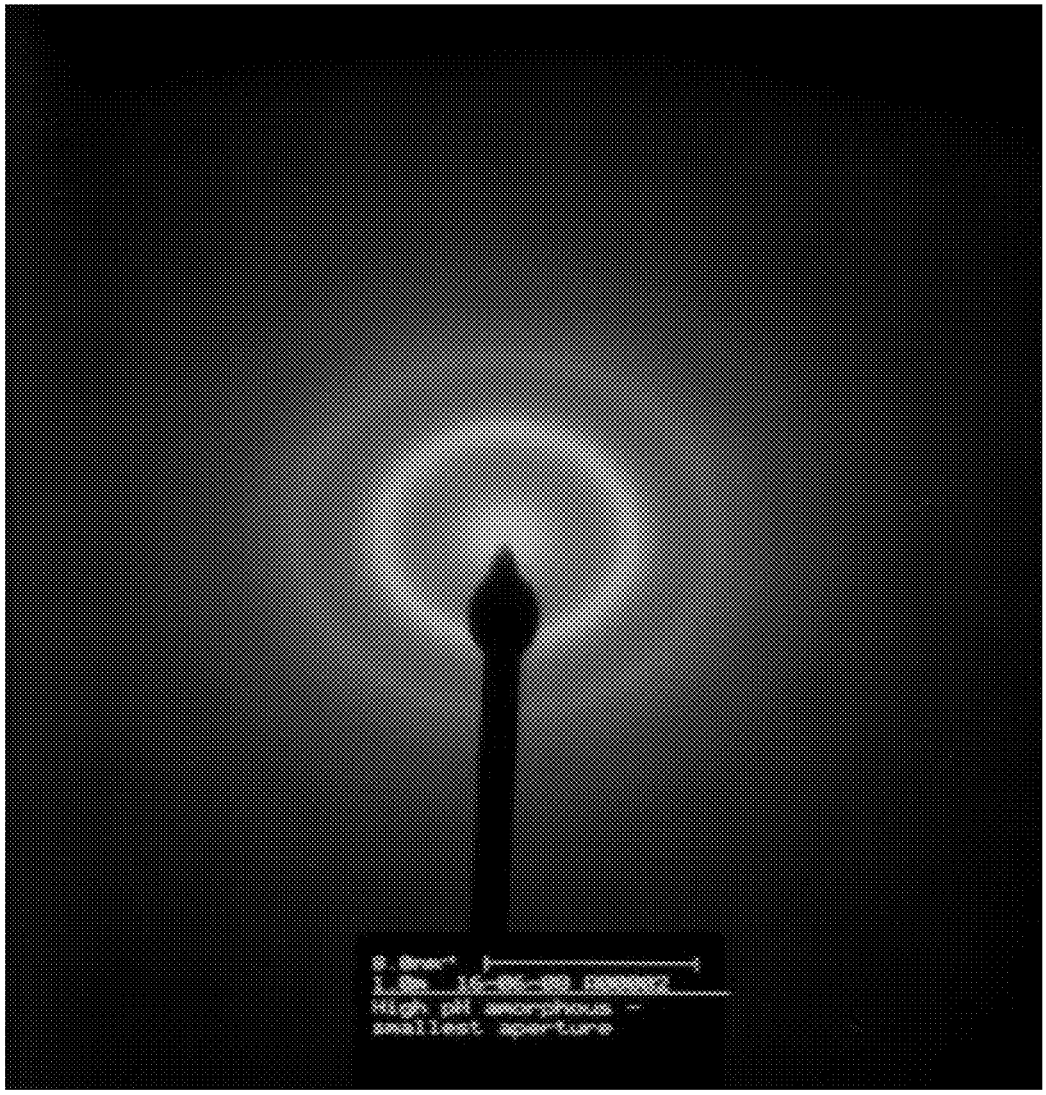
Figure 17:
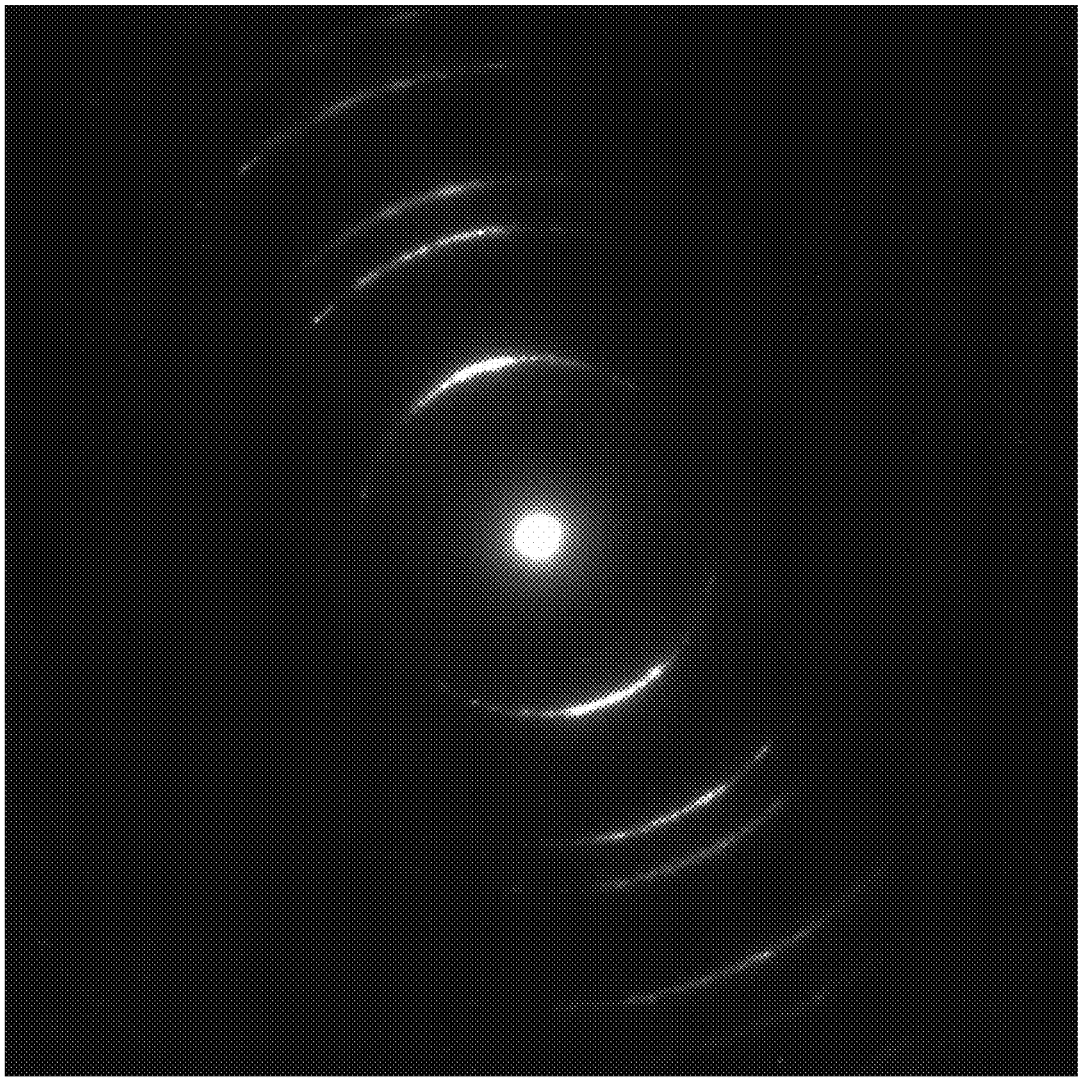

FIGS. 14-17 are TEM diffraction pattern photomicrographs of chromium deposits, in which the deposits are XRD crystalline, TEM crystalline but XRD amorphous, both XRD and TEM amorphous, and a conventional chromium deposit from a hexavalent chromium bath and process, respectively. As can be observed upon comparison of the photomicrographs in FIGS. 14-17, the differences between the TEM diffraction patterns for these chromium deposits is quite apparent. In FIG. 14, the chromium deposit is both XRD crystalline and TEM crystalline, in accordance with one embodiment of the present invention. Since the crystal grains in an XRD crystalline chromium deposit are relatively larger than the crystal grains in a deposit that is XRD amorphous and TEM crystalline, the diffraction pattern is stronger, presenting more discrete exposure of the film. In FIG. 15, the chromium deposit is XRD amorphous and TEM crystalline, in accordance with another embodiment of the present invention. Since the crystal grains are relatively smaller in a chromium deposit that is XRD amorphous and TEM crystalline than one that is both XRD and TEM crystalline, the diffraction pattern includes smaller, discrete exposure points and rings of diffuse reflections. In FIG. 16, the deposit is both XRD amorphous and TEM amorphous, and is not in accordance with the present invention. Since there are no crystal grains in a TEM amorphous chromium deposit, there are no discrete exposure points and relatively weak rings of diffuse reflections from the random chromium atoms in the deposit. Finally, in FIG. 17, for comparative purposes, a TEM diffraction pattern from a conventional chromium deposit from a hexavalent chromium bath and process is shown. Since the crystal grains in the conventional hexavalent chromium deposit are very much larger than the crystal grains in either alloy deposit according to the invention, i.e., a deposit that is both XRD and TEM crystalline or in a deposit that is XRD amorphous and TEM crystalline, the diffraction pattern is much stronger, presenting very strong discrete exposure of the film, in a different pattern.

Functional Crystalline Chromium Alloy Deposits

The present invention provides a reliably consistent body centered cubic (BCC or bcc) functional crystalline chromium alloy deposit from a trivalent chromium bath, which bath is substantially free of hexavalent chromium, and in which the deposit is TEM crystalline as deposited, without requiring further treatment to crystallize the deposit, and in which the deposit is a functional chromium alloy deposit. In one embodiment, the invention provides a fiber texture nanogranular bcc crystalline functional chromium alloy deposit. In one embodiment, the electrodeposited crystalline functional chromium alloy deposit includes chromium, carbon, nitrogen, oxygen and sulfur, and the deposit is nanogranular as deposited. In some embodiments, the chromium deposit is both TEM crystalline and XRD crystalline, as well as nanogranular, while in other embodiments, the chromium deposit is TEM crystalline and XRD amorphous, as well as nanogranular. Thus, the present invention provides a solution to the long-standing, previously unsolved problem of obtaining a reliably consistent crystalline chromium deposit from an electroplating bath, and from a process, both of which are substantially free of hexavalent chromium.

In any of the embodiments of the present invention, the deposit may include one or any combination of two or more of:

a {111} preferred orientation;

an average crystal grain cross-sectional area of less than about 500 $nm^2$; and a lattice parameter of 2.8895+/−0.0025 A. In one embodiment, the deposit includes a {111} preferred orientation and an average crystal grain cross-sectional area of less than about 500 $nm^2$. In one embodiment, the deposit includes a {111} preferred orientation and a lattice parameter of 2.8895+/−0.0025 A. In one embodiment, the deposit includes an average crystal grain cross-sectional area of less than about 500 $nm^2$ and a lattice parameter of 2.8895+/−0.0025 A. In one embodiment, the deposit includes a {111} preferred orientation, an average crystal grain cross-sectional area of less than about 500 $nm^2$, and a lattice parameter of 2.8895+/−0.0025 A.

In any of the embodiments of the invention described herein, the deposit may include from about 0.05 wt. % to about 20 wt. % sulfur. The deposit may include nitrogen, in an amount from about 0.1 to about 5 wt % nitrogen. The deposit may include carbon, in an amount of carbon less than that amount which renders the chromium deposit amorphous. In one embodiment, the deposit may include from about 0.07 wt. % to about 1.4 wt. % sulfur, from about 0.1 wt. % to about 3 wt. % nitrogen, and from about 0.1 wt. % to about 10 wt. % carbon. The deposit, in one embodiment, further comprises oxygen, from about 0.5 wt. % to about 7 wt. % of the deposit, and in another embodiment further comprises oxygen from about 1 wt. % to about 5 wt. %. The deposit may also contain hydrogen.

To accurately determine sulfur content at low concentrations PIXE is employed. PIXE is an x-ray fluorescence method which can detect elements with atomic numbers greater than lithium but can not accurately quantify elements with low atomic numbers including carbon, nitrogen, and oxygen. Therefore, with PIXE, only chromium and sulfur can be accurately reported in a quantitative manner and the values are for these two elements only (e.g., the relative quantities do not account for other alloying elements). XPS can quantify low z elements except for hydrogen, but it does not have the sensitivity of PIXE, and it samples only a very thin sample volume. Therefore, the alloy content is determined using XPS after sputtering away surface oxides and penetrating into the bulk region of the coating using an argon ion beam. The XPS spectrum is then obtained and, while it does not include the likely presence of hydrogen (H cannot be detected by XPS), the spectrum does effectively determine the relative amounts of carbon, nitrogen, oxygen, and chromium present in the material. From the values obtained by XPS and PIXE, the total content of chromium, carbon, nitrogen, oxygen and sulfur in the alloy can be calculated by those of ordinary skill in the art. In the present disclosure, all sulfur contents reported for the deposits are as determined by PIXE. In the present disclosure, all carbon, nitrogen and oxygen contents reported for the deposits are as determined by XPS. Chromium content reported for the deposits is determined by both methods.

In one embodiment, the crystalline chromium deposit of the present invention is substantially free of macrocracks, using standard test methods. That is, in this embodiment, under standard test methods, substantially no macrocracks are observed when samples of the chromium deposited are examined.

In one embodiment, the crystalline chromium deposit is substantially free of formation of macrocracks after exposure to elevated temperatures for extended periods. In one embodiment, the crystalline chromium deposit does not form macrocracks when heated to a temperature up to about 190° C. for a period of about 1 to about 10 hours. In one embodiment, the crystalline chromium deposit does not change its crystalline structure when heated to a temperature up to about 190° C. In one embodiment, the crystalline chromium deposit does not form macrocracks when heated to a temperature up to about 250° C. for a period of about 1 to about 10 hours. In one embodiment, the crystalline chromium deposit does not change its crystalline structure when heated to a temperature up to about 250° C. In one embodiment, the crystalline chromium deposit does not form macrocracks when heated to a temperature up to about 300° C. for a period of about 1 to about 10 hours. In one embodiment, the crystalline chromium deposit does not change its crystalline structure when heated to a temperature up to about 300° C.

Thus, in one embodiment, the crystalline chromium deposit wherein the deposit remains substantially free of macrocracking when subjected to a temperature of at least 190° C. for at least 3 hours. In another embodiment, the deposit remains substantially free of macrocracking when subjected to a temperature of at least 190° C. for at least 8 hours. In yet another embodiment, the deposit remains substantially free of macrocracking when subjected to a temperature of at least 190° C. for at least 12 hours. In one embodiment, the crystalline chromium deposit wherein the deposit remains substantially free of macrocracking when subjected to a temperature up to 350° C. for at least 3 hours. In another embodiment, the deposit remains substantially free of macrocracking when subjected to a temperature up to 350° C. for at least 8 hours. In yet another embodiment, the deposit remains substantially free of macrocracking when subjected to a temperature up to 350° C. for at least 12 hours.

In one embodiment, the nanogranular functional crystalline chromium alloy deposit in accordance with the present invention has a cubic lattice parameter of 2.8895+/−0.0025 Angstroms (Å). It is noted that the term "lattice parameter" is also sometimes used as "lattice constant". For purposes of the present invention, these terms are considered synonymous. It is noted that for body centered cubic crystalline chromium, there is a single lattice parameter, since the unit cell is cubic. This lattice parameter is more properly referred to as a cubic lattice parameter, since the crystal lattice of the crystalline chromium deposit of the present invention is a body centered cubic crystal, but herein is referred to simply as the "lattice parameter", with the understanding that, for the bcc chromium of the present invention, this refers to the cubic lattice parameter. In one embodiment, the crystalline chromium deposit in accordance with the present invention has a lattice parameter of 2.8895 Å+/−0.0020 Å. In another embodiment, the crystalline chromium deposit in accordance with the present invention has a lattice parameter of 2.8895 Å+/−0.0015 Å. In yet another embodiment, the crystalline chromium deposit in accordance with the present invention has a lattice parameter of 2.8895 Å+/−0.0010 Å. Some specific examples are provided herein of crystalline chromium deposits having lattice parameters within these ranges.

The lattice parameters reported herein for the nanogranular functional crystalline chromium alloy deposit of the present invention are measured for the chromium deposit as deposited but these lattice parameters generally do not substantially change with annealing. The present inventors have measured the lattice parameter on samples of crystalline chromium deposits in accordance with the present invention (1) as deposited, (2) after annealing at 350° C. for one hour and cooling to room temperature, (3) after a second annealing at 450° C. and cooling to room temperature, and (4) after a third annealing at 550° C. and cooling to room temperature. No change in lattice parameter is observed in (1)-(4). The present inventors generally carry out X-ray diffraction ("XRD") experiments in-situ in a furnace built into an XRD apparatus manufactured by Anton Parr. The present inventors generally perform not do the grinding and cleaning process described below. Thus, in one embodiment of the present invention, the lattice parameter of the nanogranular functional crystalline chromium alloy deposit does not vary upon annealing at temperatures up to 550° C. In another embodiment, the lattice parameter of the functional crystalline chromium deposit does not vary upon annealing at temperatures up to 450° C. In another embodiment, the lattice parameter of the functional crystalline chromium deposit does not vary upon annealing at temperatures up to 350° C.

Elemental crystalline chromium has a lattice parameter of 2.8839 Å which has been determined by numerous experts and reported by standards organizations such as the National Institute of Standards and Technology. A typical determination uses electrodeposited chromium from high purity chromic acid salts as reference material (ICD PDF 6-694, from Swanson, et al., Natl. Bur. Stand. (U.S.) Orc. 539, V, 20 (1955)). This material is then crushed, acid washed, annealed in hydrogen and then helium at 1200° C. to allow grain growth and diminish internal stress, carefully cooled at 100° C. per hour to room temperature in helium, then measured.

In all the literature on chromium lattice parameters there is a single reference to lattice parameter exceeding 2.887 Å. This reference is by Sakamoto who reported preparation of chromium electrodeposits on brass substrates from solutions that had different plating temperatures from 30° C. to 75° C. and measured lattice parameters of the as-deposited chromium on brass without consideration for residual stress. Attempts to duplicate Sakamoto's results ignoring residual stress have been fruitless. As discussed in more detail below, when the present inventors measured the lattice parameter as a function of temperature, using two different instruments, the results agreed with each other, and the lattice parameter values ranged from 2.8812 to 2.883 Å, with a mean of 2.8821 Å and a standard deviation of 0.0006 Å, and did not show an increase in lattice parameter as bath temperature was increased. Further discussion of the present inventors' attempts to duplicate the Sakamoto results are provided hereinbelow.

Crystalline chromium electrodeposited from a hexavalent chromium bath has a lattice parameter ranging from about 2.8809 Å to about 2.8858 Å.

Annealed electrodeposited trivalent amorphous-as-deposited chromium has a lattice parameter ranging from about 2.8818 Å to about 2.8852 Å, but also has macrocracks.

Thus, the lattice parameter of the nanogranular functional crystalline chromium alloy deposit in accordance with the present invention is larger than the lattice parameter of other known forms of crystalline chromium. Although not to be bound by theory, it is considered that this difference may be due to the incorporation of the heteroatoms in the alloy, e.g., sulfur, nitrogen, carbon, oxygen and possibly hydrogen, into the crystal lattice of the deposit obtained in accordance with the present invention.

In one embodiment, the nanogranular functional crystalline chromium alloy deposit in accordance with the invention has a {111} preferred orientation. As noted, the deposit may have, e.g., a (222) preferred orientation, which is understood to be within the {111} preferred orientation description and "family".

In one embodiment, the crystalline chromium deposit contains from about 0.05 wt. % to about 20 wt. % sulfur. In another embodiment, the chromium deposit contains from about 0.07 wt. % to about 1.4 wt. % sulfur. In another embodiment, the chromium deposit contains from about 1.5 wt. % to about 10 wt. % sulfur. In another embodiment, the chromium deposit contains from about 1.7 wt. % to about 4 wt. % sulfur. The sulfur is in the deposit present as elemental sulfur and may be a part of crystal lattice, i.e., replacing and thus taking the position of a chromium atom in the crystal lattice or taking a place in the tetrahedral or octahedral hole positions and distorting the lattice. In one embodiment, the source of sulfur may be a divalent sulfur compound. More details on exemplary sulfur sources are provided below.

In one embodiment, the nanogranular functional crystalline chromium alloy deposit contains from about 0.1 to about 5 wt % nitrogen. In another embodiment, the deposit contains from about 0.5 to about 3 wt % nitrogen. In another embodiment the deposit contains about 0.4 weight percent nitrogen.

In one embodiment, the nanogranular functional crystalline chromium alloy deposit contains from about 0.1 to about 5 wt % carbon. In another embodiment, the deposit contains from about 0.5 to about 3 wt % carbon. In another embodiment the deposit contains about 1.4 wt. % carbon. In one embodiment, the crystalline contains an amount of carbon less than that amount which renders the deposit amorphous. That is, above a certain level, e.g., in one embodiment, above about 10 wt. %, the carbon renders the deposit amorphous, and therefore takes it out of the scope of the present invention. Thus, the carbon content should be controlled so that it does not render the deposit amorphous. The carbon may be present in the deposit as elemental carbon or as carbide carbon. If the carbon is present in the deposit as elemental carbon, it may be present either as graphitic or as amorphous carbon.

In one embodiment, the nanogranular functional crystalline chromium alloy deposit contains from about 0.1 to about 5 wt % oxygen. In another embodiment, the deposit contains from about 0.5 to about 3 wt % nitrogen. In another embodiment the deposit contains about 0.4 weight percent nitrogen.

In one embodiment, the TEM crystalline, XRD amorphous nanogranular functional chromium alloy deposit contains from about 0.06 wt. % to about 1.5 wt. % sulfur, and in one embodiment, the TEM crystalline, XRD amorphous deposit contains from about 0.06 wt. % to less than 1 wt. % sulfur (e.g., up to about 0.95 or up to about 0.90 wt. % sulfur). The TEM crystalline, XRD amorphous deposit generally contains from about 0.1 wt. % to about 5 wt. % nitrogen, and from about 0.1 wt. % to about 10 wt. % carbon. In one embodiment, the TEM crystalline, XRD amorphous deposit contains from about 0.05 wt. % to less than 4 wt. % sulfur (e.g., up to about 3.9 wt. % sulfur), from about 0.1 wt. % to about 5 wt. % nitrogen, and from about 0.1 wt. % to about 10 wt. % carbon.

In one embodiment, the XRD crystalline chromium alloy deposit contains from about 4 wt. % to about 20 wt. % sulfur, from about 0.1 wt. % to about 5 wt. % nitrogen, and from about 0.1 wt. % to about 10 wt. % carbon.

In one embodiment, the TEM crystalline, XRD amorphous deposit of the present invention has grain size, as measured by cross-sectional area as described above, orders of magnitude smaller than that observed with deposits from hexavalent chromium, and has grain size substantially smaller than can be obtained with higher sulfur contents. Hexavalent chromium deposits have an average grain size or cross-sectional area in the range from about 200,000 $nm^2$ to about 800,000 $nm^2$, and larger, as determined by the ImageJ software.

In one embodiment, the nanogranular functional crystalline chromium alloy deposit of the present invention, on average, have an average grain size or cross-sectional area in the range from about 100 square nanometers ($nm^2$) to about 5000 $nm^2$, as determined by the ImageJ software. In one embodiment, the nanogranular functional crystalline chromium alloy deposit of the present invention, on average, have an average grain size or cross-sectional area in the range from about 300 square nanometers ($nm^2$) to about 4000 $nm^2$, as determined by the ImageJ software. In one embodiment, the nanogranular functional crystalline chromium alloy deposit of the present invention, on average, have an average grain size or cross-sectional area in the range from about 600 square nanometers ($nm^2$) to about 2500 $nm^2$, as determined by the ImageJ software. It is noted that these are average sizes, and to determine the average, a suitable number of grains should be examined, as readily determined by the person of skill in the art.

In one embodiment, the grains of the nanogranular functional crystalline chromium alloy deposit of the present invention, on average, have a width less than 50 nm and do not have axes elongated more than about five times (5×) the grain size, although many small grains with similar orientation may be stacked above each other. In other embodiments, the grain size is significantly less than 50 nm, as discussed below in more detail. This stacking may be due to the fiber having been disrupted and made discontinuous, like a strand of pearls, rather than continuous as is the case with chromium from hexavalent solution.

In one embodiment, the nanogranular functional crystalline chromium alloy deposit of the present invention includes an average chromium alloy crystal grain width less than 70 nanometers (nm). In another embodiment, the deposit includes an average chromium crystal grain width less than about 50 nm. In another embodiment, the deposit includes an average chromium crystal grain width less than about 30 nm. In one embodiment, the deposit includes an average chromium crystal grain width in the range from about 20 nm to about 70 nm, and in another embodiment, in the range from about 30 to about 60 nm. In one embodiment, the grain width of the deposits of the present invention are less than 20 nm, and in one embodiment, the grain width of the deposit has an average grain width in the range from 5 nm to 20 nm.

Smaller grain size is correlated to increasing hardness of the chromium deposit in accordance with the Hall-Petch effect, down to some minimum grain size in accordance with the reverse Hall-Petch effect. While smaller grain size is known to be related to greater strength, the small grain size attainable with the present invention, in combination with the other features of the present invention, provides a further novel aspect to the present invention.

In one embodiment of the present invention, the nanogranular functional crystalline chromium alloy deposit exhibits a microhardness in the range from about 50 to about 150 Vickers greater than the Vickers hardnesses obtained for hexavalent-derived chromium deposits, and in one embodiment, from about 100 to about 150 Vickers greater than comparable hexavalent-derived deposits (hardness measurements taken with a 25 gram load). Thus, in one embodiment, the functional crystalline chromium deposits in accordance with the present invention exhibit Vickers hardness values, measured under a 25 gram load, in the range from about 950 to about 1100, and in another embodiment from about 1000 to about 1050. Such hardness values are consistent with the small grain size noted above and are greater than the hardness values observed with functional chromium deposits obtained from hexavalent chromium electrodeposition baths.

Processes for Deposition of Functional Crystalline Chromium Alloy from Trivalent Chromium Baths During the process of electrodepositing the nanogranular functional crystalline chromium alloy deposit of the present invention, the electrical current is applied at a current density of at least about 10 amperes per square decimeter ($A/dm^2$). In another embodiment, the current density is in the range from about 10 $A/dm^2$ to about 200 $A/dm^2$, and in another embodiment, the current density is in the range from about 10 $A/dm^2$ to about 100 $A/dm^2$, and in another embodiment, the current density is in the range from about 20 $A/dm^2$ to about 70 $A/dm^2$, and in another embodiment, the current density is in the range from about 30 $A/dm^2$ to about 60 $A/dm^2$, during the electrodeposition of the deposit from the trivalent chromium bath in accordance with the present invention.

During the process of electrodepositing the nanogranular functional crystalline chromium alloy deposit of the present invention, the electrical current may be applied to the bath using any one or any combination of two or more of direct current, pulse waveform or pulse periodic reverse waveform.

In one embodiment, the present invention provides a process for electrodepositing a nanogranular functional crystalline chromium alloy deposit on a substrate, including providing an electrodeposition bath, in which the bath is prepared by combining ingredients comprising trivalent chromium, a source of divalent sulfur, a carboxylic acid, a source of $sp^3$ nitrogen, and in which the bath is substantially free of hexavalent chromium; immersing a substrate in the electroplating bath; and applying an electrical current to electrodeposit a functional crystalline chromium deposit on the substrate, in which the alloy includes chromium, carbon, nitrogen, oxygen and sulfur, and the deposit is crystalline and nanogranular as deposited. In one embodiment, the deposit is both TEM and XRD crystalline. In one embodiment, the deposit is TEM crystalline and is XRD amorphous. In one embodiment, the deposit further includes one or any combination of two or more of (a) a {111} preferred orientation; (b) an average crystal grain cross-sectional area of less than about 500 $nm^2$; and (c) a lattice parameter of 2.8895+/−0.0025 A.

The contents of the components of the chromium alloy deposit, and the various physical features and properties of the deposit obtained by the process are described above, with respect to the deposit, and are not repeated here for brevity.

In one embodiment, the source of $sp^3$ nitrogen includes ammonium hydroxide or a salt thereof, a primary, secondary or tertiary alkyl amine, in which the alkyl group is a $C_1$-$C_6$ alkyl, an amino acid, a hydroxy amine, or a polyhydric alkanolamines, wherein alkyl groups in the source of nitrogen comprise $C_1$-$C_6$ alkyl groups. In one embodiment, the source of $sp^3$ nitrogen may be ammonium chloride and in another embodiment, ammonium bromide, and in another embodiment, a combination of both ammonium chloride and ammonium bromide.

In one embodiment, the carboxylic acid includes one or more of formic acid, oxalic acid, glycine, acetic acid, and malonic acid or a salt of any thereof. The carboxylic acid provides both carbon and oxygen, which may be incorporated into the chromium alloy deposit of the present invention. Other carboxylic acids may be used, as will be recognized.

In one embodiment, the source of divalent sulfur comprises one or a mixture of two or more of:

thiomorpholine,
thiodiethanol,
L-cysteine,
L-cystine,
allyl sulfide,
thiosalicylic acid,
thiodipropanoic acid,
3,3'-dithiodipropanoic acid,
3-(3-aminopropyl disulfanyl) propylamine hydrochloride,
[1,3]thiazin-3-ium chloride,
thiazolidin-3-ium dichloride, a compound referred to as a 3-(3-aminoalkyl disulfenyl) alkylamine having the formula:

$$R_3N^{\oplus}—(CH_2)_n—S—S—(CH_2)_m—NR^1{}_3 2X^{\ominus}$$

wherein R and $R^1$ are independently H, methyl or ethyl and n and m are independently 1-4; or a compound referred to as a [1,3]thiazin-3-ium having the formula:

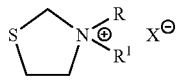

in which R and R are independently H, methyl or ethyl; or a compound referred to as a thiazolidin-3-ium having the formula:

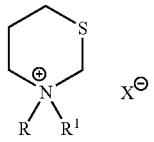

in which R and $R^1$ are independently H, methyl or ethyl; and in which in each of the foregoing sources of divalent sulfur, X may be any halide or an anion other than nitrate ($—NO_3^-$), comprising one or more of cyano, formate, citrate, oxalate, acetate, malonate, $SO_4^{-2}$, $PO_4^{-3}$, $H_2PO_3^{-1}$, $H_2PO_2^{-1}$, pyrophosphate ($P_2O_7^{-4}$), polyphosphate ($P_3O_{10}^{-5}$), partial anions of the foregoing multivalent anions, e.g., $HSO_4^{-1}$, $HPO_4^{-2}$, $H_2P_4^{-1}$, $C_1$-$C_{18}$ alkyl sulfonic acids, $C_1$-$C_{18}$ benzene sulfonic acids, and sulfamate.

In one embodiment, the source of divalent sulfur is not saccharine.

In one embodiment, the source of divalent sulfur is not thiourea.

In one embodiment, the source of divalent sulfur is present in the electrodeposition bath at a concentration from about 0.0001 M to about 0.05 M. In one embodiment, the source of divalent sulfur is present in the bath at a concentration sufficient to obtain a deposit that is both XRD and TEM crystalline. In one embodiment, the concentration of divalent sulfur in the bath that is sufficient to obtain such a deposit that is both XRD and TEM crystalline is in the range from about 0.01 M to about 0.10 M.

In another embodiment, the source of divalent sulfur is present in the bath at a concentration sufficient to obtain a deposit that is XRD amorphous and TEM crystalline. In one embodiment, the concentration of divalent sulfur in the bath that is sufficient to obtain such a deposit that is XRD amorphous and TEM crystalline is in the range from about 0.0001 M to less than about 0.01 M.

In one embodiment, the electrodeposition bath has a pH in the range from 5 to about 6.5. In one embodiment, the electrodeposition bath has a pH in the range from 5 to about 6. In one embodiment, the electrodeposition bath has a pH of about 5.5. At a pH outside the disclosed range, e.g., at about pH 4 and less, and at about pH 7 or greater, components of the bath begin to precipitate or the bath does not function as desired.

In one embodiment, the step of applying an electrical current is carried out for a time sufficient to form the deposit to a thickness of at least 3 microns. In one embodiment, the step of applying an electrical current is carried out for a time sufficient to form the deposit to a thickness of at least 10 microns. In one embodiment, the step of applying an electrical current is carried out for a time sufficient to form the deposit to a thickness of at least 15 microns.

In one embodiment, the cathodic efficiency ranges from about 5% to about 80%, and in one embodiment, the cathodic efficiency ranges from about 10% to about 40%, and in another embodiment, the cathodic efficiency ranges from about 20% to about 30%.

These processes in accordance with the invention may be carried out under the conditions described herein, and in accordance with standard practices for electrodeposition of chromium. Thus, any conditions not specifically stated herein may be set as for any conventional chromium electroplating process, as long as it does not depart from the scope of the present disclosure.

Trivalent Chromium Electrodeposition Baths

In one embodiment, the present invention relates to an electrodeposition bath for electrodepositing the above-described nanogranular crystalline functional chromium alloy deposit, in which the alloy comprises chromium, carbon, nitrogen, oxygen and sulfur, and the bath includes an aqueous solution obtained by combining ingredients including a source of trivalent chromium having a concentration of least 0.1 molar and being substantially free of added hexavalent chromium; a carboxylic acid; a source of $sp^3$ nitrogen; a source of divalent sulfur, at a concentration in the range from about 0.0001 M to about 0.05 M; and in which the bath further includes a pH in the range from 5 to about 6.5; an operating temperature in the range from about 35° C. to about 95° C.; and a source of electrical energy to be applied between an anode and a cathode immersed in the electrodeposition bath.

This bath is generally a trivalent chromium electroplating bath, and in accordance with the present invention is substantially free of hexavalent chromium. In one embodiment, the bath is free of detectable amounts of hexavalent chromium. In the baths of the present invention, hexavalent chromium is not intentionally or purposefully added. It is possible that some hexavalent chromium will be formed as a by-product, or that there may be some small quantity of hexavalent chromium impurity present, but this is neither sought nor desired. Suitable measures may be taken to avoid such formation of hexavalent chromium, as known in the art.

The trivalent chromium may be supplied as chromic chloride, $CrCl_3$, chromic fluoride, $CrF_3$, chromic oxide, $Cr_2O_3$, chromic phosphate, $CrPO_4$, or in a commercially available solution such as chromium hydroxy dichloride solution, chromic chloride solution, or chromium sulfate solution, e.g., from McGean Chemical Company or Sentury Reagents. Trivalent chromium is also available as chromium sulfate/sodium or potassium sulfate salts, e.g., $Cr(OH)SO_4.Na_2SO_4$, often referred to as chrometans or kromtans, chemicals useful for tanning of leather, and available from companies such as Elementis, Lancashire Chemical, and Soda Sanayii. As noted below, the trivalent chromium may also be provided as chromic formate, $Cr(HCOO)_3$ from Sentury Reagents. If provided as chromic formate, this would provide both the trivalent chromium and the carboxylic acid.

The concentration of the $Cr^{+3}$ ions may be in the range from about 0.1 molar (M) to about 5 M. In one embodiment, the electrodeposition bath contains $Cr^{+3}$ ions at a concentration in the range from about 0.1 M to about 2 M. The higher the concentration of trivalent chromium, the higher the current density that can be applied without resulting in a dendritic deposit, and consequently the faster the rate of crystalline chromium deposition that can be achieved.

In one embodiment, the electrodeposition bath contains a quantity of the divalent sulfur compound sufficient that the chromium deposit comprises from about 0.05 wt. % to about 20 wt. % sulfur. In one embodiment, the concentration of the divalent sulfur compound in the bath may range from about 0.1 g/l to about 25 g/l, and in one embodiment, the divalent sulfur compound in the bath may range from about 1 g/l to about 5 g/l.

The trivalent chromium bath may further include a carboxylic acid such as formic acid or a salt thereof, such as one or more of sodium formate, potassium formate, ammonium formate, calcium formate, magnesium formate, etc. Other organic additives, including amino acids, such as glycine, and thiocyanate may also be used to produce crystalline chromium deposits from trivalent chromium and their use is within the scope of one embodiment of this invention. As noted above, chromium (III) formate, $Cr(HCOO)_3$, may be used as a source of both trivalent chromium and formate. At the pH of the bath, the formate will be present in a form to provide formic acid.

In one embodiment, the electrodeposition bath contains a quantity of the carboxylic acid sufficient that the chromium deposit comprises an amount of carbon less than that amount which renders the chromium deposit amorphous. In one embodiment, the concentration of the carboxylic acid in the bath may range from about 0.1 M to about 4 M.

The trivalent chromium bath may further include a source of nitrogen, which may be in the form of ammonium hydroxide or a salt thereof, or may be a primary, secondary or tertiary alkyl amine, in which the alkyl group is a $C_1$-$C_6$ alkyl. In one embodiment, the source of nitrogen is other than a quaternary ammonium compound. In addition, amino acids, hydroxy amines such as quadrol and polyhydric alkanolamines, can be used as the source of nitrogen. In one embodiment of such nitrogen sources, the additives include $C_1$-$C_6$ alkanol groups. In one embodiment, the source of nitrogen may be added as a salt, e.g., an amine salt such as a hydrohalide salt.

In one embodiment, the electrodeposition bath contains a quantity of the source of nitrogen sufficient that the chromium deposit comprises from about 0.1 to about 5 wt % nitrogen. In one embodiment, the concentration of the source of nitrogen in the bath may range from about 0.1 M to about 6 M.

As noted above, the crystalline chromium deposit may include carbon. The carbon source may be, for example, the organic compound such as formic acid or formic acid salt included in the bath. Similarly, the crystalline chromium may include oxygen and hydrogen, which may be obtained from other components of the bath including electrolysis of water, or may also be derived from the formic acid or salt thereof, or from other bath components.

In addition to the chromium atoms in the crystalline chromium deposit, other metals may be co-deposited. As will be understood by those of skill in the art, such metals may be suitably added to the trivalent chromium electroplating bath as desired to obtain various crystalline alloys of chromium in the deposit. Such metals include, but are not necessarily limited to, Re, Cu, Fe, W, Ni, Mn, and may also include, for example, P (phosphorus). In fact, all elements electrodepositable from aqueous solution, directly or by induction, as described by Pourbaix (Pourbaix, M., "Atlas of Electrochemical Equilibria", 1974, NACE (National Association of Corrosion Engineers)) or by Brenner (Brenner, A., "Electrodeposition of Alloys, Vol. I and Vol. II", 1963, Academic Press, NY) may be alloyed in this process. In one embodiment, the alloyed metal is other than aluminum. As is known in the art, metals electrodepositable from aqueous solution include: Ag, As, Au, Bi, Cd, Co, Cr, Cu, Ga, Ge, Fe, In, Mn, Mo, Ni, P, Pb, Pd, Pt, Rh, Re, Ru, S, Sb, Se, Sn, Te, Tl, W and Zn, and inducible elements include B, C and N. As will be understood by those of skill in the art, the co-deposited metal or atom is present in an amount less than the amount of chromium in the deposit, and the deposit obtained thereby often should be body-centered cubic crystalline, as is the crystalline chromium deposit of the present invention obtained in the absence of such co-deposited metal or atom.

The trivalent chromium bath further comprises a pH of at least 5, and the pH can range up to at least about 6.5. In one embodiment, the pH of the trivalent chromium bath is in the range from about 5 to about 6.5, and in another embodiment the pH of the trivalent chromium bath is in the range from about 5 to about 6, and in another embodiment, the pH of the trivalent chromium bath is about 5.5, and in another embodiment, the pH of the trivalent chromium bath is in the range from about 5.25 to about 5.75.

In one embodiment, the trivalent chromium bath is maintained at a temperature in the range from about 35° C. to about 115° C. or the boiling point of the solution, whichever is less, during the process of electrodepositing the crystalline chromium deposit of the present invention. In one embodiment, the bath temperature is in the range from about 45° C. to about 75° C., and in another embodiment, the bath temperature is in the range from about 50° C. to about 65° C., and in one embodiment, the bath temperature is maintained at about 55° C., during the process of electrodepositing the crystalline chromium deposit.

As noted above, a source of divalent sulfur is preferably provided in the trivalent chromium electroplating bath. A wide variety of divalent sulfur-containing compounds can be used in accordance with the present invention.

In one embodiment, the source of divalent sulfur may be any one of those described above with respect to the bath disclosed in the process embodiment.

In another embodiment, the source of divalent sulfur may include one or a mixture of two or more of a compound having the general formula (I):

$$X^1—R^1—(S)_n—R^2—X^2 \quad (I)$$

wherein in (I), $X^1$ and $X^2$ may be the same or different and each of $X^1$ and $X^2$ independently comprise hydrogen, halogen, amino, cyano, nitro, nitroso, azo, alkylcarbonyl, formyl, alkoxycarbonyl, aminocarbonyl, alkylamino, dialkylamino, alkylaminocarbonyl, dialkylaminocarbonyl, carboxyl (as used herein, "carboxyl" includes all forms of carboxyl groups, e.g., carboxylic acids, carboxylic alkyl esters and carboxylic salts), sulfonate, sulfinate, phosphonate, phosphinate, sulfoxide, carbamate, polyethoxylated alkyl, polypropoxylated alkyl, hydroxyl, halogen-substituted alkyl, alkoxy, alkyl sulfate ester, alkylthio, alkylsulfinyl, alkylsulfonyl, alkylphosphonate or alkylphosphinate, wherein the alkyl and alkoxy groups are $C_1$-$C_6$, or $X^1$ and $X^2$ taken together may form a bond from $R^1$ to $R^2$, thus forming a ring containing the $R^1$ and $R^2$ groups, wherein $R^1$ and $R^2$ may be the same or different and each of $R^1$ and $R^2$ independently comprise a single bond, alkyl, allyl, alkenyl, alkynyl, cyclohexyl, aromatic and heteroaromatic rings, alkoxycarbonyl, aminocarbonyl, alkylaminocarbonyl, dialkylaminocarbonyl, polyethoxylated and polypropoxylated alkyl, wherein the alkyl groups are $C_1$-$C_6$, and wherein n has an average value ranging from 1 to about 5.

In one embodiment, the source of divalent sulfur may include one or a mixture of two or more of a compound having the general formula (IIa) and/or (IIb):

(IIa)

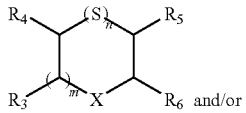

and/or (IIb)

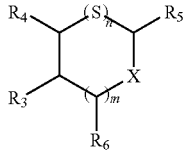

wherein in (IIa) and (IIb), $R_3$, $R_4$, $R_5$ and $R_6$ may be the same or different and independently comprise hydrogen, halogen, amino, cyano, nitro, nitroso, azo, alkylcarbonyl, formyl, alkoxycarbonyl, aminocarbonyl, alkylamino, dialkylamino, alkylaminocarbonyl, dialkylaminocarbonyl, carboxyl, sulfonate, sulfinate, phosphonate, phosphinate, sulfoxide, carbamate, polyethoxylated alkyl, polypropoxylated alkyl, hydroxyl, halogen-substituted alkyl, alkoxy, alkyl sulfate ester, alkylthio, alkylsulfinyl, alkylsulfonyl, alkylphosphonate or alkylphosphinate, wherein the alkyl and alkoxy groups are $C_1$-$C_6$, wherein X represents carbon, nitrogen, oxygen, sulfur, selenium or tellurium and in which m ranges from 0 to about 3, wherein n has an average value ranging from 1 to about 5, and wherein each of (IIa) or (IIb) includes at least one divalent sulfur atom.

In one embodiment, the source of divalent sulfur may include one or a mixture of two or more of a compound having the general formula (IIIa) and/or (IIIb):

(IIIa)

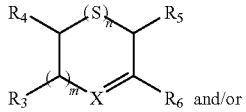

and/or (IIIb)

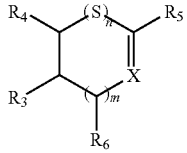

wherein, in (IIIa) and (IIIb), $R_3$, $R_4$, $R_5$ and $R_6$ may be the same or different and independently comprise hydrogen, halogen, amino, cyano, nitro, nitroso, azo, alkylcarbonyl, alkylamino, dialkylamino, formyl, alkoxycarbonyl, aminocarbonyl, alkylaminocarbonyl, dialkylaminocarbonyl, carboxyl, sulfonate, sulfinate, phosphonate, phosphinate, sulfoxide, carbamate, polyethoxylated alkyl, polypropoxylated alkyl, hydroxyl, halogen-substituted alkyl, alkoxy, alkyl sulfate ester, alkylthio, alkylsulfinyl, alkylsulfonyl, alkylphosphonate or alkylphosphinate, wherein the alkyl and alkoxy groups are $C_1$-$C_6$, wherein X represents carbon, nitrogen, sulfur, selenium or tellurium and in which m ranges from 0 to about 3, wherein n has an average value ranging from 1 to about 5, and wherein each of (IIIa) or (IIIb) includes at least one divalent sulfur atom.

In one embodiment, in any of the foregoing sulfur containing compounds, the sulfur may be replaced by selenium or tellurium. Exemplary selenium compounds include seleno-DL-methionine, seleno-DL-cystine, other selenides, R—Se—R', diselenides, R—Se—Se—R' and selenols, R—Se—H, where R and R' independently may be an alkyl or aryl group having from 1 to about 20 carbon atoms, which may include other heteroatoms, such as oxygen or nitrogen, similar to those disclosed above for sulfur. Exemplary tellurium compounds include ethoxy and methoxy telluride, $Te(OC_2H_5)_4$ and $Te(OCH_3)_4$.

In one embodiment, the electrodeposition bath contains a quantity of the divalent sulfur compound, the source of nitrogen and the carboxylic acid sufficient that the deposit comprises from about 1.7 wt. % to about 4 wt. % sulfur, from about 0.1 wt. % to about 3 wt. % nitrogen, and from about 0.1 wt. % to about 10 wt. % carbon.

In one embodiment, the bath further includes a brightener. Suitable brighteners known in the art may be used. In one embodiment, the brightener comprises a polymer soluble in the bath and having the general formula:

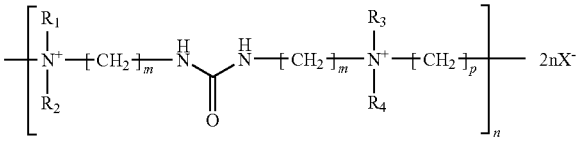

wherein m has the value 2 or 3, n has a value of at least 2, $R_1$, $R_2$, $R_3$ and $R_4$, which may be the same or different, each independently denote methyl, ethyl or hydroxyethyl, p has a value in the range from 3 to 12, and $X^-$ denotes $Cl^-$, $Br^-$ and/or $I^-$. The polymer may be included in the bath at a concentration in the range from about 0.1 g/L to about 50 g/L, and in one embodiment, from about 1 g/L to about 10 g/L. These compounds are disclosed in U.S. Pat. No. 6,652,728, the disclosure of which relating to these compounds and methods for preparation thereof is incorporated herein by reference.

In one embodiment, the brightener comprises a ureylene quaternary ammonium polymer, an iminoureylene quaternary ammonium polymer, or a thioureylene quaternary ammonium polymer. In on embodiment, the quaternary ammonium polymer has repeating groups of the formula

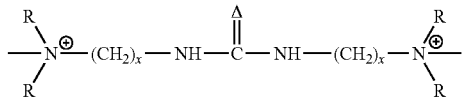

(1)

or the formula

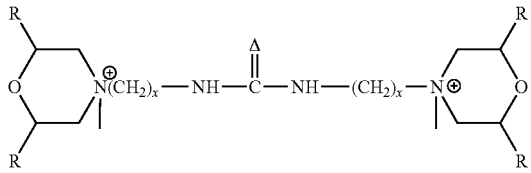

(2)

wherein Δ is O, S, N, x is 2 or 3, and R is methyl, ethyl, isopropyl, 2-hydroxyethyl, or $—CH_2CH(OCH_2CH_2)_yOH$, wherein y=0-6, in alternating sequence with ethoxyethane or methoxyethane groups, and wherein R can be H in formula (2). The polymer may have a molecular weight in the range of 350 to 100,000, and in one embodiment, the molecular weight of the polymer is in the range 350 to 2,000. These compounds are disclosed in U.S. Pat. No. 5,405,523, the disclosure of which relating to these compounds and methods for preparation thereof is incorporated herein by reference.

In one embodiment, the ureylene quaternary ammonium polymer has the formula:

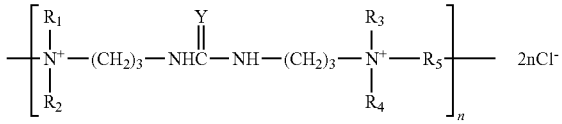

wherein Y is selected from the group consisting of S and O; n is at least 1; $R_1$, $R_2$, $R_3$ and $R_4$ may be the same or different and are selected from the group consisting of methyl, ethyl, isopropyl, 2-hydroxyethyl and $—CH_2CH_2(OCH_2CH_2)_xOH$ wherein X may be 0 to 6; and $R_5$ is selected from the group consisting of $(CH_2)_2$—O—$(CH_2)_2$; $(CH_2)_2$—O—$(CH_2)_2$—O—$(CH_2)_2$ and $CH_2$—CHOH—$CH_2$—O—$CH_2$—CHOH—$CH_2$. In one embodiment, the polymer is MIRAPOL® WT, CAS No. 68555-36-2, which is sold by Rhone-Poulenc. The polymer in MIRAPOL® WT has an average molecular weight of 2200, n=6 (average), Y=O, $R_1$-$R_4$ are all methyl and $R_5$ is $(CH_2)_2$—O—$(CH_2)_2$. The formula for the polymer in MIRAPOL® WT may be represented as follows:

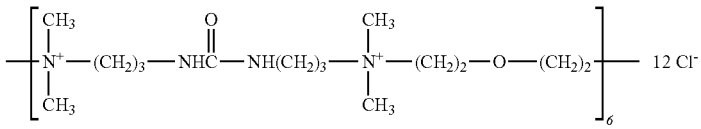

As will be understood, the substituents used should be selected so that the resulting compounds are soluble in the baths of the present invention.

As noted above, in one embodiment, the source of divalent sulfur is other than saccharine, and no saccharine is added to the bath. As noted above, in one embodiment, the source of divalent sulfur is other than thiourea, and no thiourea is added to the bath.

In one embodiment, the anodes may be isolated from the bath. In one embodiment, the anodes may be isolated by use of a fabric, which may be either tightly knit or loosely woven. Suitable fabrics include those known in the art for such use, including, e.g., cotton and polypropylene, the latter available from Chautauqua Metal Finishing Supply, Ashville, N.Y. In another embodiment, the anode may be isolated by use of anionic or cationic membranes, for example, such as perfluorosulfonic acid membranes sold under the tradenames NAFION® (DuPont), ACIPLEX® (Asahi Kasei), FLEMION® (Asahi Glass) or others supplied by Dow or by Membranes International Glen Rock, N.J. In one embodiment, the anode may be placed in a compartment, in which the compartment is filled with an acidic, neutral, or alkaline electrolyte that differs from the bulk electrolyte, by an ion exchange means such as a cationic or anionic membrane or a salt bridge.

COMPARATIVE EXAMPLES

Hexavalent Chromium

In Table 1 comparative examples of various aqueous hexavalent chromic acid containing electrolytes that produce functional chromium deposits are listed, the crystallographic properties of the deposit tabulated, and reported elemental composition based upon C, O, H, N and S analysis.

TABLE 1

Hexavalent chromium based electrolytes for functional chromium

| | H1 | H2 | H3 | H4 | H5 | H6 |
|---|---|---|---|---|---|---|
| $CrO_3$ (M) | 2.50 | 2.50 | 2.50 | 2.50 | 2.50 | 8.00 |
| $H_2SO_4$ (M) | | 0.026 | 0.015 | 0.029 | | |
| $MgSiF_6$ (M) | | | 0.02 | | | |
| $CH_2(SO_3Na)_2$ (M) | | | | 0.015 | | |
| $KIO_3$ (M) | | | | | 0.016 | 0.009 |
| $HO_3SCH_2CO_2H$ (M) | | | | | 0.18 | |
| HCl (M) | | | | | | 0.070 |
| $H_2O$ | to 1 L | to 1 L | to 1 L | to 1 L | to 1 L | to 1 L |
| Current Density (A/dm$^2$) | 30 | 20 | 45 | 50 | 50 | 62 |
| Temperature, ° C. | 55 | 55 | 50 | 60 | 55 | 50 |
| Cathodic efficiency, % | 2-7 | 10-15 | 15-25 | 20-30 | 35-40 | 55-60 |
| Lattice(s) | BCC | BCC | BCC | BCC | BCC/SC | BCC |
| Grain Preferred orientation | Random | (222) PO | (222) (211) PO | (222) PO | (110) PO | Random |
| Lattice parameter as deposited | 2.883 | 2.882 | 2.883 | 2.881 | 2.882 | 2.886 |
| Bulk [C] at % | | — | — | 0.04 | 0.06 | |
| Bulk [H] at % | | 0.055 | 0.078 | 0.076 | 0.068 | |
| Bulk [$O_2$] at % | | 0.36 | 0.62 | 0.84 | 0.98 | |
| Bulk [S] at % | | — | — | 0.04 | 0.12 | |

The only reference of which the present inventors are aware that purports to disclose a crystalline chromium deposit having a lattice parameter as high as 2.8880 Å, obtained from a hexavalent chromium electrodeposition bath, is Sakamoto, Y., "On the crystal structures and electrolytic conditions of chromium electrodeposits", NIPPON KINZOKU GAKKAISHI—JOURNAL OF THE JAPAN INSTITUTE OF METALS, Vol. 36, No. 5, May 1972, pp. 450-457 (XP009088028) ("Sakamoto"). Sakamoto purports to obtain a bcc crystalline chromium having a lattice parameter of 2.8880 Å. This lattice parameter is purportedly obtained by measuring the diffracted ray peak position of the {211} plane of bcc-type chromium as deposited at 75° C. by using a weighted average wavelength CrKα=2.29092 Å. Sakamoto reported finding that the lattice parameter (referred to by Sakamoto as the lattice constant) was dependent on the electrolysis temperature, in which the lattice parameter was reported to increase from α=2.8809 Å to 2.8880 Å as the electrolysis temperature increased from 40° C. to 75° C.

Despite repeated and earnest efforts, the present inventors have been unable to duplicate the results reported by Sakamoto. Therefore, the disclosure of Sakamoto, with respect to the lattice parameter of a bcc crystalline chromium being 2.8880 Å, is in error and so must be considered non-enabling. The present inventors consider that possibly the error or discrepancy arose due to stress in the deposits, resulting, for example, from handling, bending, cutting or other effects subsequent to the electrodeposition. It is well known that lattice parameter will vary with the temperature of the material. The density varies; therefore, the lattice parameter also varies. However, there is no evidence of which the present inventors are aware that the lattice parameter for an element will vary isothermally unless other elements are present either within the lattice or interstitially. There is a considerable amount of data showing that observed X-ray diffraction peak locations vary based upon stress and it is considered quite possible that such stress was not accounted for in the Sakamoto experiments.

The present inventors report the following repeated and earnest, but ultimately unsuccessful, attempts to duplicate the results reported by Sakamoto.

A solution of chromic acid was prepared using 250 g/l of $CrO_3$ and 2.5 g/L of concentrated sulfuric acid. A lead anode was employed. Brass (60:40) coupons were used as substrates. A CPVC jig which effectively masked the edges of the brass coupons and exposed approximately 7×2 cm of brass was employed to hold the brass coupons as the cathode. The coupons were connected to a ripple free HP rectifier, capable of constant current operation up to 30 amps not exceeding 25V DC. Direct current was applied, in all cases, with a current density of 0.6 Amp/cm$^2$ (60 A/dm$^2$). Plating was carried out at solution temperatures of 50° C., 60° C., 70° C., and 75° C. Two coupons were plated at each solution temperature. The thickness of the first coupon was measured and the plating time for the second coupon was adjusted to provide a coating of 22-28 microns in thickness.

Figure 6:
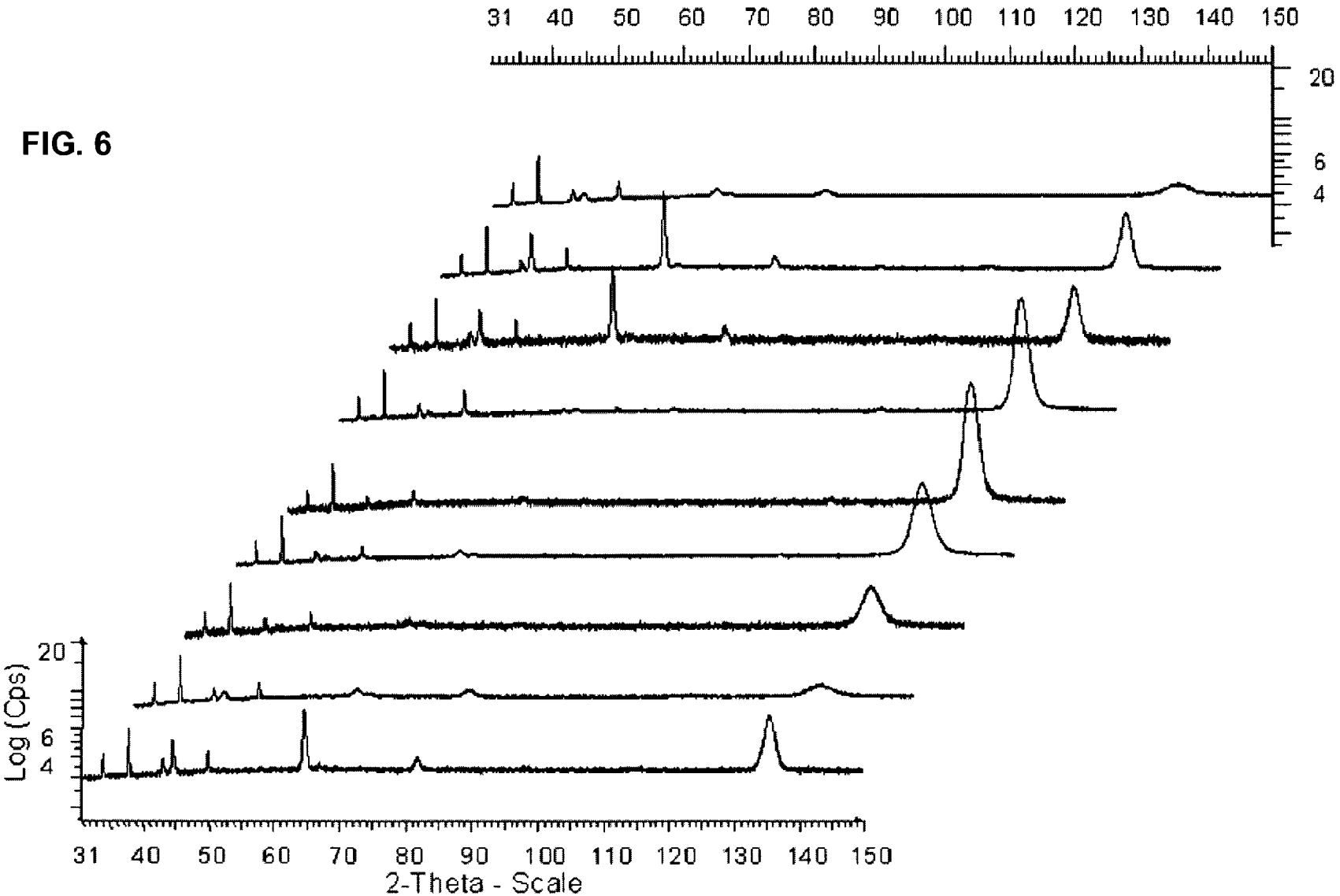
FIG. 6 is a series of nine X-ray diffraction scans of electrodeposited chromium obtained by the methods disclosed by Sakamoto.

After plating, the coupons were examined by x-ray diffraction using a Bruker D-8 Bragg Brentano powder diffractometer equipped with Cu k alpha x-ray source, a Goebel mirror, and Soller slits. Detector configuration was varied and two detectors used: a multiwire 2 dimensional Vantek® detector and a NaI scintillation detector equipped with Soller slits. Representative data is presented in FIG. 6. As shown by the data in FIG. 6, the number, location, and intensity of observed reflections varies depending upon the deposition temperature. All the deposits shown in FIG. 6 have a strong (222) reflection near 133 degrees two theta but most of the deposits have very weak or negligible peak intensities for the (211) reflection near 83 degrees two theta. Despite this, Sakamoto chose to use the (211) reflection to derive the reported lattice parameters. Although not certain, this choice may underlie the apparent error in the lattice parameters reported by Sakamoto.

The plated coupons were also measured with a Scintag X1 powder diffractometer equipped with a position sensitive solid state Peltier cooled detector. With the latter instrument the lattice parameter for NIST reference material silicon was measured as 5.431 A which compares favorably to the NIST value of 5.43102 Å+/−0.00104 Å, which NIST value can be confirmed at the NIST Internet site: physics (dot) nist (dot) gov/cgi-bin/cuu/Value?asil.

Figure 8:
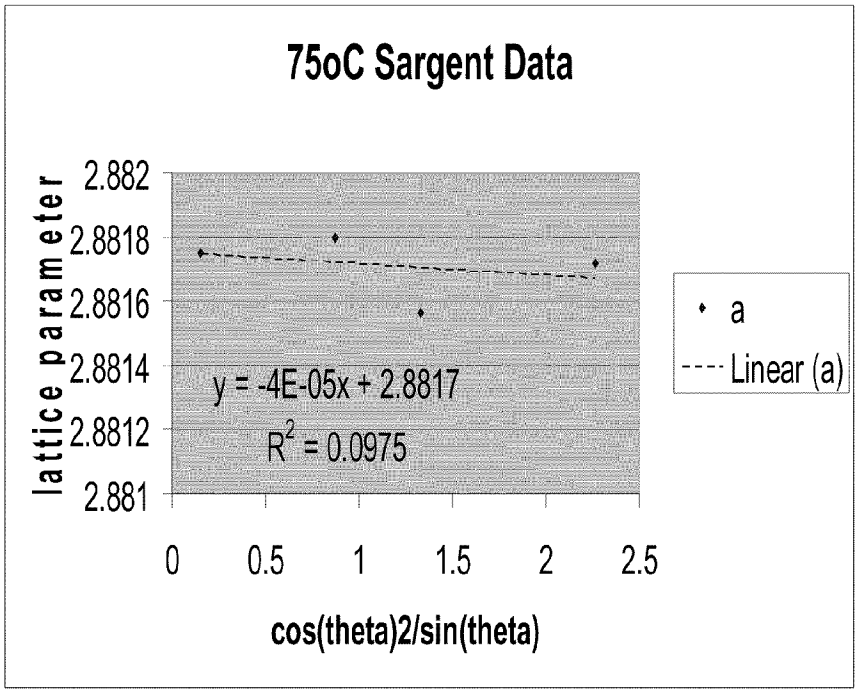
FIG. 8 is a graph illustrating the 75° C. Sargent $Cr^{+6}$ data lattice parameter values obtained by the present inventors applying the deposition methods disclosed by Sakamoto and evaluated using the subsequently described $\cos^2/\sin$ method.
Figure 7:
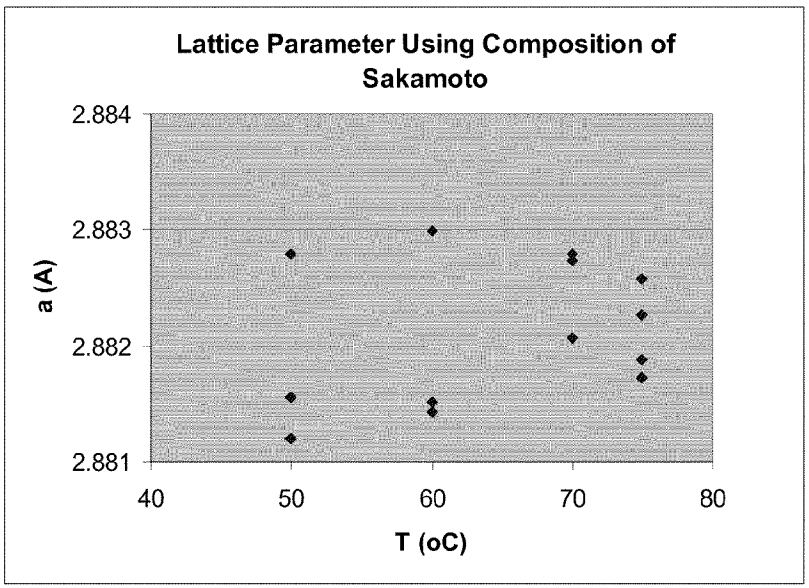
FIG. 7 is a graph illustrating the lattice parameter values obtained by the present inventors applying the deposition methods disclosed by Sakamoto and the subsequently described lattice parameter determination method based upon the modified Bragg equation.

The diffraction peaks that were observed varied with samples obtained from solutions of different temperatures although in all instances a relatively strong (222) reflection near 133° two theta was observed. Using the modified Bragg equation:

$$\text{lattice constant}=a=\lambda/[(2\sin(\theta))*(h^2+k^2+l^2)^{0.5}]$$

for different observed hkl, where $\lambda(Cu_{k\alpha 1})=1.54056$, a is the lattice constant, and h, k and l are Miller indices, applied to peaks that were clearly present, the data shown in FIG. 7 was obtained. As shown in FIG. 7, the present inventors measured lattice parameters that varied little, ranging from 2.8812 to 2.883 Å, with a mean of 2.8821 Å and a standard deviation of 0.0006 Å, regardless of deposition temperature, instrument configuration, or instrument. From the XRD scan data it is evident that at all temperatures there is a strong (222) reflection and at 75° C. there is a tendency towards random orientation with the (110), (200), and (211) reflections becoming stronger. Consequently, the 75° C. data is suitable for analysis using the analytical extrapolation parameter method of Cohen (M. U. Cohen, Rev. Sci. Instrum. 6 (1935), 68; M. U. Cohen, Rev. Sci. Instrum. 7 (1936), 155) for cubic and non cubic systems $\cos^2(\theta)/\sin(\theta)$. FIG. 8 is a graph illustrating the 75° C. Sargent data lattice parameter values obtained by the present inventors applying the methods disclosed by Sakamoto. The 75° C. data provides an extrapolated lattice constant of 2.8817 Å, within the range of 2.8816 to 2.88185 Å, as shown in FIG. 8.

Figure 9:
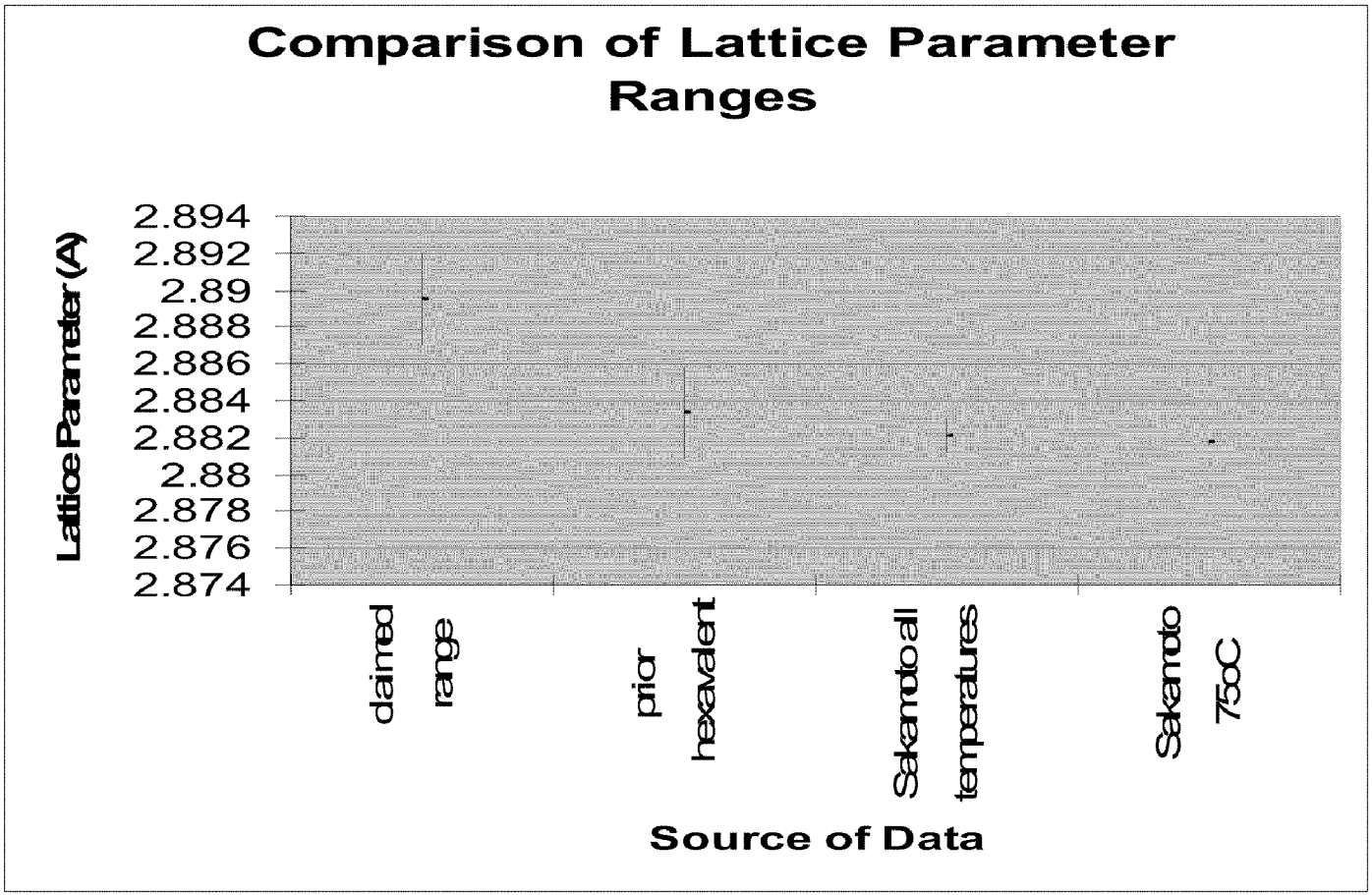
FIG. 9 is a graphical presentation of various lattice parameters for chromium obtained both from the literature and by carrying out the method of Sakamoto, illustrating the consistency of the Sakamoto method lattice parameter data obtained by the present inventors with the known lattice parameters.

Thus, using two different instruments, three different instrument configurations, and two analytical methods for determining lattice constant, there is no evidence for lattice parameters greater than about 2.8830 A, and no evidence or suggestion whatsoever for larger lattice parameters, such as within the range of 2.8895 Å+/−0.0025 Å, having been produced from a bath with the composition described by Sakamoto. Furthermore, the data obtained by the present inventors and reported herein is consistent with the lattice parameter accepted by standards organizations such as the NIST (USA) of 2.8839 Å and the present inventors' measured lattice parameters for hexavalent chromium, as disclosed previously, of 2.8809 Å to 2.8858 Å. These data and those obtained by the present inventors applying the process disclosed by Sakamoto are graphically contrasted, in FIG. 9. FIG. 9 is a graphical presentation of various lattice parameters for chromium obtained both from the literature and by carrying out the method of Sakamoto, illustrating the consistency of the Sakamoto method lattice parameter data obtained by the present inventors with the known lattice parameters.

COMPARATIVE EXAMPLES

Trivalent Chromium

In Table 2 comparative examples of trivalent chromium process solutions deemed by the Ecochrome project to be the best available technology are tabulated. The Ecochrome project was a multiyear European Union-sponsored program (G1RD CT-2002-00718) to find an efficient and high performance hard chromium alternative based upon trivalent chromium (see, Hard Chromium Alternatives Team (HCAT) Meeting, San Diego, Calif., Jan. 24-26, 2006). The three processes reviewed herein are from Cidetec, a consortium based in Spain; ENSME, a consortium based in France; and, Musashi, a consortium based in Japan. In this table, where no chemical formula is specifically listed, the material is believed to be proprietary in the presentations from which these data were obtained, and is not available.

TABLE 2

Best available known technology for functional trivalent chromium processes from the Ecochrome project.

| | EC1 (Cidetec) | EC2 (ENSME) | EC3 (Musashi) |
|---|---|---|---|
| Cr(III) (M) | 0.40 | 1.19 | |
| $CrCl_3 \cdot 6H_2O$ (M) from $Cr(OH)_3$ + 3HCl | | | 1.13 |
| $H_2NCH_2CO_2H$ (M) | | | 0.67 |
| Ligand 1 (M) | 0.60 | | |
| Ligand 2 (M) | 0.30 | | |
| Ligand 3 (M) | 0.75 | | |
| $H_3BO_3$ (M) | 0.75 | | |
| Conductivity salts (M) | 2.25 | | |
| $HCO_2H$ (M) | | 0.19 | |
| $NH_4Cl$ (M) | | 0.19 | 2.43 |
| $H_3BO_3$ (M) | | 0.08 | 0.42 |
| $AlCl_3 \cdot 6H_20$ (M) | | | 0.27 |
| Surfactant ml/L | 0.225 | 0.2 | |
| pH | 2-2.3 | ~0.1 | ~0.3 |
| Temp (° C.) | 45-50 | 50 | 50 |
| Current density A/dm$^2$ | 20.00 | 70.00 | 40.00 |
| Cathodic efficiency | 10% | ~27% | 13% |
| Structure as plated | amorphous | amorphous | amorphous |
| Pref. Orientation | NA | NA | NA |

In the Table 2 comparative examples, the EC3 example contains aluminum chloride. Other trivalent chromium solutions containing aluminum chloride have been described. Suvegh et al. (Journal of Electroanalytical Chemistry 455 (1998) 69-73) use an electrolyte comprising 0.8 M $[Cr(H_2O)_4Cl_2]Cl.2H_2O$, 0.5 M $NH_4Cl$, 0.5 M NaCl, 0.15 M $H_3BO_3$, 1 M glycine, and 0.45 M $AlCl_3$, pH not described. Hong et al. (Plating and Surface Finishing, March 2001) describe an electrolyte comprising mixtures of carboxylic acids, a chromium salt, boric acid, potassium chloride, and an aluminum salt, at pH 1-3. Ishida et al. (Journal of the Hard Chromium Platers Association of Japan 17, No. 2, Oct. 31, 2002) describe solutions comprising 1.126 M $[Cr(H_2O)_4Cl_2]Cl.2H_2O$, 0.67 M glycine, 2.43 M $NH_4Cl$, and 0.48 M $H_3BO_3$ to which varying amounts of $AlCl_3.6H_2O$, from 0.11 to 0.41 M were added; pH was not described. Of these four references disclosing aluminum chloride in the trivalent chromium bath, only Ishida et al. contends that the chromium deposit is crystalline, stating that crystalline deposits accompany increasing concentrations of $AlCl_3$.

In Table 3 various aqueous ("T") trivalent chromium-containing electrolytes and one ionic liquid ("IL") trivalent chromium-containing electrolyte, all of which can produce chromium deposits in excess of one micron thickness, are listed and the crystallographic properties of the deposit tabulated.

TABLE 3

Trivalent chromium based electrolytes for functional chromium

| | T1 | T2 | T3 | T4 | T5 | T6 | T7 | IL1 | MW |
|---|---|---|---|---|---|---|---|---|---|
| $Cr(OH)SO_4 \bullet Na_2SO_4$ (M) | 0.39 | 0.39 | 0.39 | 0.55 | 0.39 | | | | 307 |
| KCl (M) | 3.35 | | | | | | | | 74.55 |
| $H_3BO_3$ (M) | 1.05 | | | | | | | | 61.84 |
| $HCO_2^-K^+$ (M) | 0.62 | | | | | | | | 84.1 |
| $CrCl_3 \bullet 6H_2O$ (M) | | | | | | | 1.13 | 2.26 | 266.4 |
| $Cr(HCO_2)_3$ (M) | | | | | | 0.38 | | | 187 |
| $CH_2OHCH_2N^+(CH_3)_3Cl^-$ (M) | | | | | | | | 2.13 | 139.5 |
| $NH_4CHO_2$ (M) | | 3.72 | | | | | 5.55 | | 63.1 |
| LiCl (M) | | | | | | | | 2.36 | 42.4 |
| $HCO_2H$ (M) | | | 3.52 | 3.03 | 3.52 | 0.82 | 4.89 | | 46.02 |
| $NH_4OH$ (M) | | | 5.53 | 4.19 | 5.53 | | | | 35 |
| $(NH_4)_2SO_4$ (M) | | 0.61 | 0.61 | | | 1.18 | | | 132.1 |
| $NH_4Cl$ (M) | | 0.56 | 0.56 | 1.87 | 0.56 | 0.56 | | | 53.5 |
| $NH_4Br$ (M) | | 0.10 | 0.10 | 0.51 | 0.10 | 0.10 | 0.10 | | 97.96 |
| $Na_4P_2O_7 \bullet 10H_2O$ (M) | | 0.034 | 0.034 | | | 0.034 | | | 446 |
| KBr (M) | 0.042 | | | | | | | | 119 |
| $H_2O$ | to 1 L | to 1 L | to 1 L | to 1 L | to 1 L | to 1 L | to 1 L | none | 18 |
| pH | 0.1-3 | 0.1-3 | 0.1-3 | 0.1-3 | 0.1-3 | 0.1-3 | 0.1-3 | NA | |
| Current density ($A/dm^2$) | 12.4 | 20 | 20 | 20 | 20 | 50 | 80 | | |
| Temp. ° C. | 45 | 45 | 45 | 45 | 45 | 45 | 45 | 80 | |
| Cathodic eff. | 25% | 15% | 15% | 15% | 15% | 30% | | ~10% | |
| Lattice(s) as deposited | Amor. | Amor. | Amor. | Amor. | Amor. | Amor. | NA | SC | |
| Grain Pref. Orientation as deposited | NA | NA | NA | NA | NA | Pwdr | Pwdr | Rndm | |
| Lattice parameter after anneal 4 hr./191° C. | 2.882 | 2.884 | 2.882 | 2.886 | 2.883 | NA | NA | — | |
| Organic additives pH > 4 | Amor. | xtal. | xtal. | xtal. | xtal. | xtal. | xtal. | — | |
| Grain Orientation after anneal | | (111), rndm | (111), rndm | (111), rndm | (111), rndm | (111), rndm | (111), rndm | | |
| Electrolyte + $AlCl_3 \bullet 6H_20$ 0.62 M, pH < 3 | Amor. | xtal. | xtal. | xtal. | xtal. | xtal. | xtal. | | |

(In Table 3: "Amor." = amorphous; rndm = random; Pwdr = powder; NA = not applicable; SC = simple cubic; xtal. = crystalline)

In Table 4 the various deposits from Tables 1, 2 and 3 are compared using standard test methods frequently used for evaluation of as-deposited functional chromium electrodeposits. From this table it can be observed that amorphous deposits, and deposits that are not BCC (body centered cubic) do not pass all the necessary initial tests.

TABLE 4

Comparison of test results on as-deposited functional chromium from electrolytes in tables 1-3

| Electrolyte | Structure | Orientation | Appearance | Grind test | Macro-crack after heating | Hardness Vickers (100 g) | Cracks from indentation? |
|---|---|---|---|---|---|---|---|
| H1 | BCC | random | powdery | fail | Yes | — | — |
| H2 | BCC | (222) | lustrous | pass | No | 900 | No |

TABLE 4-continued

Comparison of test results on as-deposited functional chromium from electrolytes in tables 1-3

| Electrolyte | Structure | Orientation | Appearance | Grind test | Macro-crack after heating | Hardness Vickers (100 g) | Cracks from indentation? |
|---|---|---|---|---|---|---|---|
| H3 | BCC | (222)(211) | lustrous | pass | No | 950 | No |
| H4 | BCC | (222) | lustrous | pass | No | 950 | No |
| H5 | BCC + SC | (222)(110) | lustrous | fail | No | 900 | No |
| H6 | BCC | random. | lustrous | fail | No | 960 | Yes |
| EC1 | amor. | NA | lustrous | fail | Yes | 845-1000 | Yes |
| EC2 | amor. | NA | lustrous | fail | Yes | 1000 | Yes |
| EC3 | amor. | NA | lustrous | fail | Yes | — | Yes |
| T1 | amor. | NA | lustrous | fail | Yes | 1000 | Yes |
| T2 | amor. | NA | lustrous | fail | Yes | 950 | Yes |
| T3 | amor. | NA | lustrous | fail | Yes | 950 | Yes |
| T4 | amor. | NA | lustrous | fail | Yes | 900 | Yes |
| T5 | amor. | NA | lustrous | fail | Yes | 1050 | No |
| T6 | amor. | NA | lustrous | fail | Yes | 950 | Yes |
| T7 | powdery | — | — | — | — | — | — |
| IL1 | SC | random | black particulate | fail | Yes | — | — |

The Present Invention: Nanogranular TEM or TEM+XRD Functional Crystalline Chromium from Trivalent Chromium Bath and Process In accordance with industrial requirements for replacement of hexavalent chromium electrodeposition baths, the deposits from trivalent chromium electrodeposition baths must be crystalline to be effective and useful as a functional chromium deposit. It has been found by the present inventors that certain additives can be used together with adjustments in the process variables of the electrodeposition process to obtain a desirably crystalline functional chromium deposit from a trivalent chromium bath that is substantially free of hexavalent chromium. Typical process variables include current density, solution temperature, solution agitation, concentration of additives, manipulation of the applied current waveform, and solution pH. Various tests may be used to accurately assess the efficacy of a particular additive, including, e.g., X-ray diffraction (XRD) (to study the structure of the chromium deposit), TEM diffraction (to study the structure of the chromium deposit, including determining that the deposit is TEM crystalline, even when XRD amorphous in addition to XRD crystalline), X-ray photoelectron spectroscopy (XPS) (for determination of alloying components of the chromium deposit, greater than about 0.2-0.5 wt. %), PIXE, (Particle Induced X-ray Emission) is a powerful, non-destructive elemental analysis technique, which can be used for very low concentrations of sulfur, carbon, nitrogen and oxygen in the chromium alloy deposit), and electron microscopy (for determination of physical or morphological characteristics such as cracking) and presence of nanocrystalline structure.

In the prior art, it has been generally and widely considered that chromium deposition from trivalent chromium baths must occur at pH values less than about 2.5. However, there are isolated trivalent chromium plating processes, including brush plating processes, where variously higher pH has been used, although the higher pH used in these brush plating solutions do not result in a crystalline chromium deposit. Therefore, in order to assess the efficacy of various additives, stable, high pH electrolytes were tested as well as the commonly accepted low pH electrolytes. The present inventors discovered that addition of a divalent sulfur-containing compound to the trivalent chromium bath, together with certain combinations of other additives, allows the deposition of a crystalline chromium deposit that is TEM only or both TEM and XRD crystalline, as deposited. The divalent sulfur additive is sometimes generally referred to as a "crystallization inducing additive", or "CIA".

TABLE 5

Additives inducing crystallization from trivalent chromium bath T2.

| Crystallization Inducing Additive | Concentration Range Added | T2 pH 2.5: Crystalline? | T2 pH 4.2: Crystalline? |
|---|---|---|---|
| Methionine | 0.1, 0.5, 1.0, 1.5 g/L | no | no, yes, yes, na |
| Cystine | 0.1, 0.5, 1.0, 1.5 g/L | no | yes, yes, yes, yes |
| Thiomorpholine | 0.1, 0.5, 1, 1.5, 2, 3 mL/L | no | no, no, yes, yes, yes, yes |
| Thiodipropionic Acid | 0.1, 0.5, 1.0, 1.5 g/L | no | no, yes, yes, yes |
| Thiodiethanol | 0.1, 0.5, 1.0, 1.5 g/L | no | no, yes, yes, yes |
| Cysteine | 0.1, 1, 2.0, 3.0 g/L | no | yes, yes, yes, yes, |
| Allyl Sulfide | 0.5, 1.0, 1.5 mL/L | no | no, yes, yes, na |
| Thiosalicylic Acid | 0.5, 1, 1.5 | no | yes, yes, yes |
| 3,3'-dithio dipropanoic acid | 1, 2, 5, 10 g/L | no | yes, yes, yes, yes, |
| Tetrahydrothiophene | 0.5, 1.0, 1.5 mL/L | no | no, yes, yes |

From the data shown in Table 5 it is apparent that compounds that have divalent sulfur in their structure induce crystallization when functional chromium is electrodeposited from a trivalent chromium solution, at about the above-stated concentrations and when the pH of the bath is greater than about 4, or in some embodiments, greater than 5, or in some embodiments, in the range from about 5 to about 6, in which the chromium crystals have the lattice parameter of 2.8895+/−0.0025 Å, in accordance with the present invention. In one embodiment, other divalent sulfur compounds can be used in the baths described herein to electrodeposit crystalline chromium having the lattice parameter of the present invention. In one embodiment, compounds having sulfur, selenium or tellurium, when used as described herein, also induce crystallization of chromium. In one embodiment, the selenium and tellurium compounds correspond to the above-identified sulfur compounds, and like the sulfur compounds, result in the electrodeposition of crystalline chromium having a lattice parameter of 2.8895+/−0.0025 Å.

To further illustrate the induction of crystallization, studies on crystallization inducing additives using electrolyte T3 at pH 5.5 and temperature 50° C. with identical cathode current densities of 40 A/dm$^2$ and plating times of thirty minutes using brass substrate are reported in Table 6. After plating is complete the coupons are examined using X-ray diffraction, X-ray induced X-ray fluorescence for thickness determination, and electron induced X-ray fluorescence with an energy dispersive spectrophotometer to measure sulfur content. Table 6 summarizes the data for the induction of sulfur from various divalent sulfur additives and the effects on as-plated crystallization of chromium deposit for trivalent chromium solution, and plating rate. The data suggest that it is not only the presence of a divalent sulfur compound in the solution at a concentration exceeding a threshold concentration, but also the presence of sulfur in the deposit that is important, as well as the combination with the other components of the bath, in inducing crystallization of the chromium deposit as it is deposited.

TABLE 6

| Crystallization Inducing Additive ("CIA") | Additive per L | Crystalline | Thickness (um) | [S] wt % in deposit |
|---|---|---|---|---|
| Methionine | 0.1 g | no | 3.13 | 2.1 |
| | 0.5 g | yes | 2.57 | 4.3 |
| | 1.0 g | yes | 4.27 | 3.8 |
| | 1.5 g | (insoluble) | 7.17 | 2.6 |

TABLE 6-continued

| Crystallization Inducing Additive ("CIA") | Additive per L | Crystalline | Thickness (um) | [S] wt % in deposit |
|---|---|---|---|---|
| Cystine | 0.1 g | yes | 1.62 | 3.9 |
| | 0.5 g | yes | 0.75 | 7.1 |
| | 1.0 g | yes | 1.39 | 9.3 |
| | 1.5 g | yes | 0.25 | 8.6 |
| Thiomorpholine | 0.1 mL | no | 6.87 | 1.7 |
| | 0.5 mL | no | 11.82 | 3.9 |
| | 1 mL | yes | 7.7 | 5.9 |
| | 1.5 mL | yes | 2.68 | 6.7 |
| | 2 mL | yes | 4.56 | 7.8 |
| | 3 mL | yes | 6.35 | 7.1 |
| Thiodipropionic Acid | 0.1 g | no | 6.73 | 1 |
| | 0.5 g | yes | 4.83 | 3.5 |
| | 1.0 g | yes | 8.11 | 1.8 |
| | 1.5 g | yes | 8.2 | 3.1 |
| Thiodiethanol | 0.1 mL | no | 4.88 | 0.8 |
| | 0.5 mL | yes | 5.35 | 4 |
| | 1.0 mL | yes | 6.39 | 4 |
| | 1.5 mL | yes | 3.86 | 4.9 |
| Cysteine | 0.1 g | yes | 2.08 | 5.1 |
| | 1.0 g | yes | 1.3 | 7.5 |
| | 2.0 g | yes | 0.35 | 8.3 |
| | 3.0 g | yes | 0.92 | 9.7 |
| Allyl Sulfide (oily) | 0.1 mL | no | 6.39 | 1.3 |
| | 0.5 mL | yes | 4.06 | 3.4 |
| | 1.0 mL | yes | 1.33 | 4.9 |
| | 1.5 mL | (insoluble) | 5.03 | 2.6 |
| Thiosalicylic Acid | 0.5 g | yes | 2.09 | 5.8 |
| | 1.0 g | yes | 0.52 | 5.5 |
| | 1.5 g | yes | 0.33 | 7.2 |
| | 1.5 g | yes | 0.33 | 7.2 |
| 3,3'-dithiodipropanoic acid | 1 g | yes | 7.5 | 5.9 |
| | 2 g | yes | 6 | 6.1 |
| | 5 g | yes | 4 | 6 |
| | 10 g | yes | 1 | 6.2 |
| 3,3-APDSP* | 3 g | yes | 2.03 | 9.47 |
| | 5 g | yes | 1.56 | 15.06 |
| [1,3]thiazin-3-ium chloride | 1 g | yes | 4.30 | 6.28 |
| | 2 g | yes | 4.32 | 7.79 |
| | 5 g | yes | 4.74 | 9.79 |
| Thiazolidin-3-ium dichloride | 1 g | yes | 4.34 | 7.14 |
| | 2 g | yes | 4.07 | 7.74 |
| | 5 g | yes | 2.99 | 8.49 |

(S content determined by EDS)
("(insoluble)" means the additive was saturated at the given concentration)
*3,3-APDSP = 3-(3-aminopropyl disulfanyl) propylamine hydrochloride The following Table 7 provides additional data relating to electroplating baths of trivalent chromium in accordance with the present invention, including representative formulations for production of as-deposited crystalline chromium from baths containing, inter alia, trivalent chromium.

TABLE 7

| Process | Electrolyte | Additive | pH-° C.-A/dm$^2$ | Cathode Efficiency | preferred orientation | $H_v$ | [C] | [S] | [N]] |
|---|---|---|---|---|---|---|---|---|---|
| P1 | T2 | 4 ml/L thio-morpholine | 5.5-50-40 | 5-10% | (222) | 900-980 | 3.3 | 1.57 | 0.6 |
| P2 | T2 | 3 ml/L thio-diethanol | 5.5-50-40 | 10% | Random and (222) | — | 3.0 | 1.4 | 0.6 |
| P3 | T2 | 1 g/L L-cysteine | 5.5-50-40 | 5% | Random and (222) | — | | | |
| P4 | T5 | 4 ml/L thio-morpholine | 5.5-50-40 | 5-10% | (222) | 900-980 | | | |
| P5 | T5 | 3 ml/L thio-diethanol | 5.5-50-40 | 10% | Random and (222) | — | | | |
| P6 | T5 | 1 g/L I-cysteine | 5.5-50-40 | 5% | Random and (222) | — | | | |
| P7 | T5 | 4 ml/L thio-morpholine | 5.5-50-40 | 15% | (222) | 900-980 | | | |
| P8 | T5 | 3 ml/L thio-diethanol | 5.5-50-40 | 10-12% | Random and (222) | — | | | |

TABLE 7-continued

| Process | Electrolyte | Additive | pH-° C.-A/dm$^2$ | Cathode Efficiency | preferred orientation | $H_v$ | [C] | [S] | [N]] |
|---|---|---|---|---|---|---|---|---|---|
| P9 | T5 | 1 g/L L-cysteine | 5.5-50-40 | 7-9% | Random and (222) | — | | | |
| P10 | T5 | 2 g/L thiosalicylic acid | 5.5-50-40 | 10-12% | (222) | 940-975 | 5.5 | 1.8 | 1.3 |
| P11 | T5 | 2 g/L 3,3'-dithiodipropanoic acid | 5.5-50-40 | 12-15% | (222) | 930-980 | 4.9 | 2.1 | 1.1 |
| P12 | T5 | 3 g/L 3,3-APDSP* | 5.5-50-40 | 12-15% | (222) | | | | |
| P13 | T5 | 2 g/L [1,3]thiazin-3-ium Cl | 5.5-50-40 | 12-15% | (222) | | | | |
| P14 | T5 | 2 g/L Thiazolidin-3-ium 2Cl | 5.5-50-40 | 12-15% | (222) | | | | |

*3,3-APDSP = 3-(3-aminopropyl disulfanyl) propylamine hydrochloride

Although the hardness, C, S and N concentrations are not yet available for the T5 electrolyte examples P12, P13 and P14, since the deposits are clearly crystalline as deposited, it is considered that these data fall within the ranges disclosed herein for each of these parameters.

The above examples are prepared with direct current and without the use of complex cathodic waveforms such as pulse or periodic reverse pulse plating, although such variations on the applied electrical current are within the scope of the present invention. All of the examples in Table 7 that are crystalline have a lattice constant of 2.8895+/−0.0025 Å, as deposited.

Figure 11:
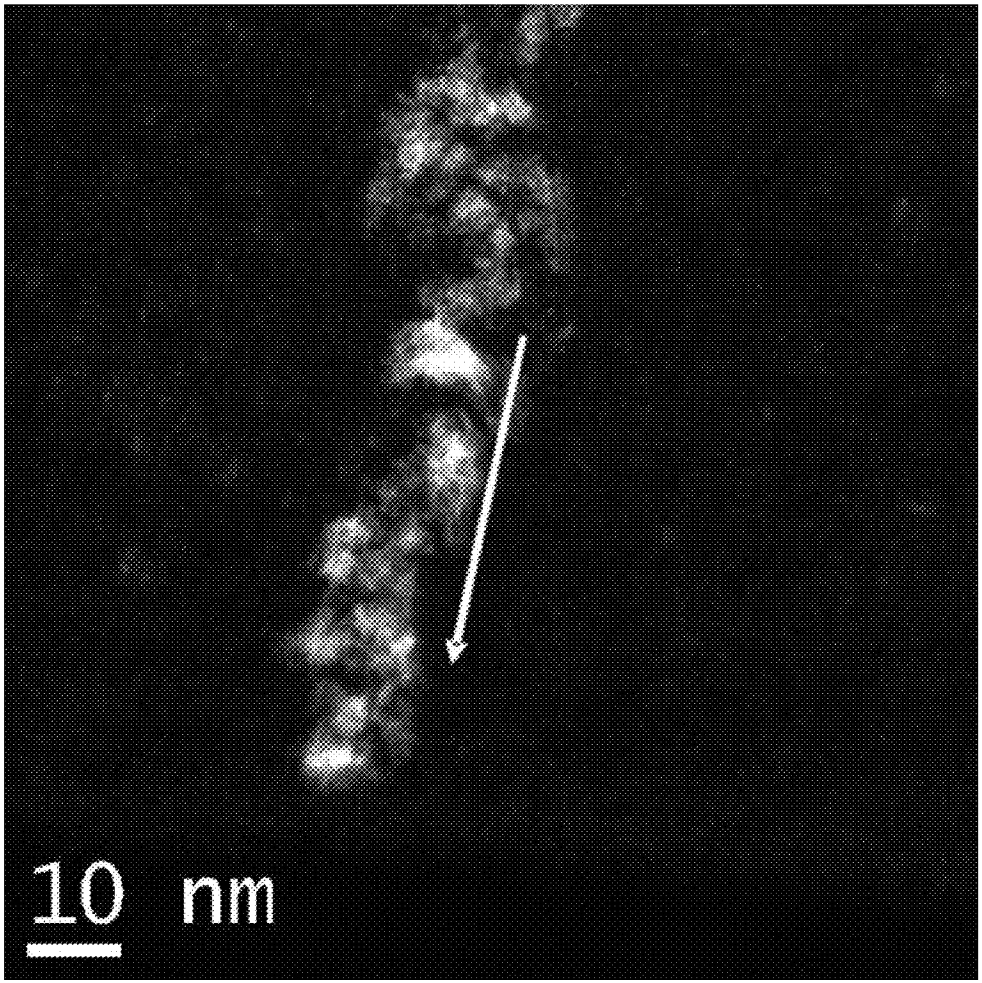
FIGS. 11-13 are dark field TEM photomicrographs of a cross sectioned lamella from chromium deposits in accordance with the present invention and conventional chromium deposit from a hexavalent chromium bath.

When deposits from processes P12, P13 and P14 are taken for TEM analysis, results consistent with a crystalline chromium deposit having very small grain size are obtained. A thin 10-30 nm lamella about 200×400 nm in size is extracted from the deposit using a focused ion beam extraction method and welded to a TEM grid. The lamella is then examined with a 300 kV field emission TEM by high resolution lattice imaging, dark field and bright field illumination, and by convergent beam electron diffraction (CBED). Several CBED patterns are observed consistent with crystalline deposits, but regions having grains that are oriented in different directions perpendicular to the TEM beam. The obtained high resolution images, such as that shown in FIG. 14, show regions with distinct lattice patterns on the scale of 5-20 nm. The dark field TEM, such as that shown in FIG. 11, shows grains stacked above each with similar contrast suggesting a field oriented fiber was disrupted during growth creating a series of small, nearly symmetric, grains in the 5-20 nm size range. Thus, the grain size of the crystalline chromium deposits in these embodiments of the present invention are quite small, and are substantially smaller than the grain size obtained from hexavalent chromium baths and processes. In one embodiment, the grain size of the crystalline chromium deposits of the present invention have an average grain size of less than 20 nm, and in one embodiment, the grain size of the crystalline chromium deposits of the present invention have an average grain size in the range from 5 nm to 20 nm.

Figure 12:
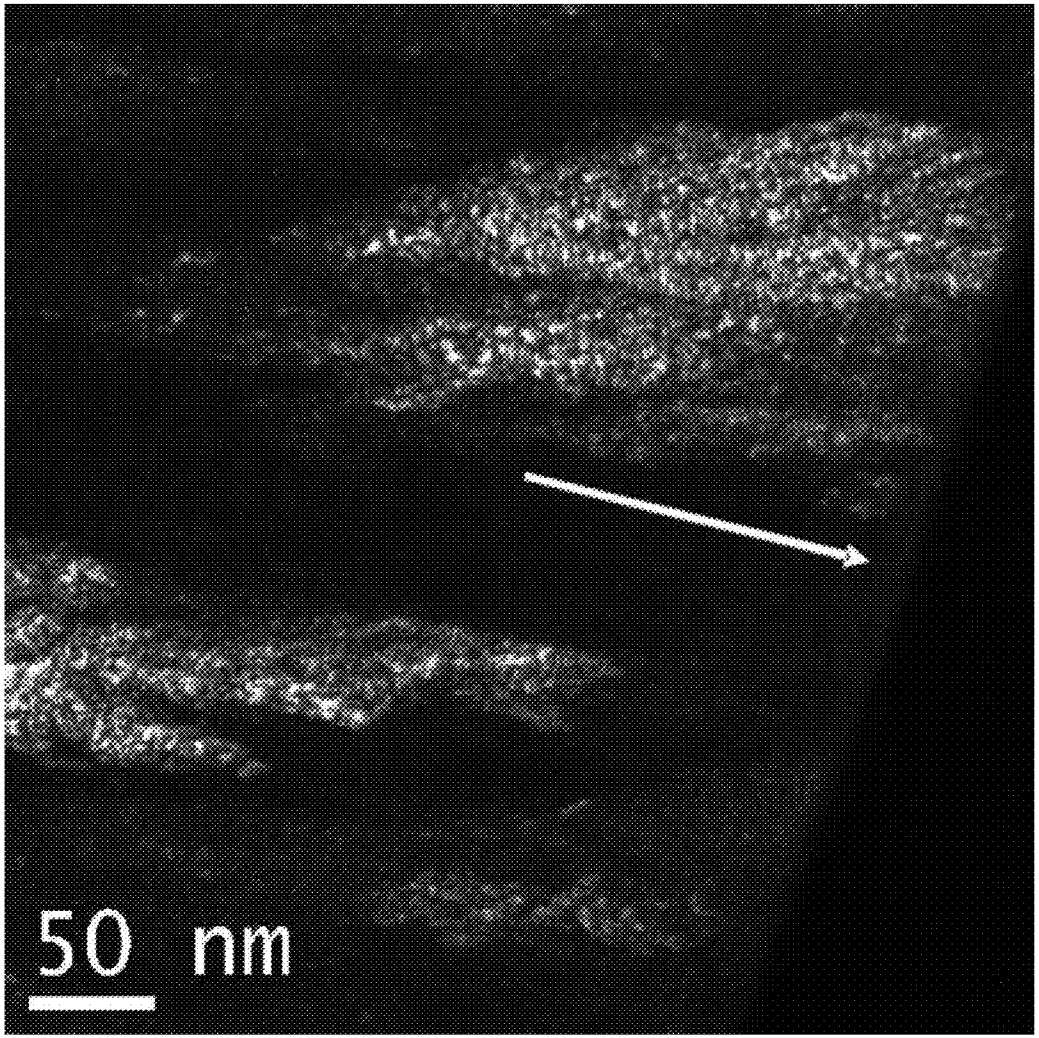
Figure 13:
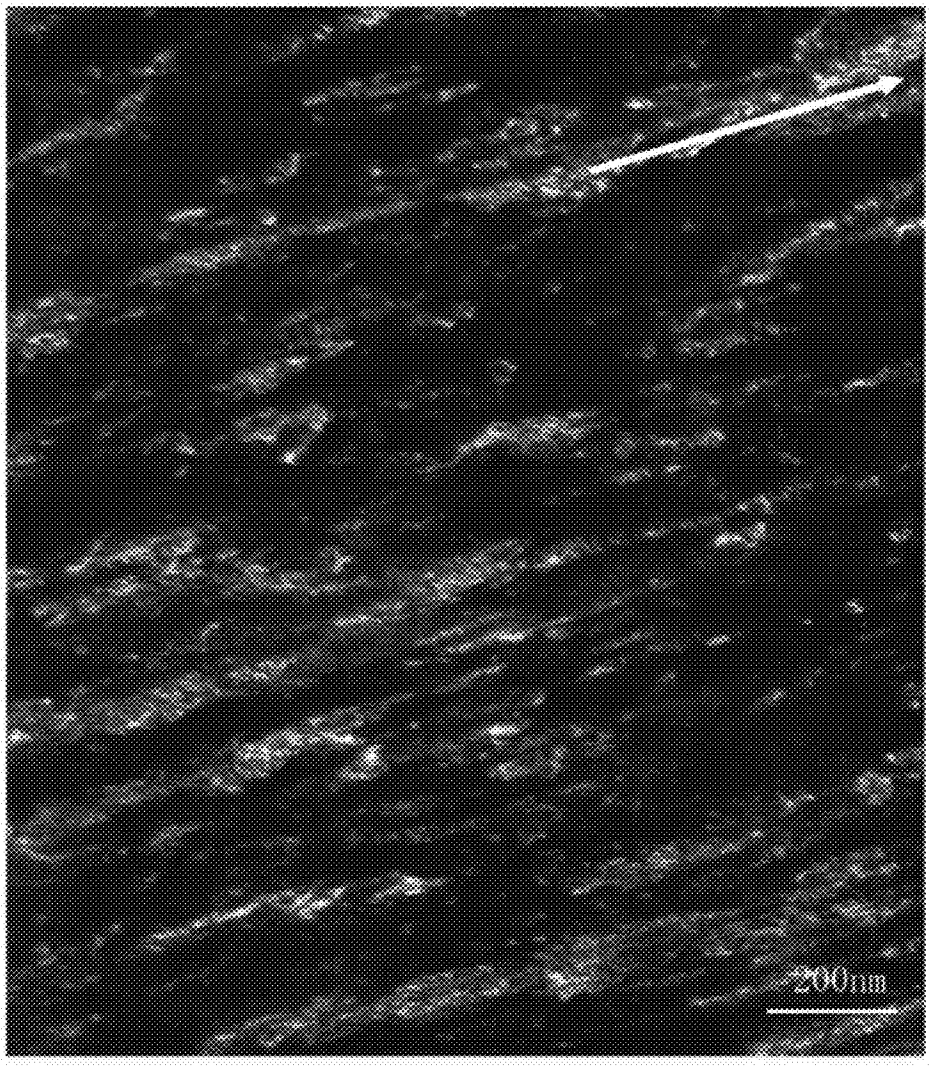

FIGS. 11-13 are dark field TEM photomicrographs of a cross sectioned lamella from chromium deposits in accordance with the present invention and conventional chromium deposit from a hexavalent chromium bath. The superimposed arrow in each of FIGS. 11-13 shows the direction toward the surface interface. FIG. 11, as noted above, is a dark field TEM of a nanogranular TEM crystalline XRD amorphous chromium alloy deposit in accordance with an embodiment of the present invention. The chromium alloy crystal grain shown in FIG. 11 has an approximate cross-sectional area of 332 nm$^2$, estimated using ImageJ software. FIG. 12 is a dark field TEM of a both TEM and XRD nanogranular crystalline chromium alloy deposit. The chromium alloy crystal grain shown in FIG. 12 has an approximate cross-sectional area of 20,600 nm$^2$, estimated using ImageJ software. FIG. 13 is a dark field TEM of a XRD crystalline chromium deposit from a hexavalent process. The chromium crystal grain nearest the arrow shown in FIG. 13 has an approximate cross-sectional area of 138860 nm$^2$, estimated using ImageJ software, although it appears this grain extends outside the image range, and so is likely to have a considerably larger cross-sectional area. It is noted that each of FIGS. 11-13 is at a different scale, appropriate to the grain size depicted in the respective dark field TEM.

In a further example of the utility of this invention pulse depositions are performed using simple pulse waveforms generated with a Princeton Applied Research Model 273A galvanostat equipped with a power booster interface and a Kepco bipolar+/−10 A power supply, using process P1, with and without thiomorpholine. Pulse waveforms are square wave, 50% duty cycle, with sufficient current to produce a 40 A/dm$^2$ current density overall. The frequencies employed are 0.5 Hz, 5 Hz, 50 Hz, and 500 Hz. At all frequencies the deposits from process P1 without thiomorpholine are amorphous while the deposits from process P1 with thiomorpholine are crystalline as deposited.

In a further example of the utility of this invention pulse depositions are performed using simple pulse waveforms generated with a Princeton Applied Research Model 273A galvanostat equipped with a power booster interface and a Kepco bipolar+/−10 A power supply, using process P1, with and without thiomorpholine. Pulse waveforms are square wave, 50% duty cycle, with sufficient current to produce a 40 A/dm$^2$ current density overall. The frequencies employed are 0.5 Hz, 5 Hz, 50 Hz, and 500 Hz. At all frequencies the deposits from process P1 without thiomorpholine are amorphous while the deposits from process P1 with thiomorpholine are crystalline as deposited, and have a lattice constant of 2.8895+/−0.0025 Å.

Similarly the electrolyte T5 is tested with and without thiosalicylic acid at a concentration of 2 g/L using a variety of pulse waveforms having current ranges of 66-109 A/dm$^2$ with pulse durations from 0.4 to 200 ms and rest durations of 0.1 to 1 ms including periodic reverse waveforms with reverse current of 38-55 A/dm$^2$ and durations of 0.1 to 2 ms. In all cases, without thiosalicylic acid the deposit is amorphous, with thiosalicylic acid the deposit is crystalline, and has a lattice constant of 2.8895+/−0.0025 Å.

In one embodiment, the crystalline chromium deposits are homogeneous, without the deliberate inclusion of particles, and have a lattice constant of 2.8895+/−0.0025 Å. For example, particles of alumina, Teflon, silicon carbide, tungsten carbide, titanium nitride, etc. may be used with the present invention to form crystalline chromium deposits including such particles within the deposit. Use of such particles with the present invention is carried out substantially in the same manner as is known from prior art processes.

The foregoing examples use anodes of platinized titanium. However, the invention is in no way limited to the use of such anodes. In one embodiment, a graphite anode may be used as an insoluble anode. In another embodiment, a soluble chromium or ferrochromium anodes may be used. In another embodiment an iridium anode is employed.

In one embodiment, exemplified by certain of the data shown in the following Table 8 for some exemplary embodiments of the present invention, the present invention relates to a chromium deposit that is crystalline as determined by transmission electron microscopy (TEM) but which is amorphous as determined by X-ray diffraction using a copper K alpha (Cu K $\alpha$) source (XRD). In one embodiment, when the sulfur content of the chromium deposit is in the range from about 0.05 wt. % to about 2.5 wt. %, the chromium deposit in accordance with this embodiment is TEM crystalline and XRD amorphous. In one embodiment, the sulfur content of the chromium deposit is in the range from about 0.06 wt. % to about 1 wt. %. In one embodiment, the sulfur content of the chromium deposit is in the range from about 0.06 wt. % to less than 1 wt. %, e.g., up to about 0.9 wt. %, or up to about 0.95 wt. %, or up to about 0.98 wt. %.

As an indication of the significance of the sulfur content, even as low as 0.06 wt. %, when zero sulfur is present in the deposit, the deposit is TEM amorphous as well as XRD amorphous. In one embodiment, the zero sulfur deposit is obtained by preparing an electroplating bath containing all of the herein disclosed ingredients except for the divalent sulfur source, and plating a chromium deposit from the bath. Because the quantity of sulfur in the chromium deposit according to the invention is so low, this method was used to obtain such a deposit.

In addition, in one embodiment, the SEM crystalline, XRD amorphous chromium deposit having the foregoing sulfur contents exhibits significantly improved Taber wear test results, in accordance with the test method of ASTM G195-08.

Figure 18:
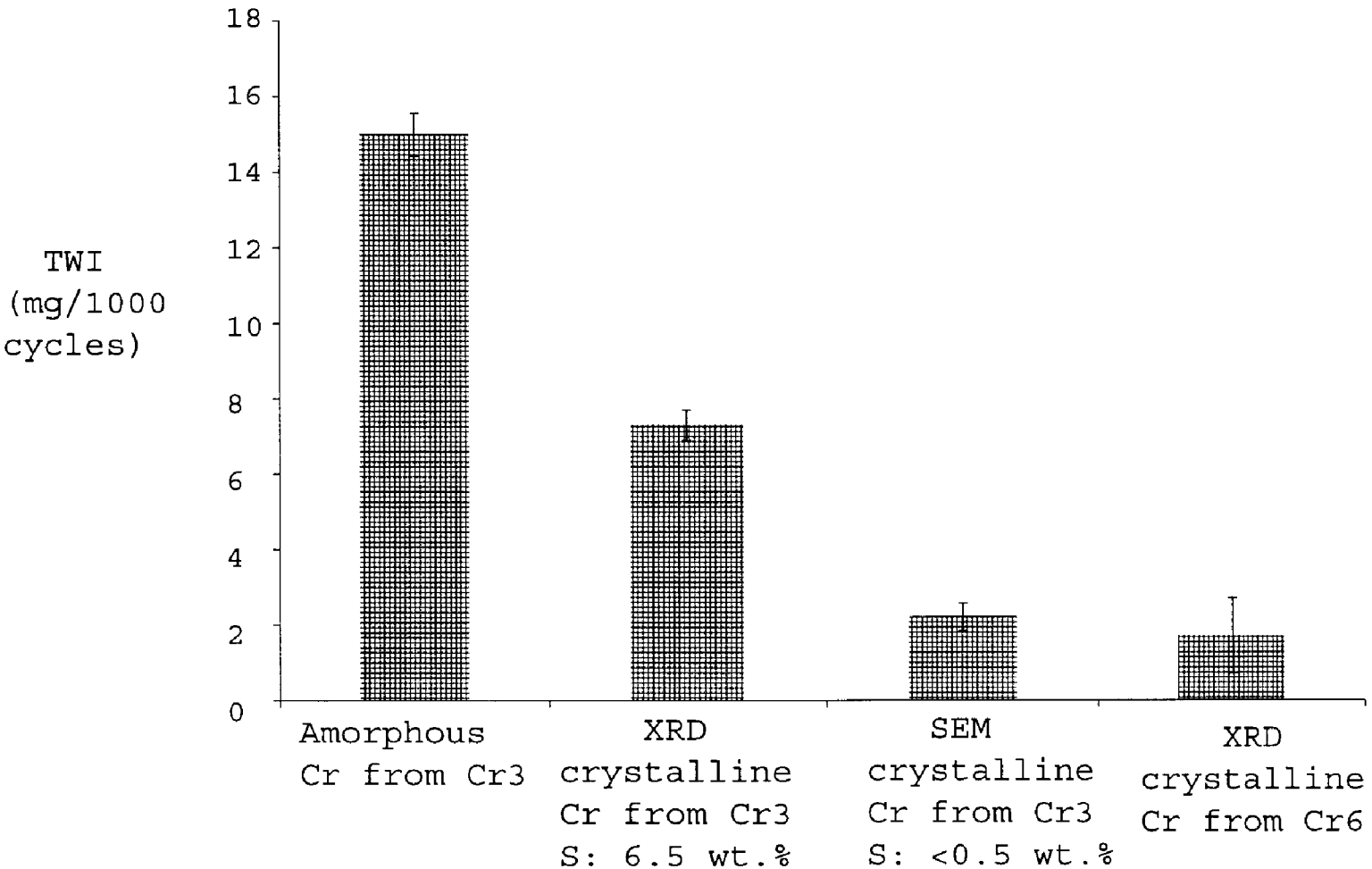
FIG. 18 is a graph comparing Taber wear data for various chromium deposits, including both conventional chromium deposits and a chromium deposit in accordance with the present invention.

FIG. 18 is a graph comparing Taber wear data for various chromium deposits, including both conventional chromium deposits and a chromium deposit in accordance with the present invention. The data underlying the graph in FIG. 18 is shown in the following, in which the Taber wear index is reported as milligrams lost per 1000 cycles under a 1 kg load:

| Sample | Taber wear index | 95% low | 95% high |
|---|---|---|---|
| chromium from hexavalent | 1.7 | 1.35 | 2.05 |
| amorphous chromium from trivalent | 15 | 14 | 16 |
| XRD crystalline chromium from trivalent, 6.5 wt. % sulfur | 7.3 | 6.72 | 7.88 |

-continued

| Sample | Taber wear index | 95% low | 95% high |
|---|---|---|---|
| XRD amorphous, TEM crystalline chromium alloy from trivalent, <0.5 wt. % sulfur | 2.2 | 1.8 | 2.5 |

As shown in FIG. 18, and in the data above, the Taber wear test results for an embodiment of the present invention in which the nanogranular TEM crystalline XRD amorphous chromium alloy deposit contains less than 0.5 wt. % sulfur compares quite favorably with the Taber wear test results for a conventional chromium deposit obtained from a hexavalent chromium process. In addition, as shown in FIG. 18, the Taber wear test results for an embodiment of the present invention in which the nanogranular TEM crystalline XRD amorphous chromium alloy deposit contains less than 0.5 wt. % sulfur compares very favorably with the Taber wear test results for a XRD crystalline chromium deposit containing about 6.5 wt. % sulfur, which is not nanogranular. As shown in FIG. 18, the Taber wear test results for an embodiment of the present invention in which the nanogranular TEM crystalline XRD amorphous chromium alloy deposit contains less than 0.5 wt. % sulfur compares very favorably with the Taber wear test results for a TEM and XRD amorphous chromium deposit from a conventional trivalent chromium process (one not in accordance with the present invention).

In addition, in one embodiment, the SEM crystalline, XRD amorphous chromium deposit having the foregoing sulfur contents exhibits significantly improved Vickers hardness when tested in accordance with the test method of ASTM E92-82 (2003)e2 Standard test Method for Vickers Hardness of Metallic Materials.

The data in Table 8 is provided as examples of the present invention, and is not intended to be limiting of the scope of the invention, but rather is provided to enable those of skill in the art to better understand and appreciate the invention.

EXPERIMENTAL

A high pH electrodeposition bath in accordance with an embodiment of the present invention is prepared by combining the following ingredients:

| | |
|---|---|
| CIA (3,3'-dithiodipropanoic acid) | 3 g/L (initial) |
| $Cr^{+3}$ ion | 20 g/L (as $Cr(OH)SO_4 \cdot Na_2SO_4$ = 118.5 g/L) |
| 90% formic acid | 180 mL/L |
| $NH_4Cl$ | 30 g/L |
| $NH_4Br$ | 10 g/L |
| pH | 5.5 |

A series of steel coupons is prepared by electrodeposition from the above-described bath, which initially contains 4.5 g/L of CIA. A control electrodeposition bath is prepared in the same manner but without the CIA. By continuously electroplating from the solution, monitoring the amount of sulfur in the deposit, which gradually decreases with continued operation of the electrolysis, and comparing the properties of the deposits obtained on the coupons, the properties of the deposit can be compared as a function of sulfur content. The process begins with all of the coupons in the electrodeposition bath, and coupons are withdrawn at the times indicated by the Ah/L, when the bath is operated at a current density of 30-40 A/dm$^2$. (This is an exemplary current density range, and other suitable current densities may be used, with appropriate adjustments as known in the art.)

Composition and properties of the deposit are measured using the following methods:

The correlation between sulfur in the deposit and small amounts of CIA may be used to estimate the amount of CIA in the baths that produce nanogranular, TEM crystalline, XRD amorphous chromium deposits. The consumption rate of the CIA is in the approximate range from 0.11 g/AH (estimated from a 1 L scale bath) to 0.16 g/AH (estimated from a 400 L scale bath). The correlation equation between CIA in solution and sulfur content in the deposit, for less than 2 wt % sulfur in the deposit, is [S](wt %)≅15.5 [CIA](g/L), where [S] is the sulfur content in the deposit and [CIA] is the concentration of the CIA in the electrodeposition bath.

Determination of the concentration of the CIA may be carried out by use of differential pulse stripping polarography with a Hanging Mercury prop Electrode (HMDE). The conditions for the analysis are as follows:

purge time: 300 s (with Nitrogen);
Conditioning potential: 0;
Conditioning time: 10 s;
Deposition time: 120 s;
Deposition potential: 0;
Initial Potential: 0;
Final potential: −0.8V or −1.5V;
Scan rate: 2 mV/s;
Pulse height: 50 mV.

Sulfur and chromium in the deposit are measured by six x-ray fluorescence methods using the S k and Cr k x-ray emission lines: (1) Electron induced (15 kV) x-ray fluorescence (XRF); (2) Energy dispersive spectroscopy (EDAX® EDS) in a LEO scanning electron microscope (SEM); (3) X-ray (40 kV) induced XRF in a non-vacuum environment with a Phillips XRF; (4) Electron induced (15 kV) XRF using a Bruker Quantax silicon drift detector (SDD) EDS with an SEM; (5) radiation induced XRF from a radioactive isotope source; and (6) particle (proton) induced XRF (PIXE) with 1.2 MeV excitation using an NEC tandem pelletron.

Surface roughness is determined using two methods: (1) Stylus profilometry with a Mitotoyo Surftest 501 profilometer and (2) non contact profilometry using an Olympus laser scanning confocal microscopy (LSCM) with 405 nm laser radiation. and subsequent data analysis using the ImageJ image analysis software from the NIH Various statistics may be obtained, including Ra and Rq, the arithmetic and root mean square deviations of roughness, respectively, and SA/IA, the estimated surface area to image area. Methods defined by ASME Y14.36M-1996 and ISO 1302:2001 may be used to define roughness statistics.

Carbon, oxygen, chromium and sulfur in the bulk deposit are estimated using x-ray photoelectron spectroscopy (XPS) with a PHI VersaProbe XPS utilizing a monochromated aluminum x-ray source after argon ion sputtering to depths of about 500 to 1000 nm.

XRD crystallinity is determined with a Bruker D8 diffractometer utilizing Cu K α x-ray source. The XRD pattern is examined and determined to be representative of a crystalline material when sharp peaks are observed at diffraction angles that match those of standard chromium reference patterns.

TEM crystallinity and cross sectional grain area is determined using a Phillips/FEI Tecnai F-30 300 keV field emission transmission electron microscope (TEM). Lamella approximately 20×8×0.2 micron for the TEM may be prepared with an FEI dual beam Nanolab field emission focused ion beam (FIB) equipped with either a Kleindeik or Omniprobe micromanipulator. The cross sectional area is determined by examining dark field photomicrographs and utilizing the ImageJ image processing software to estimate the cross-sectional area as a measure of grain size.

Microhardness is determined by preparing metallographic cross sections and using a Struers/Duramin Vickers/Knoop hardness tester, as in ASTM D-1474.

Nanohardness and reduced modulus is determined using Veeco DI 3100 atomic force microscope equipped with a Hysitron nanoindenter. The data obtained is expressed as nanohardness perpendicular to the surface and reduced modulus. The nanoindentation instrument obtains data related to the modulus (E) and Poisson's ratio (u) as they relate to reduced modulus (Er) based upon Oliver and Pharr, and often represented as:

$$1/E_r=(1-u_i^2)/E_i-(1-u_s^2)/E_s$$

where the subscripts describe the indenting and sample material and experimentally determined from the stiffness of the material obtained by unloading during indentation. The determination of nanohardness is carried out in accordance with the procedure described in a paper: Pharr, G. M., "Measurement of mechanical properties by ultra-low load indentation", Mat. Sci. Eng. A 253 (1-2), 151-159 (1998).

Wear rates are determined using a Taber abrader and Taber test panels. Wear rates express the amount of material eroded under repeated cycles by an abrasive wheel under load, in accordance with ASTM G195-08.

Deposition rates are determined by mass gain of the plated parts.

TABLE 8

| Panel | Ah/L | [S] wt % EDS | [S] wt % PIXE | [CIA] g/L by DP polarography | XRD x'tal? 1 = yes 0 = yes | TEM x'tal? 1 = yes 0 = no | Deposition rate (um/hr @ 4 Amp/cm$^2$) | Taber Wear (mg/100 0 cycles) | Approximate grain cross sectional area (nm$^2$) | H GPa) | Er (GPa) | Rq (μM) | SA/IA |
|---|---|---|---|---|---|---|---|---|---|---|---|---|---|
| 1 | 0.00 | 6.1 | 6.10% | 3.3 | 1.00 | | | | | | | | |
| 5 | 1.32 | 6.5 | | | 1.00 | | | | | | | | |
| 9 | 2.64 | 6.1 | 5.98% | 3.3 | 1.00 | | | | | | | | |
| 13 | 3.96 | 5.97 | | | 1.00 | | | | | | | | |
| 17 | 5.28 | | 5.78% | 2.2 | 1.00 | 1.00 | 5.00 | 7.00 | 20000.00 | 5.8 | 110 | 1.8 | 111.76% |
| 21 | 6.61 | | | | 1.00 | | | | | | | | |
| 25 | 7.93 | | 5.27% | | 1.00 | | | | | | | | |
| 29 | 9.25 | | | 2 | 1.00 | | | | | | | | |
| 33 | 10.57 | 5.85 | 4.81% | | 1.00 | | | | | | | | |
| 37 | 11.89 | 5.9 | | 1.8 | 1.00 | | | | | | | | |
| 41 | 13.21 | 5.8 | 4.11% | | 1.00 | 1.00 | 7.00 | 5.00 | | 6.4 | 119 | 1.79 | 109.35% |
| 45 | 14.53 | 5.35 | | | 1.00 | | | | | | | | |
| 49 | 15.85 | 4.68 | | 1.2 | 1.00 | | | | | | | | |
| 53 | 17.17 | 3.93 | | | 1.00 | | | | | | | | |

TABLE 8-continued

| Panel | Ah/L | [S] wt % EDS | [S] wt % PIXE | [CIA] g/L by DP polarography | XRD x'tal? 1 = yes 0 = yes | TEM x'tal? 1 = yes 0 = no | Deposition rate (um/hr @ 4 Amp/cm$^2$) | Taber Wear (mg/100 0 cycles) | Approximate grain cross sectional area (nm$^2$) | H GPa) | Er (GPa) | Rq (μM) | SA/IA |
|---|---|---|---|---|---|---|---|---|---|---|---|---|---|
| 57 | 18.49 | 2.8 | 2.43% | 0.4 | 1.00 | 1.00 | 10.00 | | | 15.8 | 128 | 1.4 | 102.48% |
| 61 | 19.82 | 1.57 | | | 0.00 | | | | | | | | |
| 65 | 21.14 | 1.49 | 1.40% | | 0.00 | 1.00 | 20.00 | 2.00 | | 17.5 | 140 | 1 | 99.23% |
| 69 | 22.46 | 0.43 | | 0.01 | 0.00 | | | | | | | | |
| 73 | 23.78 | 0.28 | | | 0.00 | | | | | | | | |
| 77 | 25.10 | | 0.14% | | 0.00 | 1.00 | 25.00 | 3.00 | | 18 | 175 | 0.97 | 99.61% |
| 81 | 26.42 | | | | 0.00 | | | | | | | | |
| 85 | 27.74 | | | | 0.00 | | | | | | | | |
| 89 | 29.06 | | 0.19% | | 0.00 | 1.00 | 28.00 | 2.00 | 250.00 | 17.8 | 170 | 0.95 | 100.16% |
| 93 | 30.38 | | 0.14% | | 0.00 | | | | | | | | |
| 97 | 31.70 | | 0.09% | | 0.00 | | | | | | | | |
| 101 | 33.03 | | 0.06% | | 0.00 | | | | | | | | |
| 105 | 34.35 | | 0.06% | | 0.00 | | | | | | | | |
| 106 | | | 0.0 | control - none | 0.00 | 0.00 | 35.00 | | | | | | |

To produce an XRD amorphous, TEM crystalline deposit, the electroplating bath contains a source of divalent sulfur. This source of divalent sulfur may be referred to as the CIA. In one embodiment, the CIA is present at a concentration sufficient to co-deposit from about 0.05 wt. % to about 2.5 wt. % sulfur, considering only S and Cr in the deposit. In one embodiment, the CIA is present at a concentration sufficient to co-deposit from about 0.05 wt. % to about 1.4 wt. % sulfur. In one embodiment, the CIA is present at a concentration sufficient to co-deposit from about 0.05 wt. % to about 0.28 wt. % sulfur. Without the CIA, the deposit is not TEM crystalline (and is not XRD crystalline), even though sulfur from sulfate ($SO_4^{-2}$) is present in the bath.

In one embodiment, the XRD amorphous, TEM crystalline nanogranular functional chromium alloy deposit obtains significantly improved Vickers hardness as compared to embodiments in which the crystalline chromium alloy deposit is both XRD crystalline and TEM crystalline, and the deposit contains a higher sulfur content. The following Table 9 shows Vickers hardness data, including standard deviation and 95% confidence intervals for selected panels from those shown above in Table 8.

TABLE 9

| Panel# | [S] content (wt. %) | Crystalline? | Hardness | Standard deviation | 95% confidence |
|---|---|---|---|---|---|
| 41 | 4.11 (PIXE) | XRD, TEM | 585 | 17 | 10 |
| 49 | 4.68 (EDS) | XRD, TEM | 642 | 36 | 22 |
| 57 | 2.43 PIXE | XRD, TEM | 667 | 41 | 25 |
| 65 | 1.40 (PIXE) | TEM only | 743 | 20 | 12 |
| 73 | 0.28 (EDS) | TEM only | 807 | 21 | 13 |
| 101 | 0.06 (PIXE) | TEM only | 828 | 22 | 14 |

As is evident from the data shown in Tables 8 and 9, the Vickers hardness for the panels 65, 73 and 101, in which the nanogranular functional chromium alloy deposit is TEM crystalline and XRD amorphous is considerably higher than for panels 41, 49 and 57, in which the nanogranular functional chromium alloy deposit is both TEM crystalline and XRD crystalline.

The following Table 10 shows the chromium, carbon, oxygen, nitrogen and sulfur contents of six representative coupons from those listed in Table 8.

TABLE 10

| Element | Coupon 17, wt. % | Coupon 41, wt. % | Coupon 57, wt. % | Coupon 65, wt. % | Coupon 77, wt. % | Coupon 89, wt. % |
|---|---|---|---|---|---|---|
| Cr | 93.98 | 94.02 | 94.50 | 90.64 | 88.23 | 88.69 |
| C | 0.84 | 0.74 | 1.52 | 4.47 | 6.04 | 6.34 |
| O | 1.87 | 2.11 | 2.37 | 3.48 | 4.78 | 4.04 |
| N | 0.65 | 0.68 | 0.15 | 0.33 | 0.57 | 0.32 |
| S | 2.66 | 2.45 | 1.45 | 1.07 | 0.25 | 0.32 |

FIG. 1 includes four X-ray diffraction patterns (Cu k α) of chromium deposits, labeled (a), (b), (d) and (d). The X-ray diffraction pattern labeled (a) is from an amorphous chromium deposit from a prior art trivalent chromium process and bath, and shows the typical pattern for an amorphous chromium deposit. The X-ray diffraction pattern labeled (b) is from a TEM crystalline, XRD amorphous nanogranular functional chromium alloy deposited in accordance with an embodiment of the present invention. The (b) pattern shows only that the deposit is XRD amorphous, since Cu K α X-rays cannot discern the nanogranular crystallinity of this deposit, which is clearly present as shown by the TEM diffraction pattern, such as that shown in FIG. 15. The X-ray diffraction pattern labeled (c) is from a TEM crystalline, XRD crystalline nanogranular functional chromium alloy deposited in accordance with another embodiment of the present invention. The (c) pattern shows that the crystallinity of this deposit is discernible to the Cu K α X-rays, and shows that the deposit is XRD crystalline. The X-ray diffraction pattern labeled (d) is from a crystalline functional chromium deposited from a hexavalent chromium process of the prior art.

Figure 2:
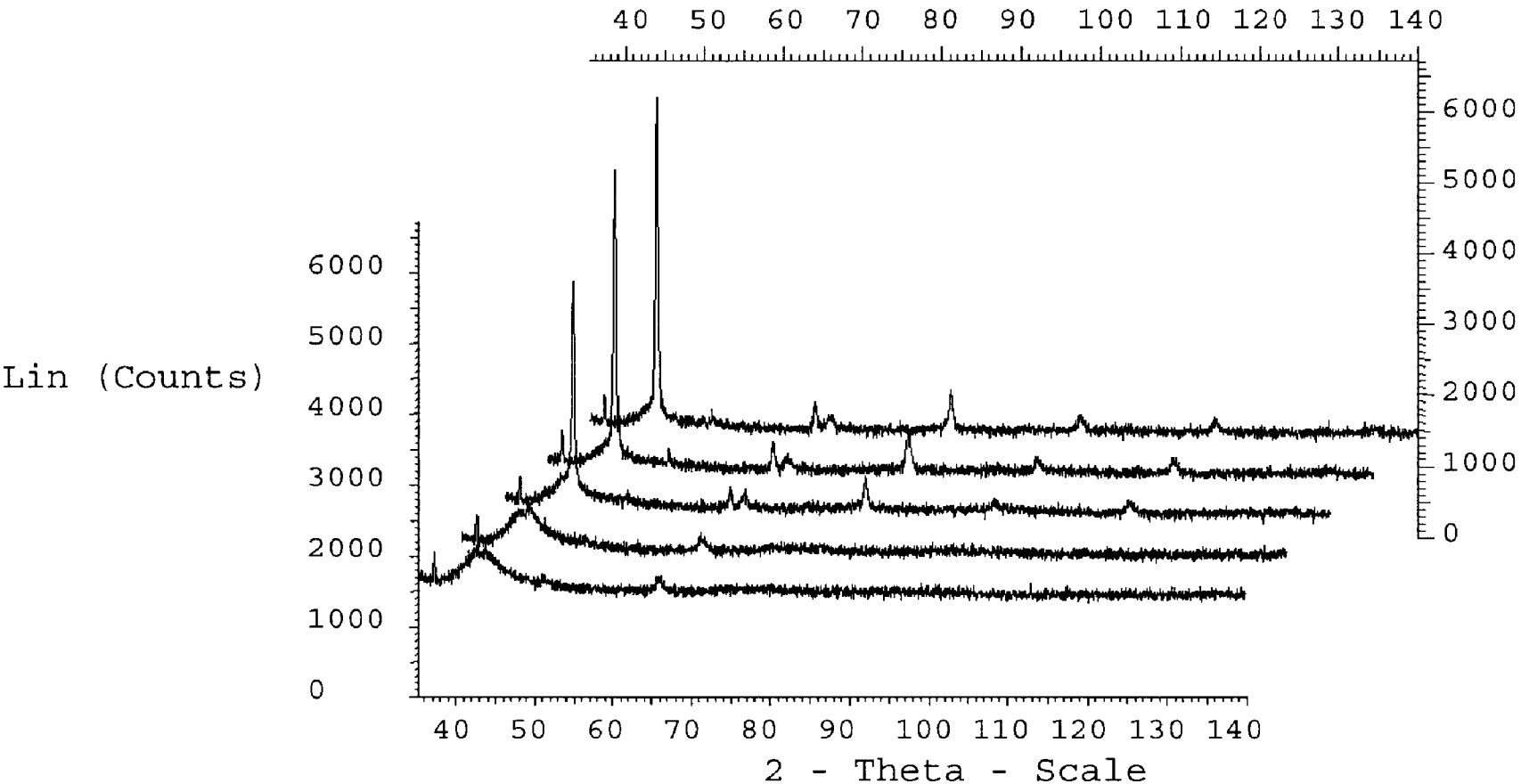
FIG. 2 is a typical X-ray diffraction pattern (Cu k alpha) showing the progressive effect of annealing an amorphous chromium deposit from a trivalent chromium bath of the prior art.

FIG. 2 is a series of typical X-ray diffraction pattern (Cu k alpha) showing the progressive effect of annealing an amorphous chromium deposit from a trivalent chromium bath of the prior art, containing no sulfur. In FIG. 2 there is shown a series of X-ray diffraction scans, starting at the lower portion and proceeding upward in FIG. 2, as the chromium deposit is annealed for longer and longer periods of time. As shown in FIG. 2, initially, the amorphous chromium deposit results in an initially amorphous X-ray diffraction pattern typical of an amorphous chromium similar to that of (a) in FIG. 1, but with continued annealing, the chromium deposit gradually crystallizes, resulting in a pattern of sharp peaks corresponding to the regularly occurring atoms in the ordered crystal structure. The lattice parameter of the annealed chromium deposit is in the 2.882 to 2.885 range, although the quality of this series is not good enough to measure accurately.

Figure 3:
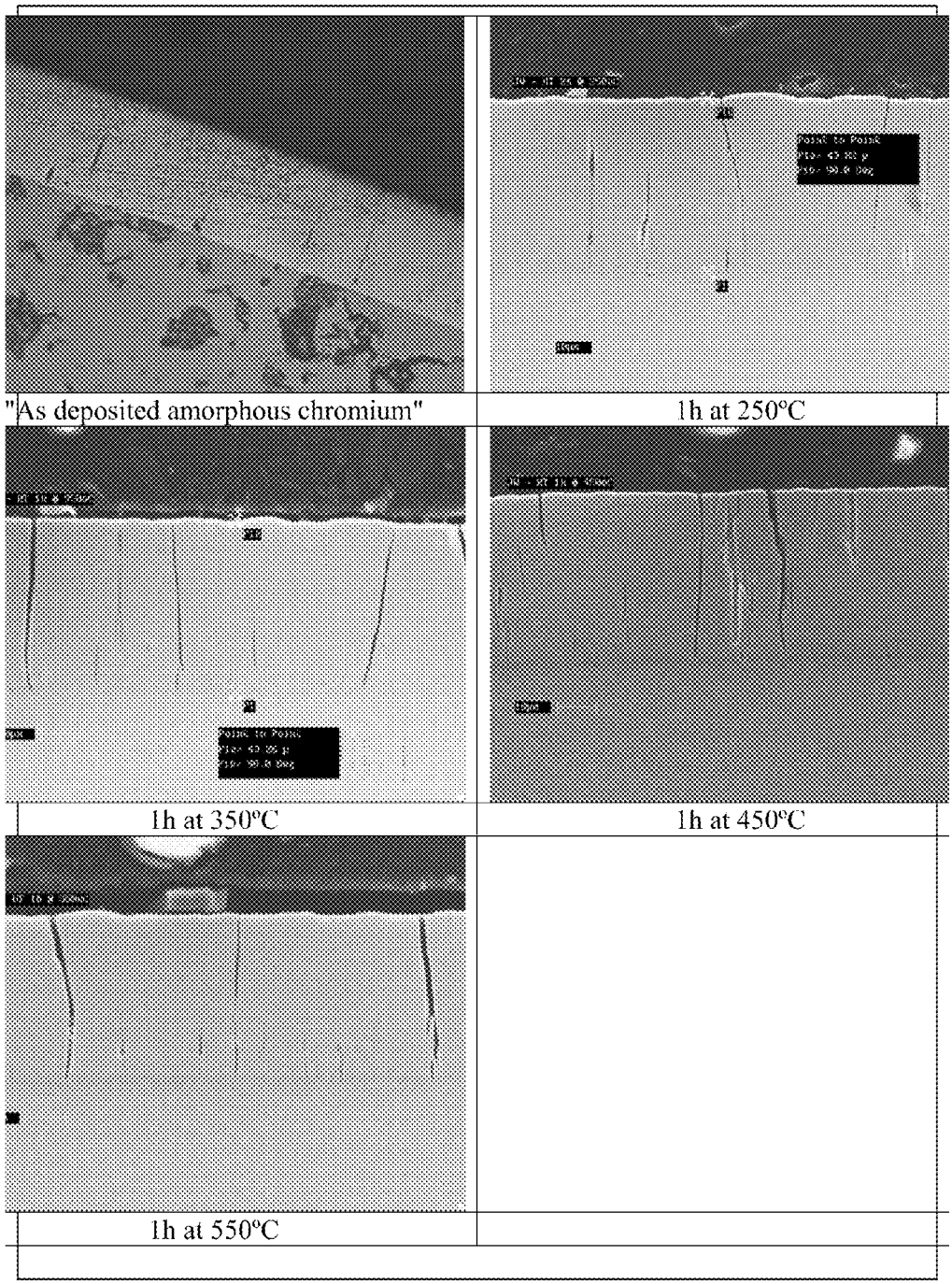
PRIOR ART FIG. 3
FIG. 3 is a series of electron photomicrographs showing the macrocracking effect of annealing an initially amorphous chromium deposit from a trivalent chromium bath of the prior art.

FIG. 3 is a series of electron photomicrographs of cross-sectioned chromium deposits showing the macrocracking effect of annealing an initially amorphous chromium deposit from a trivalent chromium bath of the prior art. In the photomicrograph labeled "As deposited amorphous chromium" the chromium layer is the lighter-colored layer deposited on the mottled-appearing substrate. In the photomicrograph labeled "1 h at 250° C.", after annealing at 250° C. for one hour, macrocracks have formed, while the chromium deposit crystallizes, the macrocracks extend through the thickness of the chromium deposit, down to the substrate. In this and the subsequent photomicrographs, the interface between the chromium deposit and the substrate is the faint line running roughly perpendicular to the direction of propagation of the macrocracks, and is marked by the small black square with "P1" within. In the photomicrograph labeled "1 h at 350° C.", after annealing at 350° C. for one hour, larger and more definite macrocracks have formed (compared to the "1 h at 250° C." sample), while the chromium deposit crystallizes, the macrocracks extend through the thickness of the chromium deposit, down to the substrate. In the photomicrograph labeled "1 h at 450° C.", after annealing at 450° C. for one hour, the macrocracks have formed and are larger than the lower temperature samples, while the chromium deposit crystallizes, the macrocracks extend through the thickness of the chromium deposit, down to the substrate. In the photomicrograph labeled "1 h at 550° C.", after annealing at 550° C. for one hour, the macrocracks have formed and appear to be larger yet than the lower temperature samples, while the chromium deposit crystallizes, the macrocracks extend through the thickness of the chromium deposit, down to the substrate.

Figure 4:
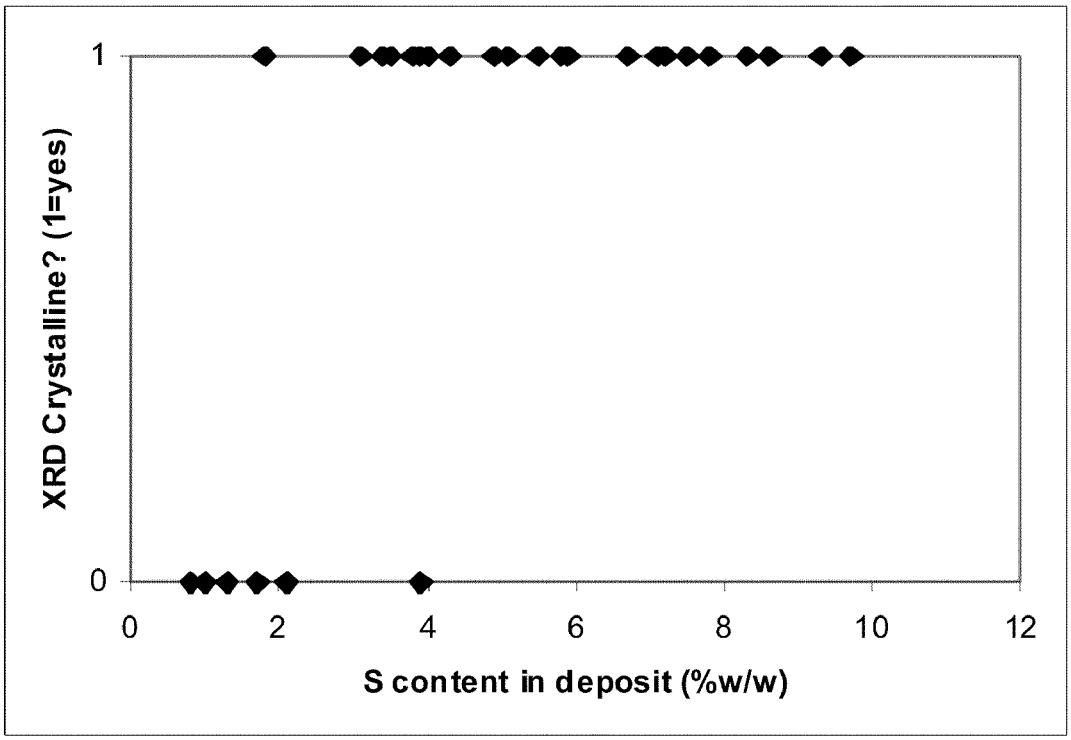
FIG. 4 is a graphical chart illustrating how the concentration of sulfur in one embodiment of a chromium deposit relates to the XRD crystallinity of the chromium deposit.

FIG. 4 is a graphical chart illustrating how the concentration of sulfur in one embodiment of a chromium deposit relates to the crystallinity of the chromium deposit. In the graph shown in FIG. 4, if the deposit is crystalline, the crystallinity axis is assigned a value of one, while if the deposit is amorphous, the crystallinity axis is assigned a value of zero. Thus, in the embodiment shown in FIG. 4, where the sulfur content of the chromium deposit ranges from about 1.7 wt. % to about 4 wt. %, the deposit is crystalline, while outside this range, the deposit is amorphous. It is noted in this regard, that the amount of sulfur present in a given crystalline chromium deposit can vary. That is, in some embodiments, a crystalline chromium deposit may contain, for example, about 1 wt. % sulfur and be crystalline, and in other embodiments, with this sulfur content, the deposit would be amorphous (as in the single point shown in FIG. 4). In other embodiments, a higher sulfur content, for example, up to about 20 wt. %, might be found in a chromium deposit that is crystalline, while in other embodiments, if the sulfur content is greater than 4 wt. %, the deposit may be amorphous. Thus, sulfur content is important, but not controlling and not the only variable affecting the crystallinity of the trivalent-derived chromium deposit.

It is noted that the XRD amorphous deposits shown in FIG. 4, in accordance with one embodiment of the present invention, can be TEM crystalline, despite being XRD amorphous.

Figure 5:
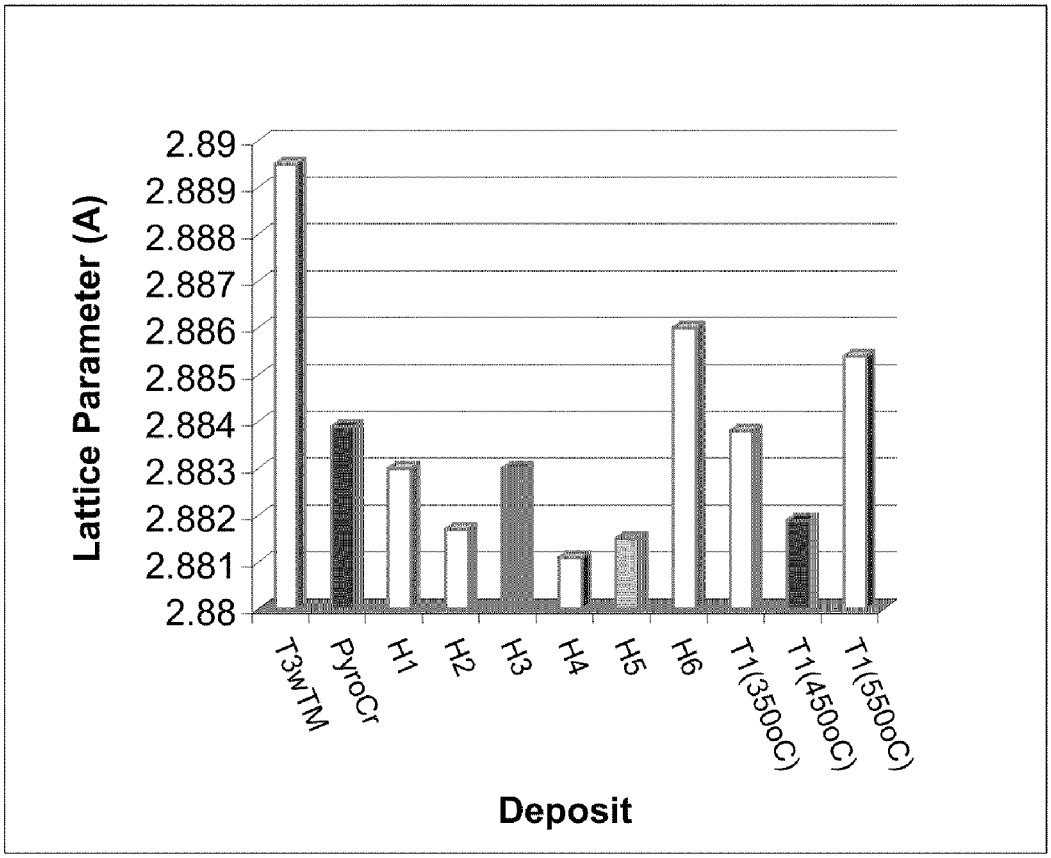
FIG. 5 is a graphical chart comparing the crystal lattice parameter, in Angstroms (Å) for (1) a crystalline chromium deposit in accordance with an embodiment of the present invention, compared with (2) crystalline chromium deposits from hexavalent chromium baths and (3) annealed amorphous-as-deposited chromium deposits.

FIG. 5 is a graphical chart comparing the crystal lattice parameter, in Angstroms (Å) for a crystalline chromium deposit in accordance with the present invention with crystalline chromium deposits from hexavalent chromium baths and annealed amorphous-as deposited chromium deposits. As shown in FIG. 5, the lattice parameter of a crystalline chromium deposit in accordance with the present invention is significantly greater and distinct from the lattice parameter of pyrometallurgically derived chromium ("PyroCr"), is significantly greater and distinct from the lattice parameters of all of the hexavalent chromium deposits ("H1"-"H6"), and is significantly greater and distinct from the lattice parameters of the annealed amorphous-as-deposited chromium deposits ("T1(350° C.)", "T1(450° C.)" and "T1(550° C.)"). The difference between the lattice parameters of the trivalent crystalline chromium deposits of the present invention and the lattice parameters of the other chromium deposits, such as those illustrated in FIG. 5, is statistically significant, at least at the 95% confidence level, according to the standard Student's 't' test.

FIGS. 6-9 relate to the present inventors' attempts to duplicate the process and obtain the deposit reported in the Sakamoto publication and have been discussed above.

Figure 10:
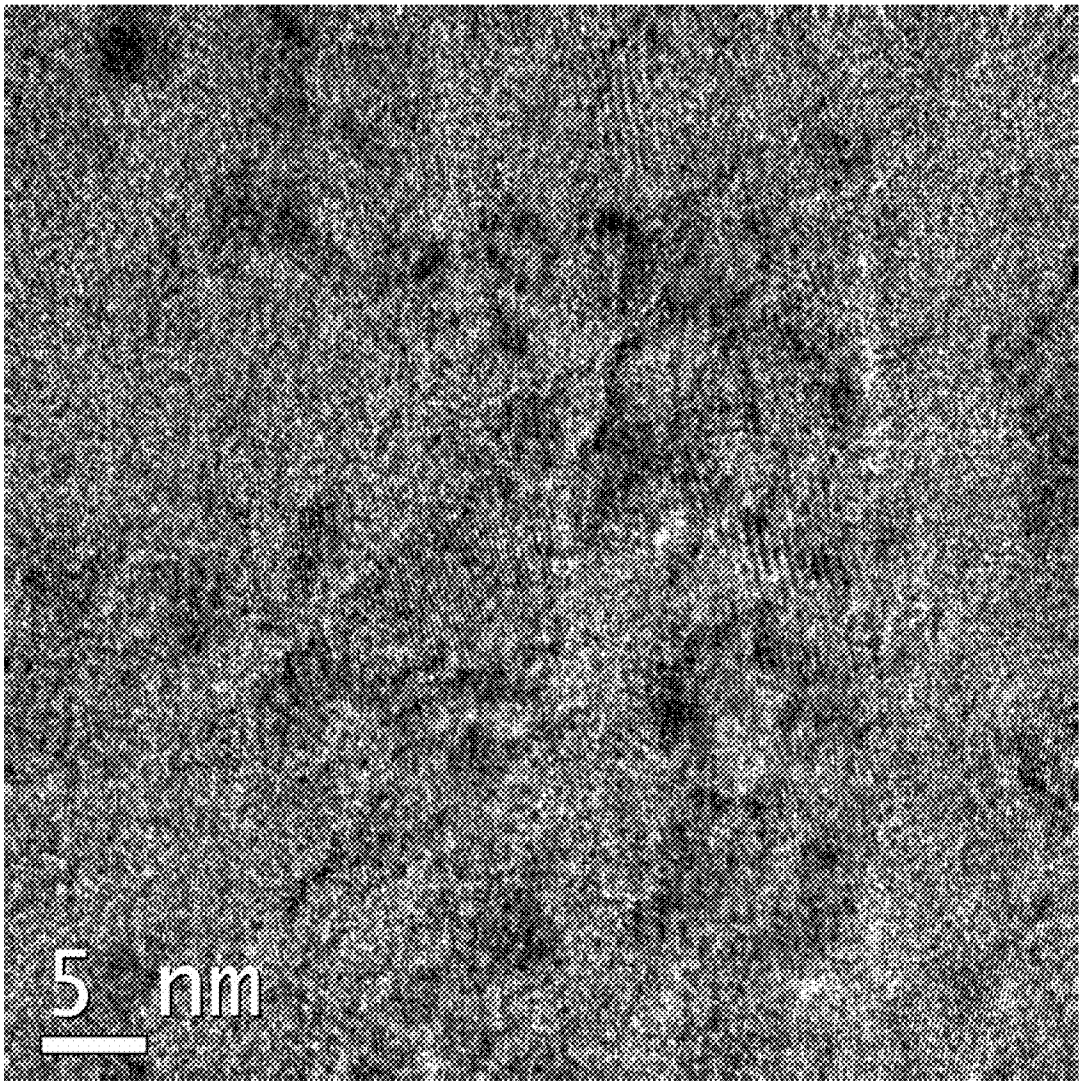
FIG. 10 is a high resolution transmission electron microscopy (TEM) photomicrograph of a focused ion beam cross sectioned lamella from a functional crystalline chromium deposit in accordance with the present invention.

FIG. 10 is a high resolution transmission electron microscopy photomicrograph of a cross sectioned lamella from a functional crystalline chromium deposit in accordance with the present invention, showing different lattice orientations corresponding to grain sizes less than 20 nm.

FIGS. 11-13 are dark field TEM photomicrographs of cross sectioned lamella from chromium deposits in accordance with two embodiments of the present invention, and of a chromium deposit obtained from a hexavalent plating bath, showing grains arranged in a disrupted fiber-like manner. These figures have been discussed above.

FIGS. 14-17 are TEM diffraction pattern photomicrographs of chromium deposits, in which the deposits are XRD crystalline, TEM crystalline but XRD amorphous, both XRD and TEM amorphous, and a conventional chromium deposit from a hexavalent chromium bath and process, respectively. These figures have been discussed above.

In one embodiment additional alloying of the crystalline chromium electrodeposit, in which the chromium has a lattice constant of 2.8895+/−0.0025 Å, may be performed using ferrous sulfate and sodium hypophosphite as sources of iron and phosphorous with and without the addition of 2 g/L thiosalicylic acid. Additions of 0.1 g/L to 2 g/L of ferrous ion to electrolyte T7 result in alloys containing 2 to 20% iron. The alloys are amorphous without the addition of thiosalicylic acid. Additions of 1 to 20 g/L sodium hypophosphite resulted in alloys containing 2 to 12% phosphorous in the deposit. The alloys were amorphous unless thiosalicylic acid is added.

In another embodiment, crystalline chromium deposits having a lattice constant of 2.8895+/−0.0025 Å are obtained from electrolyte T7 with 2 g/L thiosalicylic acid agitated using ultrasonic energy at a frequency of 25 kHz and 0.5 MHz. The resulting deposits are crystalline, having a lattice constant of 2.8895+/−0.0025 Å, bright, and there is no significant variation in deposition rate regardless of the frequency used.

It is noted that, throughout the specification and claims, the numerical limits of the disclosed ranges and ratios may be combined, and are deemed to include all intervening values. Thus, for example, where ranges of 1-100 and 10-50 are specifically disclosed, ranges of 1-10, 1-50, 10-100 and 50-100 are deemed to be within the scope of the disclosure, as are the intervening integral values. Furthermore, all numerical values are deemed to be preceded by the modifier "about", whether or not this term is specifically stated. Furthermore, when the chromium deposit is electrodeposited from a trivalent chromium bath as disclosed herein in accordance with the present invention, and the thus-formed deposit is stated herein as being crystalline, it is deemed to have a lattice constant of 2.8895+/−0.0025 Å, whether or not this lattice constant is specifically stated. Finally, all possible combinations of disclosed elements and components are deemed to be within the scope of the disclosure, whether or not specifically mentioned. That is, terms such as "in one embodiment" are deemed to disclose unambiguously to the skilled person that such embodiments may be combined with any and all other embodiments disclosed in the present specification.

While the principles of the invention have been explained in relation to certain particular embodiments, and are provided for purposes of illustration, it is to be understood that various modifications thereof will become apparent to those skilled in the art upon reading the specification. Therefore, it is to be understood that the invention disclosed herein is intended to cover such modifications as fall within the scope of the appended claims. The scope of the invention is limited only by the scope of the claims.

The invention claimed is:

1. A process for electrodepositing a nanogranular functional crystalline chromium alloy deposit on a substrate, comprising:

providing an electrodeposition bath, wherein the bath is prepared by combining ingredients comprising trivalent chromium, a source of divalent sulfur, a carboxylic acid, a source of $sp^3$ nitrogen, wherein the bath is substantially free of hexavalent chromium;

immersing a substrate in the electroplating bath; and applying an electrical current to electrodeposit a functional crystalline chromium alloy on the substrate, wherein the chromium alloy comprises chromium, carbon, nitrogen, oxygen and sulfur, and the chromium alloy is crystalline and nanogranular as deposited;

wherein the source of divalent sulfur is present in the electrodeposition bath at a concentration from about 0.0001 M to about 0.05 M and the electrodeposition bath comprises a pH in the range from 5 to about 6.5.

2. The process of claim 1 wherein the chromium alloy is both TEM and XRD crystalline.

3. The process of claim 1 wherein the chromium alloy is TEM crystalline and is XRD amorphous.

4. The process of claim 1 wherein the chromium alloy comprises one or any combination of two or more of:

a {111} preferred orientation;

an average crystal grain cross-sectional area of less than about 500 $nm^2$; and a lattice parameter of 2.8895+/−0.0025 A.

5. The process of claim 1 wherein the chromium alloy comprises from about 0.05 wt. % to about 20 wt. % sulfur.

6. The process of claim 1 wherein the chromium alloy comprises from about 0.1 to about 5 wt % nitrogen.

7. The process of claim 1 wherein the chromium alloy comprises an amount of carbon less than that amount which renders the chromium alloy amorphous.

8. The process of claim 1 wherein the chromium alloy comprises from about 0.07 wt. % to about 1.4 wt. % sulfur, from about 0.1 wt. % to about 3 wt. % nitrogen, from about 0.5 wt. % to about 7 wt. % oxygen, and from about 0.1 wt. % to about 10 wt. % carbon.

9. The process of claim 1 wherein the chromium alloy remains substantially free of macrocracking when subjected to a temperature of at least 190° C. for at least 3 hours and has a thickness in the range from about 3 microns to about 1000 microns.

10. The process of claim 1 wherein the source of $sp^3$ nitrogen comprises ammonium hydroxide or a salt thereof, a primary, secondary or tertiary alkyl amine, in which the alkyl group is a $C_1$-$C_6$ alkyl, an amino acid, a hydroxy amine, or a polyhydric alkanolamines, wherein alkyl groups in the source of nitrogen comprise $C_1$-$C_6$ alkyl groups.

11. The process of claim 1 wherein the carboxylic acid comprises one or more of formic acid, oxalic acid, glycine, acetic acid, and malonic acid or a salt of any thereof.

12. The process of claim 1 wherein the source of divalent sulfur comprises one or a mixture of two or more of:

thiomorpholine, thiodiethanol,

L-cysteine,

L-cystine, allyl sulfide, thiosalicylic acid, thiodipropanoic acid, 3,3'-dithiodipropanoic acid, 3-(3-aminopropyl disulfanyl)propylamine hydrochloride,

[1,3]thiazin-3-ium chloride, thiazolidin-3-ium dichloride, a compound referred to as a 3-(3-aminoalkyl disulfenyl) alkylamine having the formula:

$$R_3N^{\oplus}—(CH_2)_n—S—S—(CH_2)_m—^{\oplus}NR^1{}_32X^{\ominus}$$

wherein R and $R^1$ are independently H, methyl or ethyl and n and m are independently 1-4; or a compound referred to as a [1,3]thiazin-3-ium having the formula:

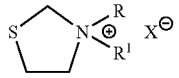

wherein R and $R^1$ are independently H, methyl or ethyl; or a compound referred to as a thiazolidin-3-ium having the formula:

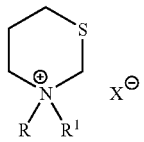

wherein R and $R^1$ are independently H, methyl or ethyl; and wherein in each of the foregoing, X is any halide or an anion other than nitrate (—$NO_3^-$), comprising one or more of cyano, formate, citrate, oxalate, acetate, malonate, $SO_4^{-2}$, $PO_4^{-3}$, $H_2PO_3^{-1}$, $H_2PO_2^{-1}$, pyrophosphate ($P_2O_7^{-4}$), polyphosphate ($P_3O_{10}^{-5}$), partial anions of the foregoing multivalent anions, $C_1$-$C_{18}$ alkyl sulfonic acids, $C_1$-$C_{18}$ benzene sulfonic acids, and sulfamate.

13. The process of claim 1 wherein the applying an electrical current is carried out for a time sufficient to form the chromium alloy to a thickness of at least 3 microns.

14. An electrodeposition bath for electrodepositing a functional nanogranular crystalline chromium alloy, wherein the chromium alloy comprises chromium, carbon, nitrogen, oxygen and sulfur, and the bath comprises an aqueous solution obtained by combining ingredients comprising:

a source of trivalent chromium having a concentration of least 0.1 molar and being substantially free of added hexavalent chromium;

a carboxylic acid;

a source of $sp^3$ nitrogen;

a source of divalent sulfur, at a concentration in the range from about 0.0001 M to about 0.05 M; and wherein the bath further comprises:

a pH in the range from 5 to about 6.5;

an operating temperature in the range from about 35° C. to about 95° C.; and a source of electrical energy to be applied between an anode and a cathode immersed in the electrodeposition bath.

15. The electrodeposition bath of claim 14 wherein the source of divalent sulfur comprises one or a mixture of two or more of:

thiomorpholine,
thiodiethanol,
L-cysteine,
L-cystine,
allyl sulfide,
thiosalicylic acid,
thiodipropanoic acid,
3,3'-dithiodipropanoic acid,
3-(3-aminopropyl disulfanyl)propylamine hydrochloride,
[1,3]thiazin-3-ium chloride,
thiazolidin-3-ium dichloride,
a compound referred to as 3-(3-aminoalkyl disulfenyl)alkylamine having the formula:

$$R_3N^{\oplus}—(CH_2)_n—S—S—(CH_2)_m—^{\oplus}NR^1{}_3 2X^{\ominus}$$

wherein R and $R^1$ are independently H, methyl or ethyl and n and m are independently 1-4; or a compound referred to as a [1,3]thiazin-3-ium having the formula:

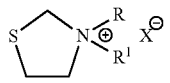

wherein R and $R^1$ are independently H, methyl or ethyl; or a compound referred to as a thiazolidin-3-ium having the formula:

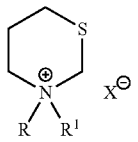

wherein R and $R^1$ are independently H, methyl or ethyl; and wherein in each of the foregoing, X is any halide or an anion other than nitrate ($—NO_3^-$), comprising one or more of cyano, formate, citrate, oxalate, acetate, malonate, $SO_4^{-2}$, $PO_4^{-3}$, $H_2PO_3^{-1}$, $H_2PO_2^{-1}$, pyrophosphate ($P_2O_7^{-4}$), polyphosphate ($P_3O_{10}^{-5}$), partial anions of the foregoing multivalent anions, $C_1$-$C_{18}$ alkyl sulfonic acids, $C_1$-$C_{18}$ benzene sulfonic acids, and sulfamate.

16. The electrodeposition bath of claim 14 wherein the source of electrical energy is capable of providing a current density of at least 10 A/dm$^2$ based on an area of substrate to be plated.

17. The electrodeposition bath of claim 14 wherein the bath contains a quantity of the source of nitrogen sufficient that the chromium alloy comprises from about 0.1 to about 5 wt % nitrogen.

18. The electrodeposition bath of claim 14 wherein the bath contains a quantity of the carboxylic acid sufficient that the chromium alloy comprises an amount of carbon less than that amount which renders the chromium alloy amorphous.

19. The electrodeposition bath of claim 14 wherein the bath contains a quantity of the source of divalent sulfur, the source of nitrogen and the carboxylic acid sufficient that the chromium alloy comprises from about 0.05 wt. % to about 1.4 wt. % sulfur, from about 0.1 wt. % to about 3 wt. % nitrogen, from about 0.5 wt. % to about 7 wt. % oxygen, and from about 0.1 wt. % to about 10 wt. % carbon.

20. The electrodeposition bath of claim 14 wherein the carboxylic acid comprises one or more of formic acid, oxalic acid, glycine, acetic acid, and malonic acid or a salt of any thereof.

21. The electrodeposition bath of claim 14 wherein the source of $sp^3$ nitrogen comprises ammonium hydroxide or a salt thereof, a primary, secondary or tertiary alkyl amine, in which the alkyl group is a $C_1$-$C_6$ alkyl, an amino acid, a hydroxy amine, or a polyhydric alkanolamines, wherein alkyl groups in the source of nitrogen comprise $C_1$-$C_6$ alkyl groups.

22. The electrodeposition bath of claim 14 wherein the bath comprises the source of divalent sulfur at a concentration sufficient to obtain either (a) a chromium alloy that is both TEM and XRD crystalline, as deposited or (b) a chromium alloy that is TEM crystalline and XRD amorphous, as deposited.

* * * * *